US009354029B2

(12) United States Patent
Mace et al.

(10) Patent No.: US 9,354,029 B2
(45) Date of Patent: May 31, 2016

(54) DETONATION COMMAND AND CONTROL

(71) Applicant: Los Alamos National Security, LLC, Los Alamos, NM (US)

(72) Inventors: Jonathan L. Mace, Los Alamos, NM (US); Gerald J. Seitz, El Rancho, NM (US); John A. Echave, Los Alamos, NM (US); Pierre-Yves Le Bas, Los Alamos, NM (US)

(73) Assignee: Los Alamos National Security, LLC, Los Alamos, NM (US)

( * ) Notice: Subject to any disclaimer, the term of this patent is extended or adjusted under 35 U.S.C. 154(b) by 0 days.

(21) Appl. No.: 14/878,969

(22) Filed: Oct. 8, 2015

(65) Prior Publication Data

US 2016/0033248 A1 Feb. 4, 2016

Related U.S. Application Data

(62) Division of application No. 14/370,209, filed as application No. PCT/US2013/021475 on Jan. 14, 2013, now Pat. No. 9,181,790.

(60) Provisional application No. 61/586,576, filed on Jan. 13, 2012.

(51) Int. Cl.
*F42D 1/045* (2006.01)
*F42D 1/05* (2006.01)
(Continued)

(52) U.S. Cl.
CPC ..... *F42D 1/042* (2013.01); *C06B 25/34* (2013.01); *E21B 43/263* (2013.01); *F23Q 21/00* (2013.01);
(Continued)

(58) Field of Classification Search
CPC ..... F42D 1/00; F42D 1/02; F42D 1/04; F42D 1/042; F42D 1/045; F42D 1/05; F42D 1/055; F42D 3/00; F42D 3/04; F42D 3/06; F42B 3/00; F42B 3/02; F42B 3/10; F42C 15/40; F42C 15/42; E21B 43/1185; E21B 43/11857; E21B 43/263; F23Q 21/00
USPC ..... 102/301, 311, 312, 313, 200, 206, 215, 102/217, 270
See application file for complete search history.

(56) References Cited

U.S. PATENT DOCUMENTS 2,921,519 A 1/1960 Martin
3,150,590 A 9/1964 Silverman
(Continued)

FOREIGN PATENT DOCUMENTS

GB 2141529 A 12/1984
WO WO 2007/141604 12/2007
(Continued)

OTHER PUBLICATIONS

International Search Report and Written Opinion dated Sep. 5, 2013; issued in corresponding PCT Application No. PCT/2013/021479, filed Jan. 14, 2013.
(Continued)

*Primary Examiner* — James S Bergin
(74) *Attorney, Agent, or Firm* — Klarquist Sparkman, LLP

(57) ABSTRACT

The detonation of one or more explosive charges and propellant charges by a detonator in response to a fire control signal from a command and control system comprised of a command center and instrumentation center with a communications link therebetween. The fire control signal is selectively provided to the detonator from the instrumentation center if plural detonation control switches at the command center are in a fire authorization status, and instruments, and one or more interlocks, if included, are in a ready for firing status. The instrumentation and command centers are desirably mobile, such as being respective vehicles.

14 Claims, 42 Drawing Sheets

(51) Int. Cl.

| | |
|---|---|
| ***F42D 3/00*** | (2006.01) |
| ***F42C 15/42*** | (2006.01) |
| ***E21B 43/263*** | (2006.01) |
| ***F23Q 21/00*** | (2006.01) |
| ***F42D 1/04*** | (2006.01) |
| ***F42D 3/04*** | (2006.01) |
| ***C06B 25/34*** | (2006.01) |
| ***F42B 3/02*** | (2006.01) |
| ***F42B 3/10*** | (2006.01) |
| ***F42D 1/02*** | (2006.01) |
| ***F42D 3/06*** | (2006.01) |

(52) U.S. Cl.

CPC ... *F42B 3/02* (2013.01); *F42B 3/10* (2013.01); *F42C 15/42* (2013.01); *F42D 1/02* (2013.01); *F42D 1/045* (2013.01); *F42D 1/05* (2013.01); *F42D 3/00* (2013.01); *F42D 3/04* (2013.01); *F42D 3/06* (2013.01); *Y10T 29/49826* (2015.01)

(56) References Cited

U.S. PATENT DOCUMENTS

| | | | | |
|---|---|---|---|---|
| 3,276,371 | A | 10/1966 | Newman | |
| 3,329,219 | A | 7/1967 | Pausky | |
| 3,448,801 | A | 6/1969 | Closmann et al. | |
| 3,580,171 | A | 5/1971 | Maes | |
| 3,650,212 | A | 3/1972 | Bauer | |
| 3,764,419 | A | 10/1973 | Sheeran | |
| 4,284,006 | A | 8/1981 | Davis | |
| 4,391,337 | A | 7/1983 | Ford et al. | |
| 4,484,641 | A | 11/1984 | Dismukes | |
| 4,586,437 | A | 5/1986 | Miki et al. | |
| 4,590,997 | A | 5/1986 | Stowe | |
| 4,674,047 | A | 6/1987 | Tyler et al. | |
| 4,819,560 | A | 4/1989 | Patz et al. | |
| 4,870,902 | A | 10/1989 | Simon et al. | |
| 4,884,506 | A | 12/1989 | Guerreri | |
| 4,984,518 | A | 1/1991 | Yarrington | |
| 5,052,489 | A | 10/1991 | Carisella et al. | |
| 5,155,293 | A | 10/1992 | Barton | |
| 5,295,545 | A | 3/1994 | Passamaneck | |
| 5,317,973 | A | 6/1994 | Winaver et al. | |
| 5,379,676 | A | 1/1995 | Profeta et al. | |
| 5,539,636 | A | 7/1996 | Marsh et al. | |
| 5,598,891 | A | 2/1997 | Snider et al. | |
| 5,714,712 | A | 2/1998 | Ewick et al. | |
| 6,300,764 | B1 | 10/2001 | Kelley | |
| 6,336,506 | B2 | 1/2002 | Wesson | |
| 6,422,145 | B1 | 7/2002 | Gavrilovic et al. | |
| 6,851,369 | B2 * | 2/2005 | Hummel | F42C 15/42 102/200 |
| 6,997,996 | B1 | 2/2006 | Manning et al. | |
| 7,273,108 | B2 | 9/2007 | Misselbrook | |
| 7,755,878 | B2 | 7/2010 | Van Wyk et al. | |
| 7,861,785 | B2 | 1/2011 | Frazier et al. | |
| 7,929,270 | B2 * | 4/2011 | Hummel | F42D 3/04 361/249 |
| 8,369,062 | B2 | 2/2013 | Fisher et al. | |
| 8,390,979 | B2 * | 3/2013 | Hurley | F42D 1/055 102/217 |
| 8,474,379 | B2 | 7/2013 | Jacobson et al. | |
| 8,499,679 | B1 | 8/2013 | Crowell | |
| 9,181,790 | B2 * | 11/2015 | Mace | F23Q 21/00 |
| 2001/0001418 | A1 | 5/2001 | Wesson | |
| 2003/0037692 | A1 | 2/2003 | Liu | |
| 2006/0185898 | A1 | 8/2006 | Seekford | |
| 2010/0096136 | A1 | 4/2010 | Bourne | |
| 2010/0170411 | A1 | 7/2010 | Ballantine et al. | |
| 2011/0056400 | A1 | 3/2011 | Fisher et al. | |
| 2011/0174181 | A1 | 7/2011 | Plummer et al. | |
| 2012/0006217 | A1 | 1/2012 | Anderson | |
| 2013/0161007 | A1 | 6/2013 | Wolfe et al. | |
| 2013/0192829 | A1 | 8/2013 | Fadul et al. | |
| 2014/0338894 | A1 | 11/2014 | Mace et al. | |
| 2014/0366761 | A1 | 12/2014 | Mace et al. | |
| 2014/0373743 | A1 | 12/2014 | Mace et al. | |
| 2014/0374084 | A1 | 12/2014 | Mace et al. | |

FOREIGN PATENT DOCUMENTS

| | | |
|---|---|---|
| WO | WO 2013/106850 | 7/2013 |
| WO | WO 2013/147980 | 10/2013 |
| WO | WO 2013/151603 | 10/2013 |
| WO | WO 2013/151604 | 10/2013 |
| WO | WO 20131154628 | 10/2013 |

OTHER PUBLICATIONS

International Search Report and Written Opinion dated Mar. 21, 2013; issued in corresponding PCT Application No. PCT/2013/021475, filed Jan. 14, 2013.

International Search Report and Written Opinion dated Sep. 20, 2013; issued in corresponding PCT Application No. PCT/US2013/021491, filed Jan. 14, 2013.

International Search Report and Written Opinion dated Sep. 4, 2013; issued in corresponding PCT Application No. PCT/US2013/021484, filed Jan. 14, 2013.

Gustavsen et al., "Detonation Wave Profiles in HMX Based Explosives," Los Alamos National Laboratory; Apr. 15, 1998; retrieved from the Internet on Sep. 11, 2013; 7 pages; URL: <http://www.fas.org/sgp/othergov/doe/lanl/libwww/la-pubs/00412738.pdf> (entire document).

International Search Report and Written Opinion for International Application No. PCT/2014/046739, 11 pages, mailed Nov. 4, 2014.

International Search Report and Written Opinion for International Application No. PCT/2014/046742, 7 pages, mailed Nov. 4, 2014.

International Search Report and Written Opinion for International Application No. PCT/2014/046744, 5 pages, mailed Nov. 4, 2014.

Office Action mailed for U.S. Appl. No. 14/371,696 mailed Feb. 1, 2016.

Office Action mailed for U.S. Appl. No. 14/371,700 mailed Feb. 2, 2016.

* cited by examiner

CONTROL REFERS TO COMMAND VEHICLE SUBSYSTEM
MONITOR REFERS TO INSTRUMENTATION VEHICLE SUBSYSTEM

DETONATION COMMAND AND CONTROL

CROSS REFERENCE TO RELATED APPLICATIONS

This is a divisional patent application of a claims priority under 35 U.S.C. 121 to U.S. patent application Ser. No. 14/370,209, filed on Jul. 1, 2014, titled "Detonation Command and Control," which application is the U.S. National Stage of International Application No. PCT/US2013/021475, filed Jan. 13, 2013, which was published in English under PCT Article 21(2), which in turn claims the benefit of U.S. Provisional Patent Application No. 61/586,576, filed Jan. 13, 2012, entitled "Explosive Compositions, Systems and Methods of Use Thereof". All of the foregoing applications are hereby incorporated by reference herein in their entirety.

ACKNOWLEDGMENT OF GOVERNMENT SUPPORT

The invention was made with government support under Contract No. DE-AC52-06NA25396 awarded by the U.S. Department of Energy. The government has certain rights in the invention.

FIELD

This application is related to a command and control systems, apparatus and methods for detonating one or more explosive charges and/or initiating one or more propellant charges. The system can be used, for example, in testing explosives, and other applications including use in geologic fracturing, such as in relation to accessing geologic energy resources.

PARTIES TO JOINT RESEARCH AGREEMENT

The research work described here was performed under a Cooperative Research and Development Agreement (CRADA) between Los Alamos National Laboratory (LANL) and Chevron under the LANL-Chevron Alliance, CRADA number LA05C10518-PTS-21.

BACKGROUND

Resources such as oil, gas, water and minerals may be extracted from geologic formations, such as deep shale formations, by creating propped fracture zones within the formation, thereby enabling fluid flow pathways. For hydrocarbon based materials encased within tight geologic formations, this fracturing process is typically achieved by a process known as hydraulic fracturing. Hydraulic fracturing is the propagation of fractures in a rock layer caused by the presence of a pressurized fracture fluid. This type of fracturing is done from a wellbore drilled into reservoir rock formations. The energy from the injection of a highly-pressurized fracking fluid creates new channels in the rock which can increase the extraction rates and ultimate recovery of hydrocarbons. The fracture width may be maintained after the injection is stopped by introducing a proppant, such as grains of sand, ceramic, or other particulates into the injected fluid. Although this technology has the potential to provide access to large amounts of efficient energy resources, the practice of hydraulic fracturing has come under scrutiny internationally due to concerns about the environmental impact, health and safety of such practices. Environmental concerns with hydraulic fracturing include the potential for contamination of ground water, risks to air quality, possible release of gases and hydraulic fracturing chemicals to the surface, mishandling of waste, and the health effects of these. In fact, hydraulic fracturing has been suspended or even banned in some countries.

Therefore, a need exists for alternative methods of recovering energy resources trapped within geologic formations.

SUMMARY

A command and control system, apparatus and methods are disclosed for controlling the detonation of one or more explosive charges and propellant charges by a detonator.

As is explained below, detonation includes deflagration and also includes initiation of propellant charges if present. In the examples where a capacitor is charged and then discharged to set off a detonator or to initiate a propellant initiator, a high voltage source is typically used to provide this charge. In addition, a fire control signal can be provided by the detonation control system or apparatus to a switch operable to discharge the capacitor to a detonator. Similarly, the fire control signal can control the initiation of combustion of propellant charges. The detonators for respective explosive charges and propellant charges (in which case the detonators would typically comprise propellant initiators) can be controlled to respond to the fire control signal at the same or different times. The exemplary system, apparatus and methods can be used both in the context of detonating explosives for experiments and field testing, such as to determine and evaluate the results of explosions from various explosive charge designs, as well as in commercial applications, such as detonating charges in an underground bore or otherwise positioned underground to fracture rock for petroleum recovery purposes.

In one embodiment, the command and control system comprises: a mobile command vehicle, the command vehicle comprising a first switch operable to provide a first authorized to fire control signal in response to actuation of the first switch to a first switch authorized to fire position; a second switch operable to provide a second authorized to fire control signal in response to actuation of the second switch to a second switch authorized to fire position; command computing hardware configured to provide a third switch operable to provide a third authorized to fire control signal in response to actuation of the third switch to a third authorized to fire position. In accordance with this embodiment, the command computing hardware can also being configured to receive signals corresponding to the status of plural instruments and at least one interlock. In addition, in this embodiment, a mobile instrumentation vehicle is provided spaced from the command vehicle, the instrumentation vehicle comprising a plurality of instrumentation inputs (which can comprise input/outputs) each for coupling to a respective associated instrument for receiving instrument status signals indicating the status of the associated instrument and for receiving instrument data signals corresponding to the data collected by the associated instrument. The instrumentation vehicle in this embodiment also comprising at least one interlock input for coupling to a respective associated interlock for receiving interlock status signals indicating the status of the associated interlock. The instrumentation vehicle further comprising fire set and control system (FSCS) computing hardware operable to receive: (i) signals corresponding to the instrument status and instrument data signals, (ii) signals corresponding to the at least one interlock status signal, and (iii) signals corresponding to the first, second and third authorized to fire control signals. In accordance with this embodiment, the FSCS computing hardware is configured to provide FSCS computing hardware output signals corresponding to the instrument status and instrument data signals and corresponding to the at least one interlock status signal and is also configured to provide a firing control signal for causing the firing of the detonation device to detonate the one or more explosive charges and propellant charges in response to the firing control signal. In this embodiment, the FSCS computing hardware provides the firing control signal in response to the plural instruments and at least one interlock having a status corresponding to an authorized to fire status. In accordance with this embodiment, a communication network, which can be a wireless or a wired network, is coupled to the command computing hardware and to the FSCS computing hardware. The communication network is operable to provide communications between the command vehicle and the instrumentation vehicle so as to: (i) transmit signals corresponding to the FSCS computing hardware output signals and thereby corresponding to the status of said at least one interlock, corresponding to the status of the plural instruments, and corresponding to the instrument data signals, from the instrumentation vehicle to the command vehicle for receipt by the command computer hardware; and (ii) signals corresponding to the first, second and third authorized to fire control signals from the command vehicle to the instrumentation vehicle for receipt by the FSCS computing hardware.

In accordance with another aspect of an embodiment, command and control system computing hardware can comprise a display and be operable to display the status of: (i) the first, second and third switches; (ii) the plural instruments; and (iii) the at least one interlock. The command computing hardware display can comprise a display configured to simultaneously display the status of the plural instruments and at least one interlock, the status of the first switch, the status of the second switch and the status of the third switch.

In accordance with a further aspect of an embodiment, the command computing hardware can be configured to block the transmission of the third authorized to fire control signal in the event the plural instruments and at least one interlock are not in their desired or acceptable status for firing as determined from the signals corresponding to the instrument status signals and corresponding to the at least one interlock status signal.

As yet another aspect of an embodiment, FSCS computing hardware and command computing hardware are desirably configured to monitor the communication network to verify that the communication network is operable, and wherein the FSCS computing hardware is configured to block the provision of the firing control signal if the communication network is not operable. As a more specific aspect of an embodiment, the command computing hardware and FSCS computing hardware can be configured to provide respective test data packets and responsive test data packets for transmission from the command vehicle to the instrumentation vehicle and from the instrumentation vehicle to the command vehicle via the communication network, the command computing hardware. The FSCS computing hardware being configured in accordance with this more specific aspect to determine that the communication network is not operable in the event: (i) there is a lack of correspondence between a test data packet from the command vehicle and a responsive test data packet from the instrumentation vehicle or between a test data packet from the instrumentation vehicle and a responsive data packet from the command vehicle; or (ii) test data packets transmitted and responsive test data packets transmitted between the instrumentation vehicle and command vehicle are not received within a predetermined time.

As a still further aspect of an embodiment, the FSCS computing hardware can comprise an interrupt manager configured to comprise the instrumentation inputs and at least one interlock input so as to receive signals corresponding to the status of the plural instruments and to the status of the at least one interlock.

The plural instruments, in accordance with an embodiment may be considered to be separate from the command and control center or considered to be a part of the command and control center. The instruments can be any desirable instruments, such as one or more of stress gauges, a fast framing camera, a high speed video camera, an X-ray device, and a photon Doppler velocimetry (PDV) system, as well as other instruments.

As a further aspect of an embodiment, an instrumentation vehicle can comprise a plurality of instrumentation outputs each for coupling to a respective associated instrument for sending instrument control signals to control the associated instrument. These outputs can be in the form of or comprise input/outputs can be provided for both sending and receiving signals from the associated instruments In accordance with another aspect of an embodiment, the detonator can be of a type that is detonated in response to the discharge of a capacitive discharge unit (CDU). The FSCS computing hardware in accordance with this embodiment can be configured to provide a CDU discharge control signal to cause the discharge of the CDU to ground potential in the event any one or more of the plural instruments and at least one interlock are not in their authorized to fire status.

In accordance with another embodiment, an apparatus is disclosed for controlling the detonation of an explosive by a detonator. In this embodiment, the apparatus comprises: a movable command center; the command center comprising at least one manually controlled switch operable to produce a first fire authorization signal when said at least one switch is in a detonate explosive position; and the command center comprising command center computing hardware configured to cause the generation of a second fire authorization signal in response to actuation of displayed fire command switch to a detonate explosive position. In addition, in accordance with this embodiment, the apparatus also comprises a movable instrumentation center physically spaced from and movable relative to the movable command center. The instrumentation center comprises, in this embodiment, fire setting and control system (FSCS) computing hardware having an output for coupling to the detonator and configured to selectively provide a fire control signal to cause detonation of the detonator and explosion of the explosive. In this embodiment, the FSCS computing hardware also comprises plural inputs (which can comprise input/outputs) coupled to a plurality of instruments for receiving instrument status signals corresponding to the operational status of such instruments and instrument data signals corresponding to data signals from such instruments such as resulting from detonation of the explosive or otherwise. In this embodiment, the FSCS computing hardware is configured to selectively provide a fire control signal to cause the detonation of the detonator to detonate the explosive in response to the first and second fire authorization signals providing that the status of the instruments determined based on the instrument status signals is acceptable for detonating the explosive. The status of one or more interlocks, if provided, can also be required to be acceptable as a condition of the fire control signal being provided. In addition, this embodiment of an apparatus also comprises a communication network, that can be wired or wireless, that is operable to communicate signals from the command center to the instrumentation center and from the instrumentation center to the command center, such communicated signals corresponding to the first and second fire authorization signals, corresponding to the instrument status signals and corresponding to the instrument data signals. In addition, in this embodiment of the apparatus, the FSCS computing hardware and command computing hardware can be configured to test the operability of the communication network and to prevent the detonation of the detonator and explosion of the explosive in the event the communication network is determined to be inoperative.

As another aspect of an embodiment, the command center can comprise at least a second manually controlled switch operable to produce a third fire authorization signal when said second manually controlled switch is in a detonate explosive position. In addition, the FSCS computing hardware in accordance with this aspect is configured to selectively provide the fire control signal in response to the first, second and third fire authorization signals providing that the status of the instruments determined based on the instrument status signals is acceptable.

In accordance with yet another aspect, the first fire authorization signal can be dependent upon the position of a key of a key actuated switch and the third fire authorization can be dependent upon the position of a dead man switch.

In accordance with a further aspect, the command center can be at a first location spaced a first distance from the explosive to be detonated and the instrumentation center can be at a second location spaced a second distance from the explosive to be detonated, and wherein the first distance is greater than the second distance.

In accordance with yet another aspect, both the command center and the instrumentation center can comprise mobile vehicles. In addition, the mobile vehicles can each comprise a trailer.

As yet another aspect, the command computer hardware and the FSCS computer hardware can each be configured to monitor the communications network by causing the sending of test signals and responsive test signals back and forth between the command center and instrumentation center to verify the operation of the communications network. In addition, the FSCS computer hardware can be configured to prevent the delivery of the fire control signal in the event transmission of signals over the communications network is interrupted or the test signals and responsive test signals transmitted over the communications network between the command center and instrumentation center do not correspond.

As a still further aspect of an embodiment, the fire control signal can also be also provided to control the initiation of a propellant by an initiator.

In accordance with an embodiment of a method, a method of controlling the firing of an explosive comprises; (a) placing a command center a first distance away from the site at which the explosive is to be detonated; (b) placing an instrumentation center a second distance away from the site at which the explosive is to be detonated, the second distance being less than the first distance; (c) establishing a communication link between the command center and instrumentation center and verifying the operation of the communications link at least during times that the explosive may be detonated; (d) receiving instrument status signals at the instrumentation center indicating the operational status of plural instruments and transmitting signals corresponding to such instrument status signals to the command center; (e) receiving at least one interlock status signal at the instrumentation center indicating the status of the at least one interlock and transmitting signals corresponding to such interlock status signal to the command center; (f) providing plural fire authorization signals from the command center to the instrumentation center; (g) selectively delivering a fire control signal from the instrumentation center to an explosive detonator in response to the plural detonation control signals and providing that the instrument status signals and interlock status signals indicate that the instruments and at least one interlock are in an acceptable status for the explosive to be detonated; (h) detonating the explosive in response to the fire control signal; and (i) receiving explosion responsive instrument data signals at the instrument center collected by instruments in response to the explosion and transmitting signals corresponding to the instrument data signals to the command center.

As a further aspect of a method, the method can comprise initiating at least one propellant charge in response to the fire control signal.

As yet another aspect of a method, the act of providing plural fire authorization signals can comprise providing first and second and third fire authorization signals in response to the movement of switches to fire authorization positions, first and second of said fire authorization signals being dependent on the position of respective manually actuated first and second switches, the third of said fire authorization signals being dependent upon the actuation of a computing hardware implemented third switch to a fire authorization position. In addition, the act of selectively delivering the fire control signal can comprise delivering the fire control signal only if all of the first, second and third switches are in a position indicating that the explosive is to be detonated.

As an additional aspect of a method, the method can comprise testing the operation of the communication link and the act of selectively delivering the fire control signal can comprise delivering the fire control signal only if testing confirms that the communication link is operational.

As a further aspect of a method, the method can comprise the act of displaying the status of plural instruments, the status of the computing hardware implemented third switch and the status of the first and second switches on a common display. As another aspect, the status of the at least one interlock can be displayed on the common display.

It should be noted that the invention disclosed herein encompass all novel and non-obvious method acts, system aspects and apparatus features disclosed herein. In addition, the invention disclosed herein encompasses all novel and non-obvious combinations and sub-combinations of method acts, system aspects, and apparatus features set forth herein. Thus, the invention encompasses, but is not limited to, all combinations and sub-combinations of the various aspects of the embodiments mentioned in this summary as well as in the accompanying technical description and drawings.

The foregoing and other features and advantages of the disclosure will become more apparent from the following detailed description, which proceeds with reference to the accompanying figures.

DETAILED DESCRIPTION

I. Introduction

Figure 1:
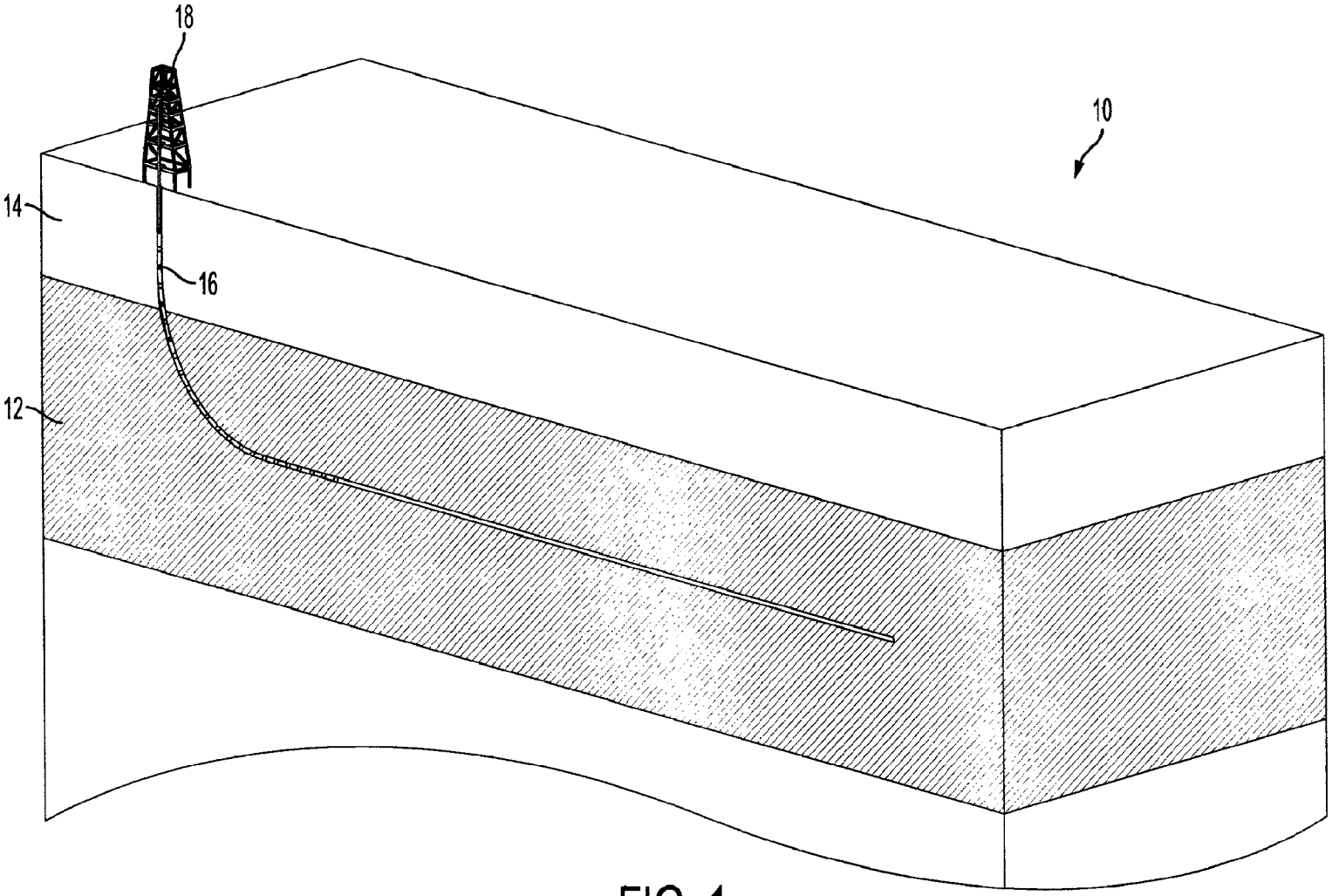
FIG. 1 is a cross-sectional view of a geologic formation accessed with a wellbore.

Although the use of high energy density (HED) sources, such as explosives, for the purpose of stimulating permeability in hydrocarbon reservoirs has been previously investigated, the fracture radius away from the borehole with such technologies has never extended for more than a few feet radially from the borehole. Permeability stimulation in tight formations is currently dominated by the process known as hydraulic fracturing. With hydraulic fracturing, chemically treated water is pumped into the reservoir via a perforated wellbore to hydraulically fracture the rock providing a limited network of propped fractures for hydrocarbons to flow into a production well. The chemicals and the produced water used in this method can be considered environmentally hazardous.

Past investigations and present practice of stimulating permeability in tight formation do not take full advantage of the information gained from detailed analysis of both the formation properties and the customization of a HED system to create the largest permeability zone that is economical and environmentally benign. Some systems disclosed herein take into account best estimates of the shock wave behavior in the specific geologic formation and can be geometrically configured and adjusted in detonation time to enhance the beneficial mixing of multiple shock waves from multiple sources to extend the damage/rubblization of the rock to economic distances. Shock waves travel with different velocities and different attenuation depending on physical geologic properties. These properties include strength, porosity, density, hydrocarbon content, water content, saturation and a number of other material attributes.

As such, explosive systems, compositions, and methods are disclosed herein which are designed to be used to fracture geologic formations to provide access to energy resources, such as geothermal and hydrocarbon reservoirs, while not requiring the underground injection of millions of gallons of water or other chemical additives or proppants associated with the conventional hydraulic fracturing. Some disclosed methods and systems, such as those for enhancing permeability in tight geologic formations, involve the beneficial spacing and timing of HED sources, which can include explosives and specially formulated propellants. In some examples, the disclosed methods and systems include high explosive (HE) systems, propellant (PP) systems, and other inert systems. The beneficial spacing and timing of HED sources provides a designed coalescence of shock waves in the geologic formation for the designed purpose of permeability enhancement.

Beneficial spacing of the HED sources can be achieved through an engineered system designed for delivery of the shock to the geologic formations of interest. A disclosed high fidelity mobile detonation physics laboratory (HFMDPL) can be utilized to control the firing of one or more explosive charges and/or to control the initiation of one or more propellant charges, such as in a permeability enhancing system.

Some advantages over conventional hydrofracturing which can be attributed to the HED compositions include the following: (1) the resulting rubblized zone around the stimulated wellbore can comprise a substantially 360° zone around the wellbore, as compared to traditional hydrofractures which propagate in a single plane from the wellbore in the direction of the maximum principle stress in the rock or extents along a pre-existing fracture; (2) the useful rubblizaton zone can extend to a significant radius from the bore, such as a radius or average radius, expected to be an at least three times improvement over a continuous charge of equal yield, such as a six times improvement; (3) the disclosed HED compositions and systems have residual by-products that are environmentally non-hazardous; and (4) the ability to generate explosions tailored to specific geologic profiles, thereby directing the force of the explosion radially away from the bore to liberate the desired energy resource without resulting in substantial pulverization of geologic material immediately adjacent to the wellbore, which can clog flow pathways and waste energy.

Various exemplary embodiments of explosive devices, systems, methods and compositions are described herein. The following description is exemplary in nature and is not intended to limit the scope, applicability, or configuration of the disclosure in any way. Various changes to the described embodiments may be made in the function and arrangement of the elements described herein without departing from the scope of the invention.

II. Terms and Abbreviations i. Terms

As used herein, the term detonation (and its grammatical variations) is not limited to traditional definitions and instead also includes deflagration and other forms of combustion and energetic chemical reactions.

As used herein, the term detonator is used broadly and includes any device configured to cause a chemical reaction, including explosive detonators and propellant initiators, igniters and similar devices. In addition, the term detonation is used broadly to also include detonation, initiation, igniting and combusting. Thus a reference to detonation (e.g. in the phrase detonation control signal) includes detonating an explosive charge (if an explosive charge is present) such as in response to a fire control signal and initiating the combustion of a propellant charge (if a propellant charge is present) such as in response to a fire control signal.

In addition a reference to "and/or" in reference to a list of items includes the items individually, all of the items in combination and all possible sub-combinations of the items. Thus, for example, a reference to an explosive charge and/or a propellant charge means "one or more explosive charges", "one or more propellant charges" and "one or more explosive charges and one or more propellant charges.

As used in this application, the singular forms "a," "an," and "the" include the plural forms unless the context clearly dictates otherwise. Additionally, the term "includes" means "comprises." Further, the term "coupled" generally means electrically, electromagnetically, and/or physically (e.g., mechanically or chemically) coupled or linked and does not exclude the presence of intermediate elements between the coupled or associated items absent specific contrary language.

It is further to be understood that all sizes, distances and amounts are approximate, and are provided for description. Although methods and materials similar or equivalent to those described herein can be used in the practice or testing of the present disclosure, suitable methods and materials are described below. All publications, patent applications, patents, and other references mentioned herein are incorporated by reference in their entirety. In case of conflict, the present specification, including explanations of terms, will control.

ii. Abbreviations

Al: Aluminum
CL-20: 2,4,6,8,10,12-hexanitro-2,4,6,8,10,12-hexaazaisowurtzitane
DAAF: diaminoazoxyfurazan
ETN: erythritol tetranitrate
EGDN: ethylene glycol dinitrate
FOX-7: 1,1-diamino-2,2-dinitroethene
GAP: Glycidyl azide polymer
HMX: octogen, Octahydro-1,3,5,7-tetranitro-1,3,5,7-tetrazocine
HNS: hexanitrostilbene
HE: high explosive
HED: high energy density
HFMDPL: High Fidelity Mobile Detonation Physics Laboratory
LAX-112: 3,6-diamino-1,2,4,5-tetrazine-1,4-dioxide
NG: nitroglycerin
NTO: 3-nitro-1,2,4-triazol-5-one
NQ: nitroguanidine
PETN: pentaerythritol tetranitrate
PP: propellant(s)
RDX: cyclonite, hexogen, 1,3,5-Trinitro-1,3,5-triazacyclohexane, 1,3,5-Trinitrohexahydro-s-triazine
TAGN: triaminoguanidine nitrate
TNAZ: 1,3,3-trinitroazetidine
TATB: triaminotrinitrobenzene
TNT: trinitrotoluene

III. Exemplary Systems

Disclosed are systems for enhancing permeability of a geologic formation, such as in tight junctions of a geologic formation. In some examples, a system for enhancing permeability includes at least one high explosive (HE) system. For example, an HE system can includes one or more HE, such as a cast curable HE. Desirable characteristics of an HE system can include one or more of the following: the HE system is environmentally benign; the HE is safe to handle, store and utilize in all required configurations, and in industrialized wellbore environments; the HE has a high total stored energy density (e.g. total stored chemical energy density), such as at least 8 kJ/cc, at least 10 kJ/cc, or at least 12 kJ/cc; and the HE is highly non-ideal. A non-ideal HE can be defined, for example, as an HE in which 30% to 40% or more of the meta-stably stored chemical energy is converted to HE hot product gases after the detonation front (shock front) in a deflagrating Taylor Wave. Further details of HE chemical compositions are described below (see, for example, Section VIII).

Some exemplary systems for enhancing permeability include one or more propellant (PP) systems, such as one or more PP systems in the axial space along the bore between the HE systems, which can add more usable energy to the system and/or help direct energy from the HE systems radially into the geologic formation rather than axially along the bore, without defeating the goal of wave interaction sought through the axial spatial separation of charges. The PP systems can pressurize the bore and/or add uncompressible or low-compressibility material in the bore between the HE systems the helps high-pressure energy from the HE systems from travelling axially along the bore. The PP systems can further increase or sustain high pressure in the annular region of the bore between the outside of the HE systems and the bore walls. Sustaining a high pressure in the bore helps to support the radially outwardly traveling wave of energy, causing the region of significant fracture to be extended radially. As used herein, a bore is any hole formed in a geologic formation for the purpose of exploration or extraction of natural resources, such as water, gas or oil. The term bore may be used interchangeably with wellbore, drill hole, borehole and other similar terms in this application.

The pressure generated by the combustion products of the PP confined in the bore is a contributor to increasing the radial travel of HE energy waves. Desirable characteristics of an exemplary PP system include one or more of the following: the PP system is environmentally benign; the material is safe to handle, store and utilize in all required configurations, and in industrialized wellbore environments; and the PP deflagrates without transitioning into a detonation within the context of the separately timed geometry- and material-specific HE. The active material in a PP system can comprise one or more of variety of materials, including: inert materials, such as brine, water, and mud; and energetic materials, such as explosive, combustible, and/or chemically reactive materials. These materials can be environmentally benign and safe to handle, store and utilize in required configurations and in industrialized bore environments. It is contemplated that the PP material may be fluid, semi-fluid or solid in nature. Desirably, the PP systems comprise or produce a product that has low compressibility. Further details of exemplary propellants are described below (see, for example, Section VIII).

Optimized geometry- and material-specific configurations of the disclosed systems enable carefully timed, multiple detonation events along HE-PP strings within the bore environment. The disclosed systems optimize the interaction of multiple shock waves and rarefaction waves within the surrounding formation, thereby producing 360 degree rubblization zones, which can be at least three to four times the radius produced by an equivalent radius of a continuous detonating column of the same HE. Further, optimized material layers between the bore wall and radially outer surfaces of the HE-PP string can minimize the amount of energy wasted on crushing/pulverizing geologic material near the bore/epicenter, thereby optimizing the transition of available energy into the geologic material in a manner that maximizes useful rubblization effects and maximizes flow channels through the rubblized material.

FIG. 1 shows a cross-section of an exemplary geologic formation 10 that comprises a target zone 12 comprising an energy resource, which is positioned below another geologic layer, or overburden 14. An exemplary bore 16 extends from a rig 18 at the surface, through the overburden 14, and into the target zone 12. The bore 16 can be formed in various configurations based on the shape of the geologic formations, such as by using known directional drilling techniques. In the illustrated example, the bore 16 extends generally vertically from a rig 18 through the overburden 14 and then curves and extends generally horizontally through the target zone 12. In some embodiments, the bore 16 can extend through two or more target zones 12 and/or through two or more overburdens 14. In some embodiments, the bore can be generally vertical, angled between vertical and horizontal, partially curved at one or more portions, branched into two or more sub-bores, and/or can have other known bore configurations. In some embodiments, the target zone can be at or near the surface and not covered by an overburden. The target zone 12 is shown having a horizontal orientation, but can have any shape or configuration.

Figure 2:
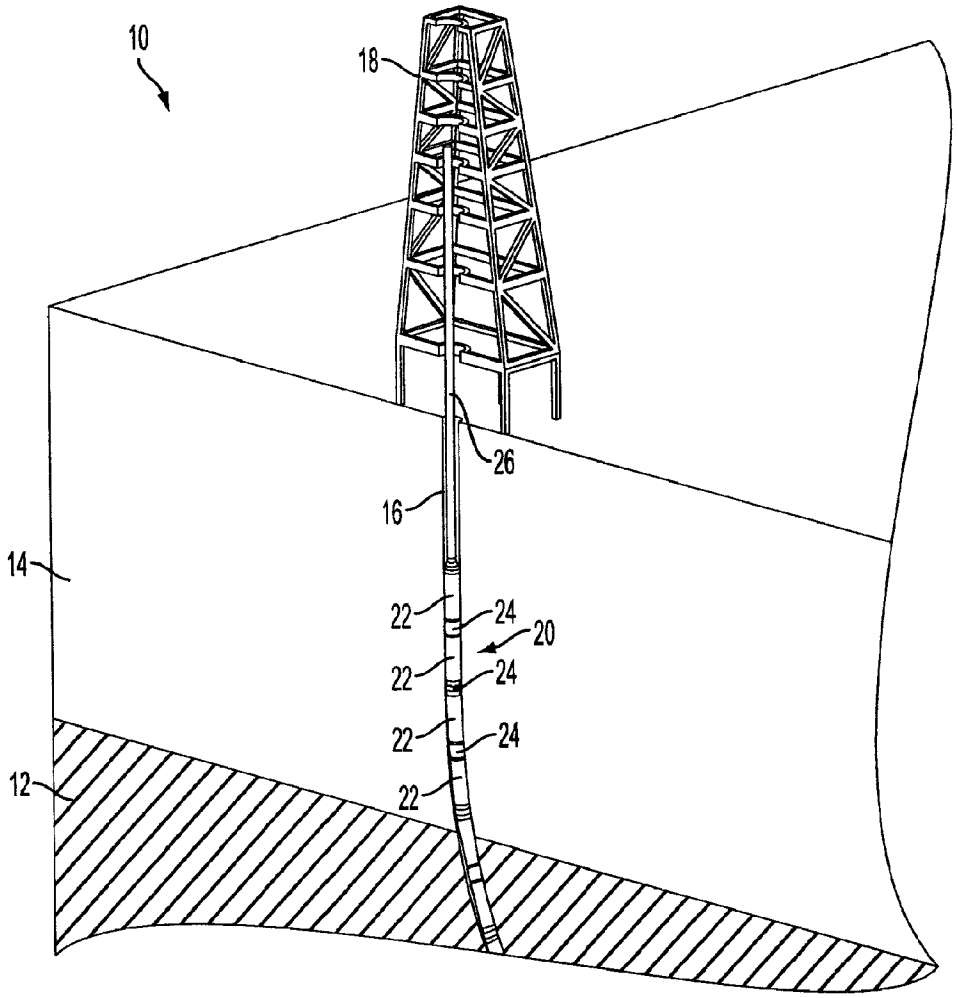
FIG. 2 is an enlarged view of a portion of FIG. 1 showing a proximal portion of an exemplary tool string being inserted into the wellbore.

As shown in FIG. 2, after the bore 16 is formed, an explosive tool string 20 can be inserted into the bore. The string 20 can comprise one or more units 22 coupled in series via one or more connectors 24. The units 22 can comprise explosive units, propellant units, inert units, and/or other units, as described elsewhere herein. The units 22 and connectors 24 can be coupled end-to-end in various combinations, along with other components, to form the elongated string 20. The string 20 can further comprise a proximal portion 26 coupling the string to surface structures and control units, such as to support the axial weight of the string, to push the string down the bore, and/or to electrically control the units 22.

Figure 3:
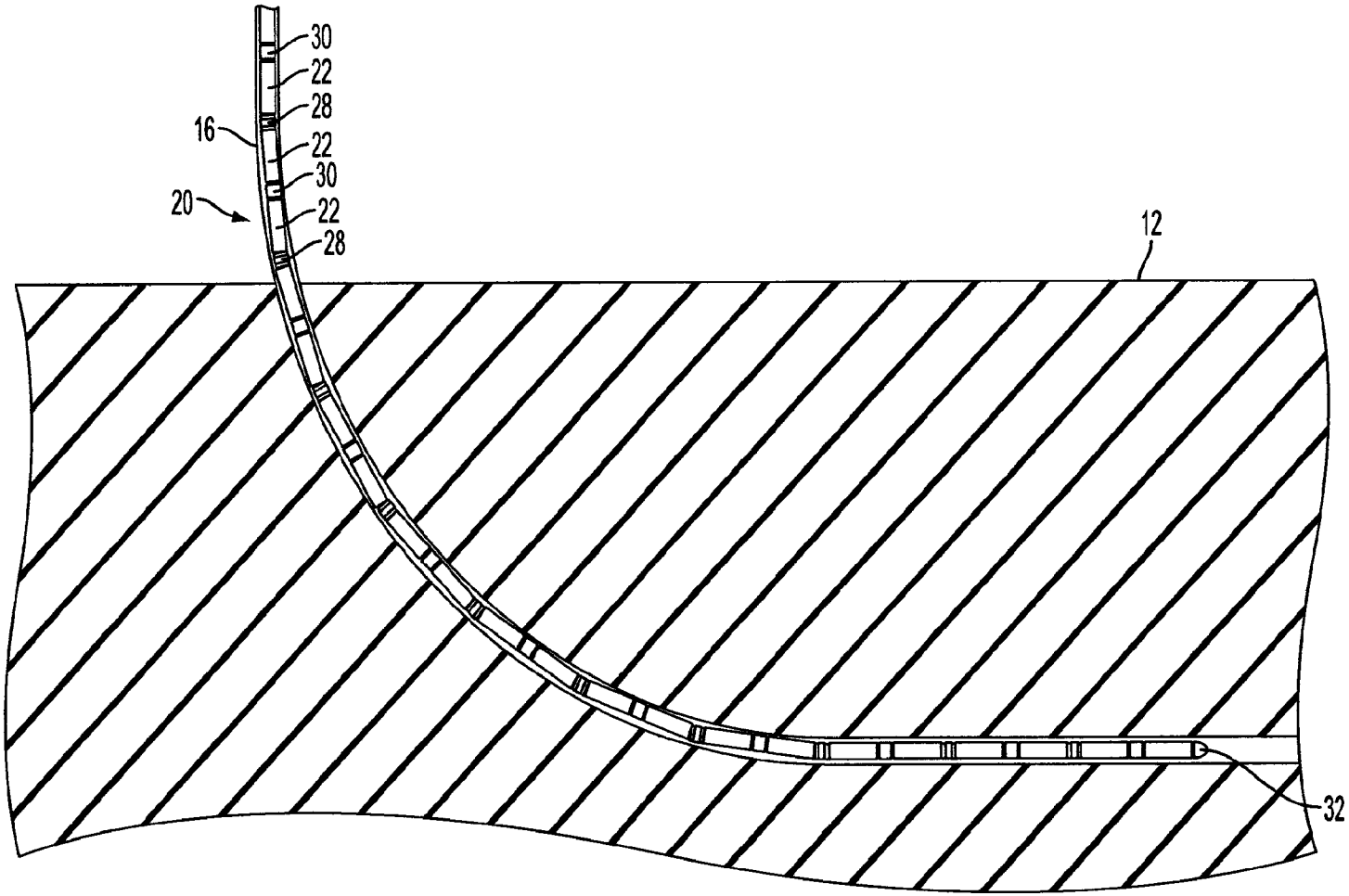
FIG. 3 is a cross-sectional view of a tool string portion positioned in a curved portion of a wellbore.

As shown in FIG. 3, one or more of the connectors 24 can comprise flexible connectors 28 and one or more of the connectors 24 can comprise rigid connectors 30. The flexible connectors 28 can allow the string to bend or curve, as shown in FIG. 3. In the example of FIG. 3, every other connector is a flexible connector 28 while the other connectors are rigid or semi-rigid connectors 30. In other strings 20, the number and arrangement of flexible and rigid connectors can vary. The flexible connectors 28 can be configured to allow adjacent units 22 to pivot off-axis from each other in any radial direction, whereas the rigid connectors 30 can be configured to maintain adjacent units 22 in substantial axial alignment. The degree of flexibility of the flexible connectors 28 can have varying magnitude. In some embodiments, the string 20 can comprising at least one flexible connector, or swivel connector, and configured to traverse a curved bore portion having a radius of curvature of less than 500 feet. Additional instances of flexible connectors at smaller intervals apart from each other can further reduce the minimum radius of curvature traversable by the string. Furthermore, each joint along the string can be formed with a given amount of play to allow additional flexing of the string. Joints can be formed using threaded connected between adjoining units and connectors and are designed to allow off-axis motion to a small degree in each joint, as is describe further below.

Figure 4:
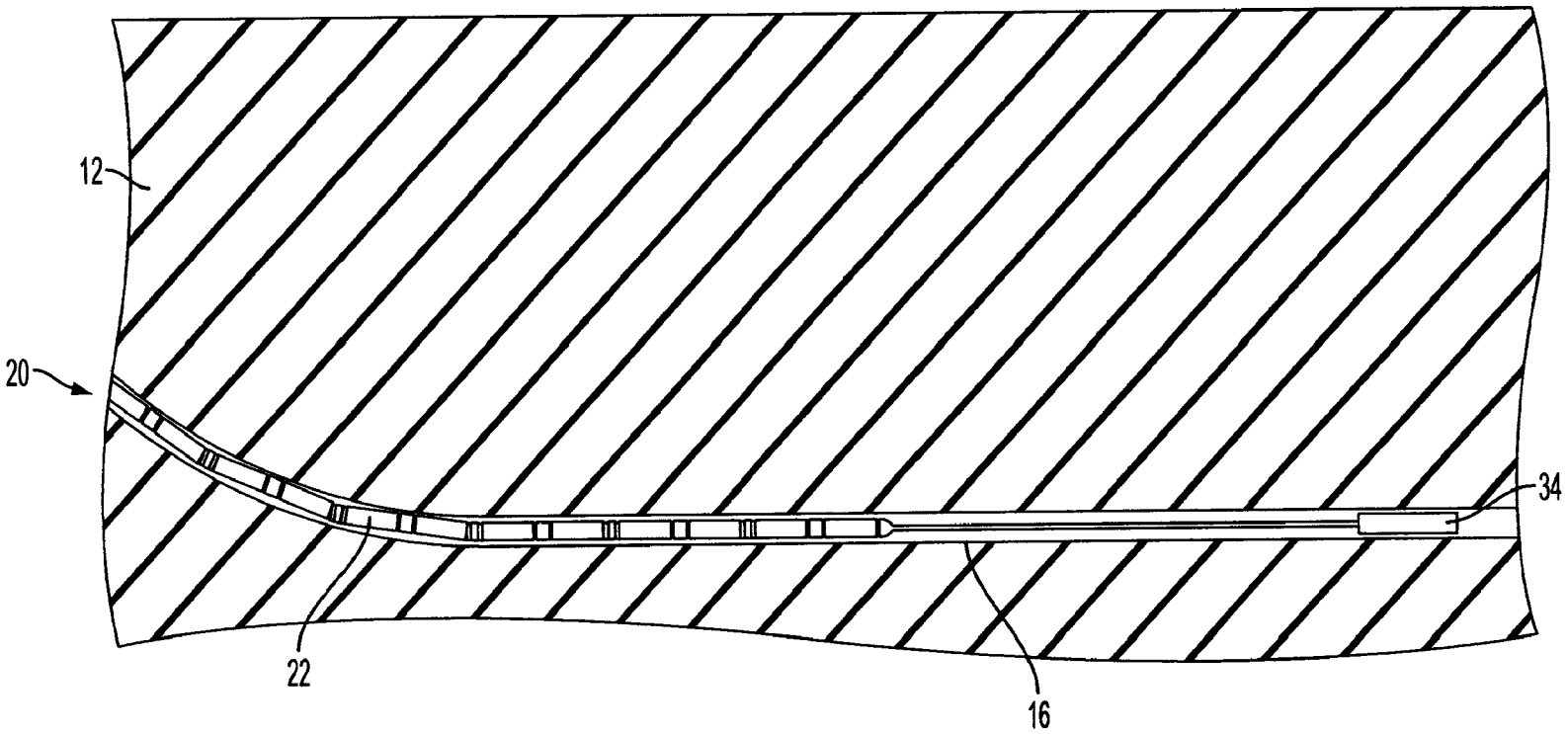
FIG. 4 is a cross-sectional view of a tool string distal portion having a tractor mechanism for pulling through the wellbore.

As shown in FIG. 3, the distal end of the string 20 can comprise a nose-cone 32 or other object to assist the string in traveling distally through the bore 16 with minimal resistance. In some embodiments, as shown in FIG. 4, the distal end of the string 20 can comprise a tractor 34 configured to actively pull the string through the bore 16 via interaction with the bore distal to units 22.

Figure 5:
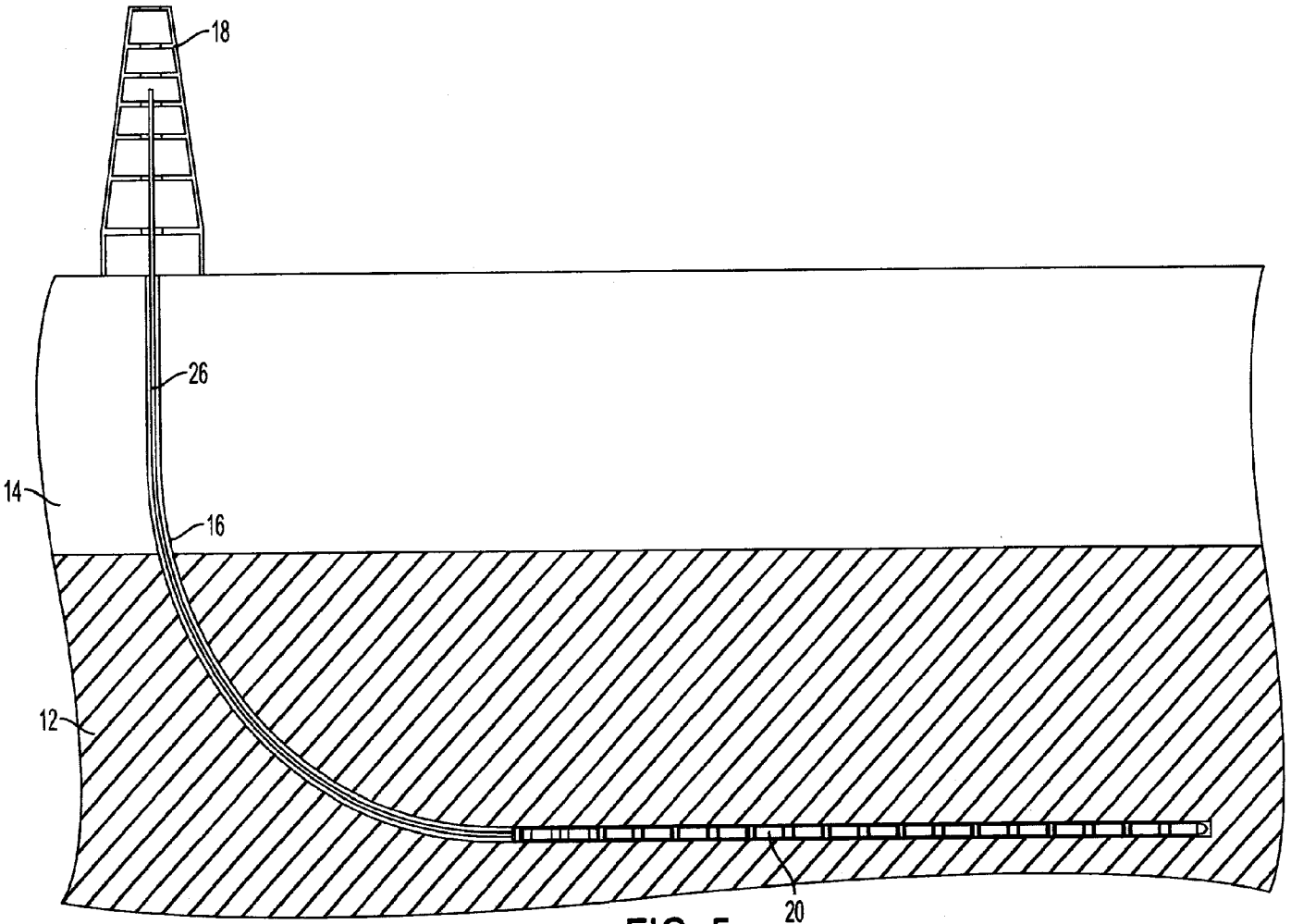
FIG. 5 is a cross-sectional view of a tool string completely inserted into a wellbore and ready for detonation.

FIG. 5 shows an exemplary string 20 fully inserted into a bore 16 such that units 22 have passed the curved portion of the bore and are positioned generally in horizontal axial alignment within the target zone 12. In this configuration, the string 20 can be ready for detonation.

Figure 6:
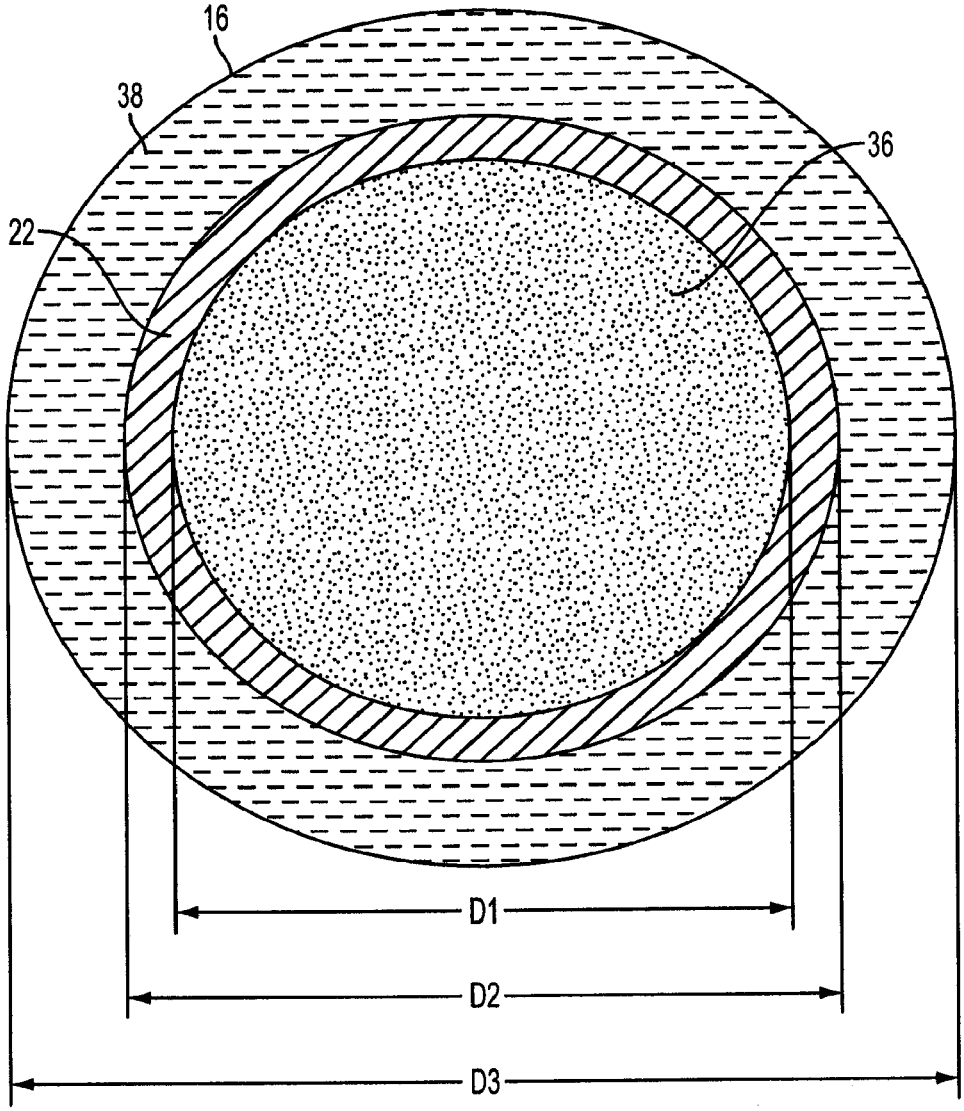
FIG. 6 is a cross-sectional view of an exemplary unit of a tool string in a wellbore, taken perpendicular to the longitudinal axis.

FIG. 6 shows a cross-section of an exemplary unit 22 positioned within a bore 16. The unit 22 contains a material 36, which can comprise a high energy explosive material, a propellant, brine, and/or other materials, as described herein. A fluid material 38, such as brine, can fill the space between the outer surface of the string 20 (represented by the unit 22 in FIG. 6) and the inner wall of the bore 16. The inner diameter of the unit 22, D1, the outer diameter of the unit and the string 20, D2, and the diameter of the bore, D3, can vary as described herein. For example, D1 can be about 6.5 inches, D2 can be about 7.5 inches, and D3 can be about 10 inches.

Figure 7:
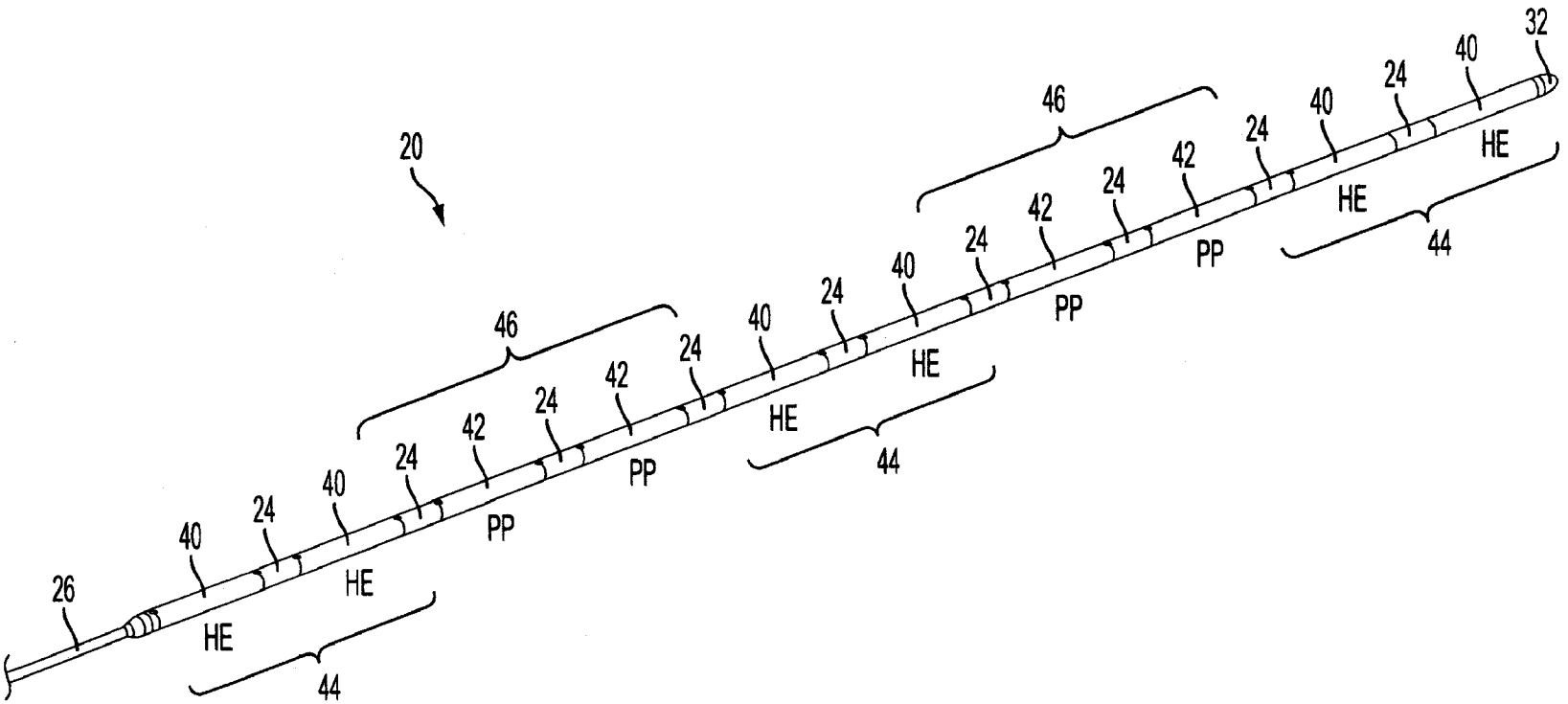
FIG. 7 is a perspective view of an exemplary tool string portion.

Each unit 22 can comprise an HE unit, a PP unit, an inert unit, or other type of unit. Two or more adjacent units 22 can form a system, which can also include one or more of the adjoining connectors. For example, FIG. 7 shows an exemplary string 20 comprising a plurality of HE units 40 and a plurality of PP units 42. Each adjacent pair of HE units 40 and the intermediate connector 24 can comprise an HE system 44. Each adjacent pair of PP units 42 and the three adjoining connectors 24 (the intermediate connector and the two connectors at the opposite ends of the PP units), can comprise a PP system 46. In other embodiments, any number of units 20 of a given type can be connected together to from a system of that type. Furthermore, the number and location of connectors in such system can vary in different embodiments.

Connectors 24 can mechanically couple adjacent units together to support the weight of the string 20. In addition, some of the connectors 24 can comprise electrical couplings and/or detonator control modules for controlling detonation of one or more of the adjacent HE or PP units. Details of exemplary detonator control modules are described below.

In some embodiments, one or more HE systems in a string can comprise a pair of adjacent HE units and a connector that comprises a detonator control module configured to control detonation of both of the adjacent HE units of the system. In some embodiments, one or more HE systems can comprise a single HE unit and an adjacent connector that comprises a detonator control module configured to control detonation of only that single HE unit.

Each unit can be independently detonated. Each unit can comprise one or more detonators or initiators. The one or more detonators can be located anywhere in the unit, such as at one or both axial ends of the unit or intermediate the axial ends. In some embodiments, one or more of the units, such as HE units, can be configured to be detonated from one axial end of the unit with a single detonator at only one axial end of the unit that is electrically coupled to the detonator control module in an adjacent connector.

In some units, such as PP units, the unit is configured to be detonated or ignited from both axial ends of the unit at the same time, or nearly the same time. For example, a PP unit can comprise two detonators/igniters/initiators, one at each end of the PP unit. Each of the detonators of the PP unit can be electrically coupled to a respective detonator control module in the adjacent connector. Thus, in some embodiments, one or more PP systems in a string can comprise a pair of adjacent PP units and three adjacent connectors. The three adjacent connectors can comprise an intermediate connector that comprises a detonator control module that is electrically coupled to and controls two detonators, one of each of the two adjacent PP units. The two connectors at either end of the PP system can each comprise a detonator control module that is electrically coupled to and controls only one detonator at that end of the PP system. In PP systems having three or more PP units, each of the intermediate connectors can comprise detonator control modules that control two detonators. In PP systems having only a single PP unit, the PP system can comprise two connectors, one at each end of the PP unit. In embodiments having detonators intermediate to the two axial ends of the unit, the detonator can be coupled to a detonation control module coupled to either axial end of the unit, with wires passing through the material and end caps to reach the detonation control module.

Figure 8A:
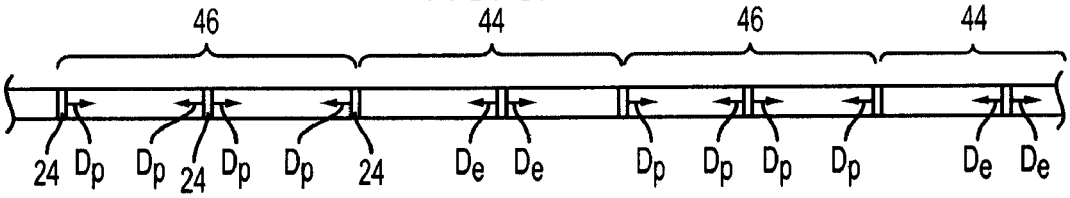
FIGS. 8A-8G are schematic views of alternative exemplary tool strings portions.
Figure 8B:
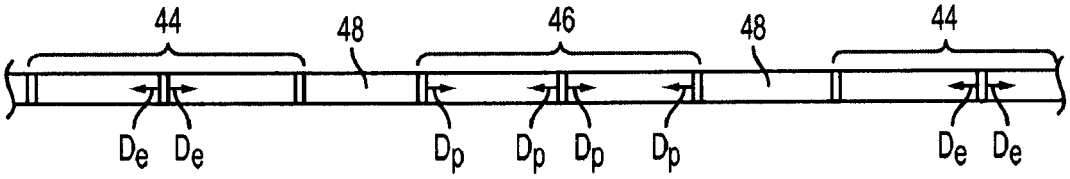

FIGS. 8A-8G show several examples strings 20 arranged in different manners, with HE unit detonators labeled as De and PP unit detonators labeled as Dp. FIG. 8A shows a portion of a string similar to that shown in FIG. 7 comprising alternating pairs of HE systems 44 and PP systems 46. FIG. 8B shows a portion of a string having HE systems 44 and PP systems as well as inert units 48 positioned therebetween. Any number of inert units 48 can be used along the string 20 to position the HE units and PP units in desired positions relative to the given geologic formations. Instead of inert units 48 (e.g., containing water, brine or mud), or in addition to the inert units 48, units positioned between the HE units and/or the PP units in a string can comprise units containing non-high energy explosives (e.g., liquid explosives). Any combination of inert units and non-high energy units can be includes in a string in positions between the HE units and/or PP units, or at the proximal and distal ends of a string.

Figure 8C:
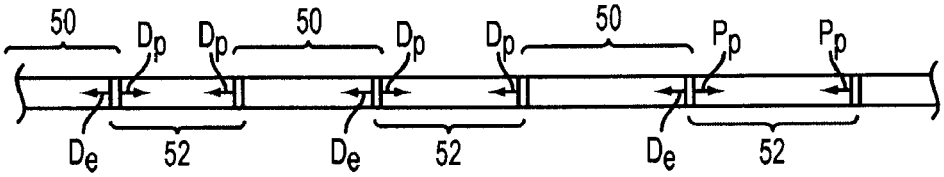
Figure 8D:
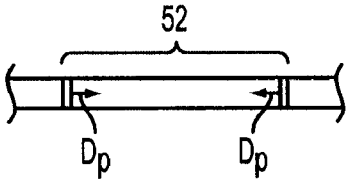
Figure 8E:
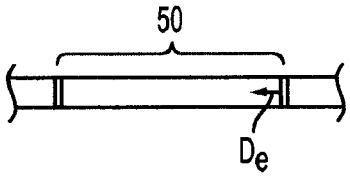

FIG. 8C shows a portion of a string 20 comprising a plurality of single-unit HE systems 50 alternating with single-unit PP systems 52. In this arrangement, each connector is coupled to one end of a HE unit and one end of a PP unit. Some of these connectors comprise a detonation control module configured to control only a PP detonator, while others of these connectors comprise a detonation control module configured to control one PP detonator and also control one HE detonator. FIG. 8D shows an exemplary single-unit PP system 52 comprising a connector at either end. FIG. 8E shows an exemplary single-unit HE system 50 comprising a single connector at one end. The single-unit systems 50, 52, the double-unit systems 44, 46, and/or inert units 48 can be combined in any arrangement in a string 20. In some embodiments, one or more of the connectors do not comprise a detonation control module.

Figure 8F:
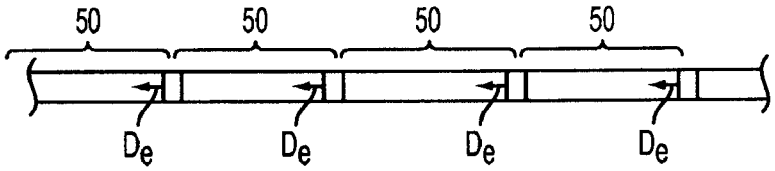
Figure 8G:
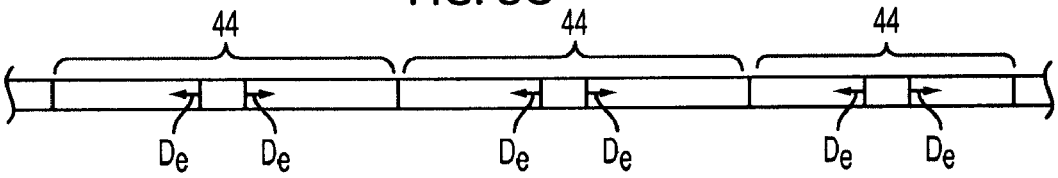

FIG. 8F shows a string of several adjacent single-unit HE systems 50, each arranged with the detonator at the same end of the system. In this arrangement, each connector controls the detonator to its left. FIG. 8G shows a string of double-unit HE systems 44 connected directly together. In this arrangement, each double-unit HE system 44 is coupled directly to the next double-unit HE system without any intermediate connectors. In this matter, some of the connectors in a string can be eliminated. Connectors can also be removed or unnecessary when inert units 48 are included in the string.

In some embodiments, a system for enhancing permeability includes one or more HE systems, such as one to twelve or more HE systems and one or more PP systems, such as one to twelve or more PP systems, which are arranged in a rack/column along a string 20. In some examples, each HE system is separated from another HE system by one or more PP systems, such as one to eight or more PP systems. In some embodiments, the string 20 can comprise a generally cylindrical rack/column of about 20 feet to about 50 feet in length, such as about 30 feet to about 50 feet. In some examples, each HE system and each PP system is about 2 feet to about 12 feet in length, such as about 3 feet to about 10 feet in length.

Each of the units 20 can comprise a casing, such as a generally cylindrical casing 22 as shown in cross-section in FIG. 6. In some examples, the casing is designed to contain the HE, PP, or inert material. The casing can also separate the contained material from the fluid 38 that fills the bore 16 outside of the casing. In some examples, the casing completely surrounds the contained material to separate it completely from the fluid filling the bore. In some examples, the casing only partial surrounds the contained material thereby only partially separating it from the material filling the bore.

In some embodiments, the PP units can be ignited prior to the HE units. This can cause the PP ignited product (e.g., a gas and/or liquid) to quickly expand and fill any regions of the bore outside of the HE units, including regions of the bore not filled with other fluid. The quickly expanding PP product can further force other fluids in the bore further into smaller and more distant cracks and spaces between the solid materials of the target zone before the HE units detonate. Filling the bore with the PP product and/or other fluid prior to detonation of the HE units in this manner can mitigate the crushing of the rock directly adjacent to the bore caused by the HE explosion because the fluid between the HE units and the bore walls acts to transfer the energy of the explosion further radially away from the centerline of the bore without as violent of a shock to the immediately adjacent bore walls. Avoiding the crushing of the bore wall material is desirable for it reduces the production of sand and other fine particulates, which can clog permeability paths and are therefore counterproductive to liberating energy resources from regions of the target zone distant from the bore. Moreover, reducing the near-bore crushing and pulverization reduces the energy lost in these processes, allowing more energy to flow radially outward further with the shock wave and contribute to fracture in an extended region.

The dimensions (size and shape) and arrangement of the HE and PP units and connectors can vary according to the type of geologic formation, bore size, desired rubblization zone, and other factors related to the intended use. In some examples, the case(s) 22 can be about ¼ inches to about 2 inches thick, such as ¼, ½, ¾, 1, 1¼1½, 1¾, and 2 inches thick. In some examples, the material between the case 22 and the bore wall 16 can be about 0 inches to about 6 inches thick. The cases 22 can contact the bore walls in some locations, while leaving a larger gap on the opposite side of the case from the contact with the bore. The thickness of the material in the bore between the cases and the bore wall can therefore vary considerably along the axial length of the string 20. In some examples, the HE (such as a non-ideal HE) is about 4 inches to about 12 inches in diameter, within a case 22. For example, a disclosed system includes a 6½ inch diameter of HE, ½ inch metal case (such aluminum case) and 1¼ inch average thickness of material between the case and the bore wall (such as a 1¼ inch thick brine and/or PP layer) for use in a 10 inch bore. Such a system can be used to generate a rubblization zone to a radius of an at least three times improvement over a continuous charge of equal yield, such as a six times improvement. For example, the explosive charges can be detonated and/or the combustion of each propellant charge initiated to fracture the section of the underground geologic formation in a first fracture zone adjacent to and surrounding the section of the bore hole and extending into the underground geologic formation to a first depth of penetration away from the section of the bore hole and plural second fracture zones spaced apart from one another and extending into the underground geologic formation to a second depth of penetration away from the section of the bore hole greater than the first depth of penetration, wherein the second fracture zones are in the form of respective spaced apart disc-like fracture zones extending radially outwardly from the bore hole and/or the second depth of penetration averages at least three times, such as at least six times, the average first depth of penetration. In some examples, a disclosed system includes a 9½ inch diameter of HE (such as a non-ideal HE), ¼ inch metal case (such aluminum case) and 1 inch average thickness of material between the case and the bore wall (such as a 1 inch thick brine and/or PP layer) for use in a 12 inch borehole. It is contemplated that the dimensions of the system can vary depending upon the size of the bore.

In some embodiments, the system for enhancing permeability further includes engineered keyed coupling mechanisms between HE and PP units and the connectors. Such coupling mechanisms can include mechanical coupling mechanisms, high-voltage electrical coupling mechanisms, communications coupling mechanisms, high voltage detonator or initiation systems (planes), and/or monitoring systems. In some examples, independently timed high-precision detonation and initiation planes for each HE and PP section, respectively, can be included. Such planes can include customized programmable logic for performing tasks specific to the system operated by the plane, including safety and security components, and each plane can include carefully keyed coupling mechanisms for mechanical coupling, including coupling detonators/initiators into the HE/PP, high-voltage coupling, and communications coupling.

In some examples, cast-cured HE and PP section designs, including high-voltage systems, communication systems, detonator or initiation systems, and monitoring systems, are such that they can be manufactured, such as at an HE Production Service Provider Company, and then safely stored and/or "just in time" shipped to a particular firing site for rapid assembly into ruggedized HE-PP columns, testing and monitoring, and deployment into a bore. Specific formulations utilized, and the geometrical and material configurations in which the HE and PP systems are deployed, can be central for producing a desired rubblization effects in situ within each particular geologic formation. In some examples, these optimized geometric and material configurations can be produced via specifically calibrated numerical simulation capabilities that can include many implementations of models into the commercial code ABAQUS. In further examples, any of the disclosed systems can be developed/up-dated by use of a High Fidelity Mobile Detonation Physics Laboratory (HFM-DPL), as described in detail herein (see, for example, Section IX).

IV. Exemplary High Explosive and Propellant Units and Systems

Figure 9:
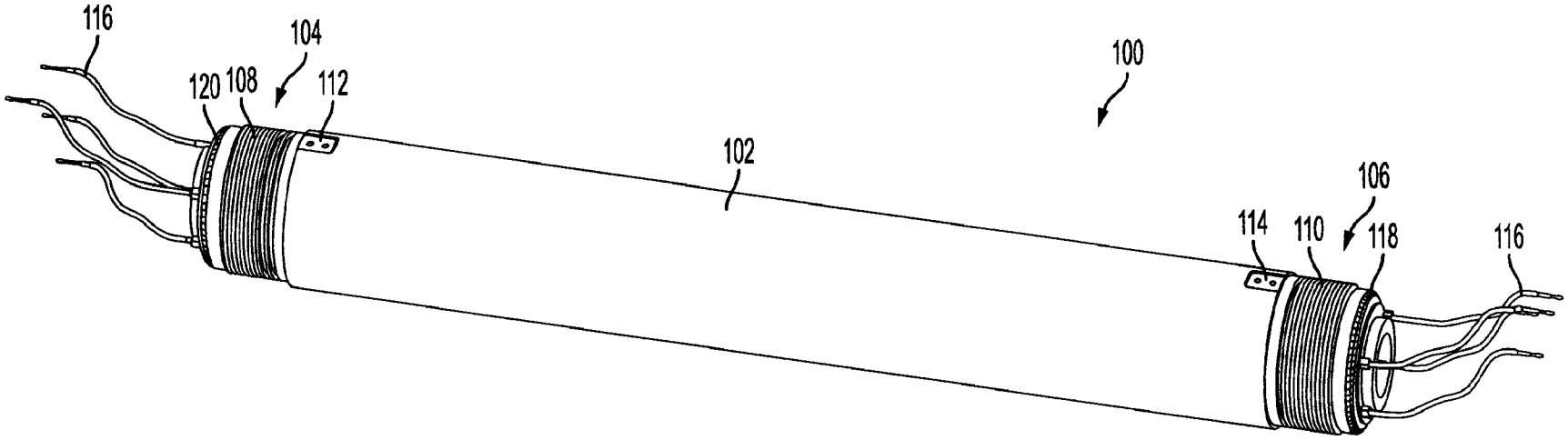
FIG. 9 is a perspective view of an exemplary unit of a tool string.

FIG. 9 shows an exemplary unit 100, which can comprise a HE unit, a PP unit, or an inert unit. The unit 100 comprises a generally cylindrical, tubular case 102 having at least one interior chamber for containing a material 150, such as HE material, PP material, brine, or other material. The unit 100 comprises a first axial end portion 104 and a second opposite axial end portion 106. Each axial end portion 104, 106 is configured to be coupled to a connector, to another HE, PP or inert unit, or other portions of a bore insertion string. The casing 102 can comprise one or more metals, metal alloys, ceramics, and/or other materials or combinations thereof. In some embodiments, the casing 102 comprises aluminum or an aluminum alloy.

The axial end portions 104, 106 can comprise mechanical coupling mechanisms for supporting the weight of the units along a string. The mechanical coupling mechanisms can comprise external threaded portions 108, 110, plate attachment portions 112, 114, and/or any other suitable coupling mechanisms. For example, FIGS. 14A-14D show representative suitable mechanical coupling mechanisms. The axial end portions 104, 106 can further comprise electrical couplings, such as one or more wires 116, that electrically couple the unit to the adjacent connectors, other units in the string, and/or to control systems outside of the bore. The wires 116 can pass axially through the length of the unit 100 and extend from either end for coupling to adjacent components.

Figure 10:
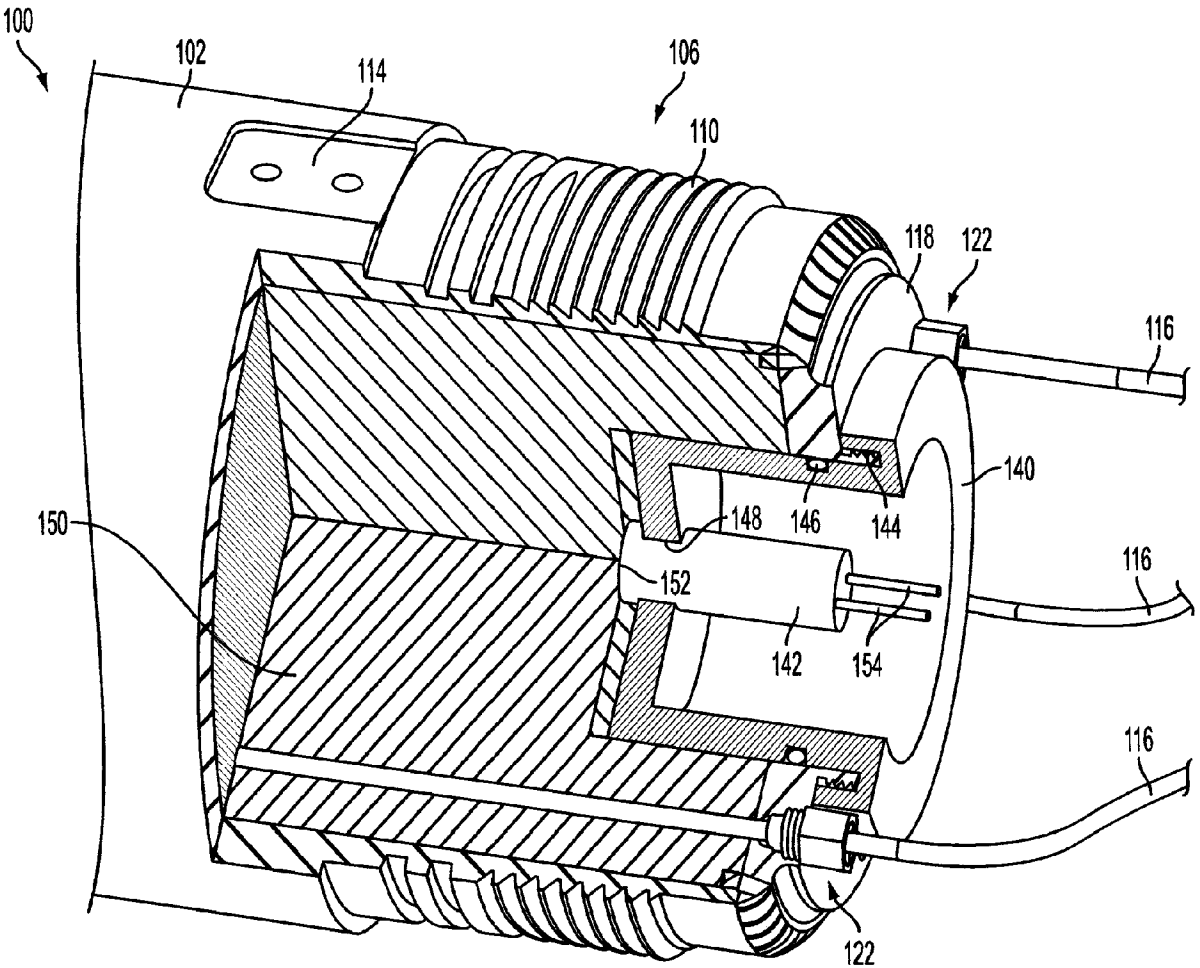
FIG. 10 is a partially cross-sectional perspective view of a portion of the unit of FIG. 9.

As shown in detail in FIG. 10, the unit 100 can further comprise a first end cap 118 coupled to the axial end portion 106 of the case 102 and/or a second end cap 120 coupled to the opposite axial end portion 108 of the case 102. The end caps 118, 120 can comprise an annular body having a perimeter portion that is or can be coupled to the axial end of the case 102. The end caps 118, 120 can be fixed to the casing 102, such as be welding, adhesive, fasteners, threading, or other means. The end caps 118, 120 can comprise any material, such as one or more metals, metal alloys, ceramics, polymeric materials, etc. In embodiments with the end caps welded to the casing, the full penetration welds can be used in order to preclude thing metal-to-metal gaps in which migration of chemical components could become sensitive to undesired ignition. In embodiments having polymeric end caps, thin contact gaps can exist between the caps and the casing with less or no risk of undesired ignition. Polymeric end caps can be secured to the casing via threading and/or a polymeric retaining ring. Furthermore, a sealing member, such as an O-ring, can be positioned between the end cap and the casing to prevent leakage or material 150 out of the unit. In other embodiments, metallic end caps can be used with annular polymeric material positioned between the end caps and the casing to preclude metal-to-metal gaps.

The outer diameter of the units and/or connectors can be at least partially covered with or treated with a friction-reducing layer and/or surface treatment. This treatment layer or treatment can comprise at least one of the following: solid lubricants, such as graphite, PTFE containing materials, MoS2, or WS2; liquid lubricants, such as petroleum or synthetic analogs, grease; or aqueous based lubricants. Surface treatments can include attached material layers, such as WS2 (trade name Dicronite®); MoS2, metals having high lubricity, such as tin (Sn), polymer coatings exhibiting high lubricity such as fluoropolymers, polyethylene, PBT, etc.; physically deposited, electroplated, painting, powder coating; or other materials.

Wires 116 (such as for controlling, powering and triggering the detonation of the energetic material) pass through or at least up to each unit 100. Any number of wires 116 can be included, such as one, two, four, or more. At least some of the wires 116 can pass through at least one of the end caps 118, 120 on the ends of each unit, as shown in FIG. 10. The penetrations in the end caps and the penetrating wires 116 can be free of thin metal-to-metal gaps in which migration of chemical components could become sensitive to undesired ignition.

In some embodiments, the end caps 118, 120 can comprise one or more penetration glands 122 designed to obviate undesired ignition by eliminating or reducing thin metal-to-metal gaps and preventing leakage of material 150 out of the unit 100. The penetration glands 122 can be configured to provide thin gaps between polymeric and metal surface penetration holes. The compliance of polymer-to-metal or polymer-to-polymer thin gaps can prevent sufficient compression and friction for sensitive chemical components to ignite.

Figure 11:
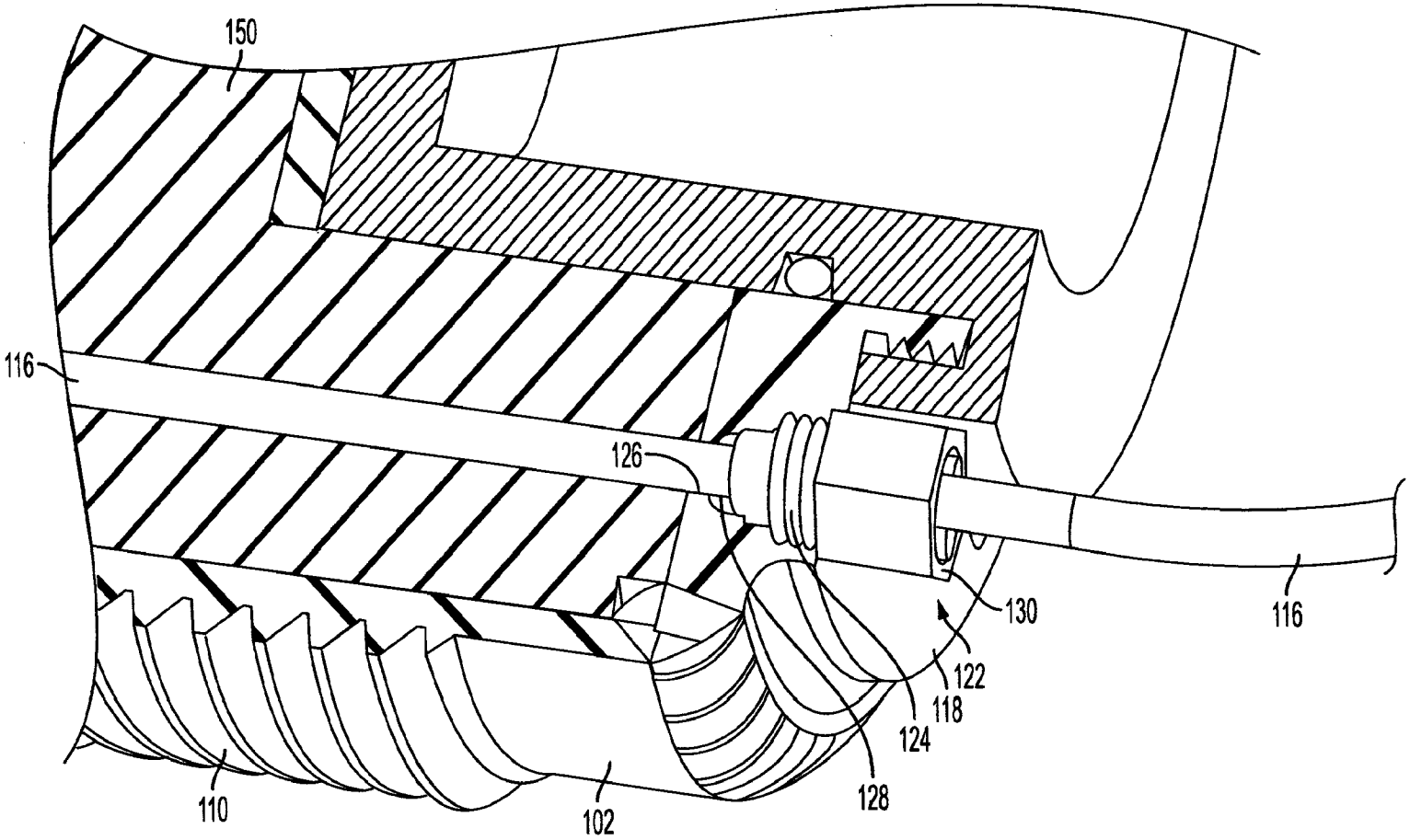
FIG. 11 is an enlarged view of a portion of FIG. 10.

As shown in more detail in FIG. 11, each penetration gland 122 can receive a wire 116 with a polymer jacket 124 passing through a hole 126 in the end cap 118, 120. The wire 116 can be sealed with a compliant seal, such as an O-ring 128. The seal is compressed in place by a polymeric fastener 130, which is secured to the end cap, such as via threads, and tightened to compress the seal. The fastener 130 can comprise a hole through its axis through which the wire 116 passes.

In other embodiments, a penetration gland can be comprised of a threaded hole with a shoulder, a gland screw with a coaxial through-hole, said screw having a shoulder which compresses a seal (such as an o-ring) in order to seal the cable passing through it. Coaxial cable can allow two conductors to be passed through each seal gland with an effective seal between the inside of the unit and the outside of the unit.

The unit 100 can further comprise at least one detonator holder 140 and at least one detonator 142 and at least one axial end of the unit, as shown in FIG. 10. The term detonator includes any device used to detonate or ignite the material 150 within the unit, or initiate or cause the material 150 to detonate or ignite or explode, or to initiate or cause a chemical reaction or expansion of the material 150. In an HE filled unit, the unit can comprise a single detonator 142 at one end of the unit, such as at the end portion 106, with no second detonator at the opposite end of the unit. In a PP filled unit, the unit can comprise a detonator 142 at both axial end portions of the unit, each being generally similar in structure and function.

The detonator holder 140, as shown in FIG. 10, for either a HE unit or a PP unit, can comprise a cup-shaped structure positioned within a central opening in the end cap 118. The holder 140 can be secured to and sealed to the end cap 118, such as via threads 144 and an O-ring 146. The holder 140 extends axially through the end cap 118 into the chamber within the casing 102 such that the holder 140 can be in contact with the material 150. The holder 140 can comprise a central opening 148 at a location recessed within the casing and the detonator 142 can be secured within the opening 148. An internal end 152 of the detonator can be held in contact with the material 150 with a contact urging mechanism to ensure the detonator does not lose direct contact with the material 150 and to ensure reliable ignition of the material 150. The urging mechanism can comprise a spring element, adhesive, fastener, or other suitable mechanism.

The detonator 142 can further comprise an electrical contact portion 154 positioned within the recess of the holder 140. The electrical contact portion 154 can be positioned to be not extend axially beyond the axial extend of the rim of the holder 140 to prevent or reduce unintended contact with the detonator 142. The electrical contact portion 154 can be electrically coupled to a detonation control module in an adjacent connector via wires.

Figure 12:
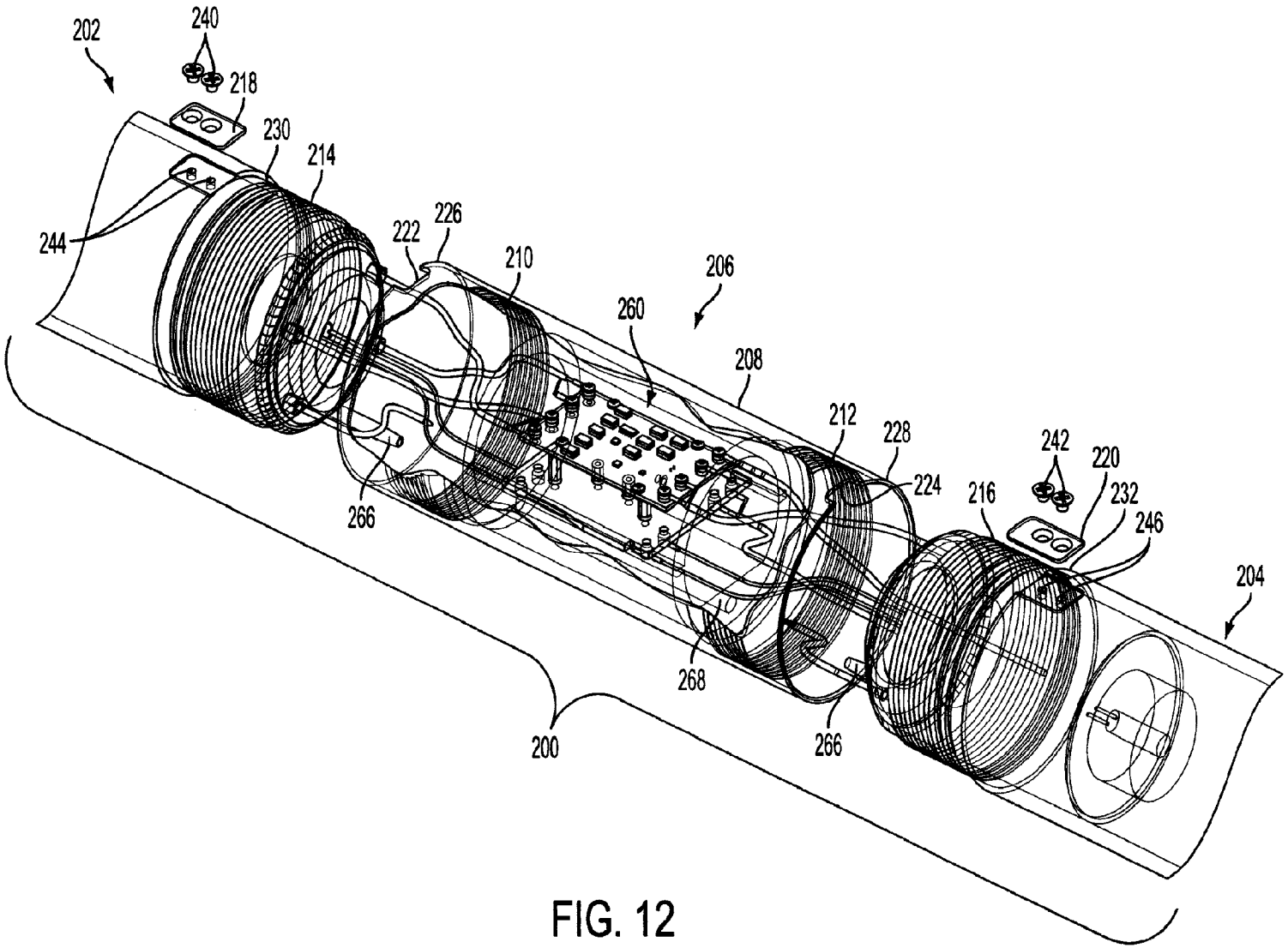
FIG. 12 is an exploded view of an exemplary explosive system.
Figure 13:
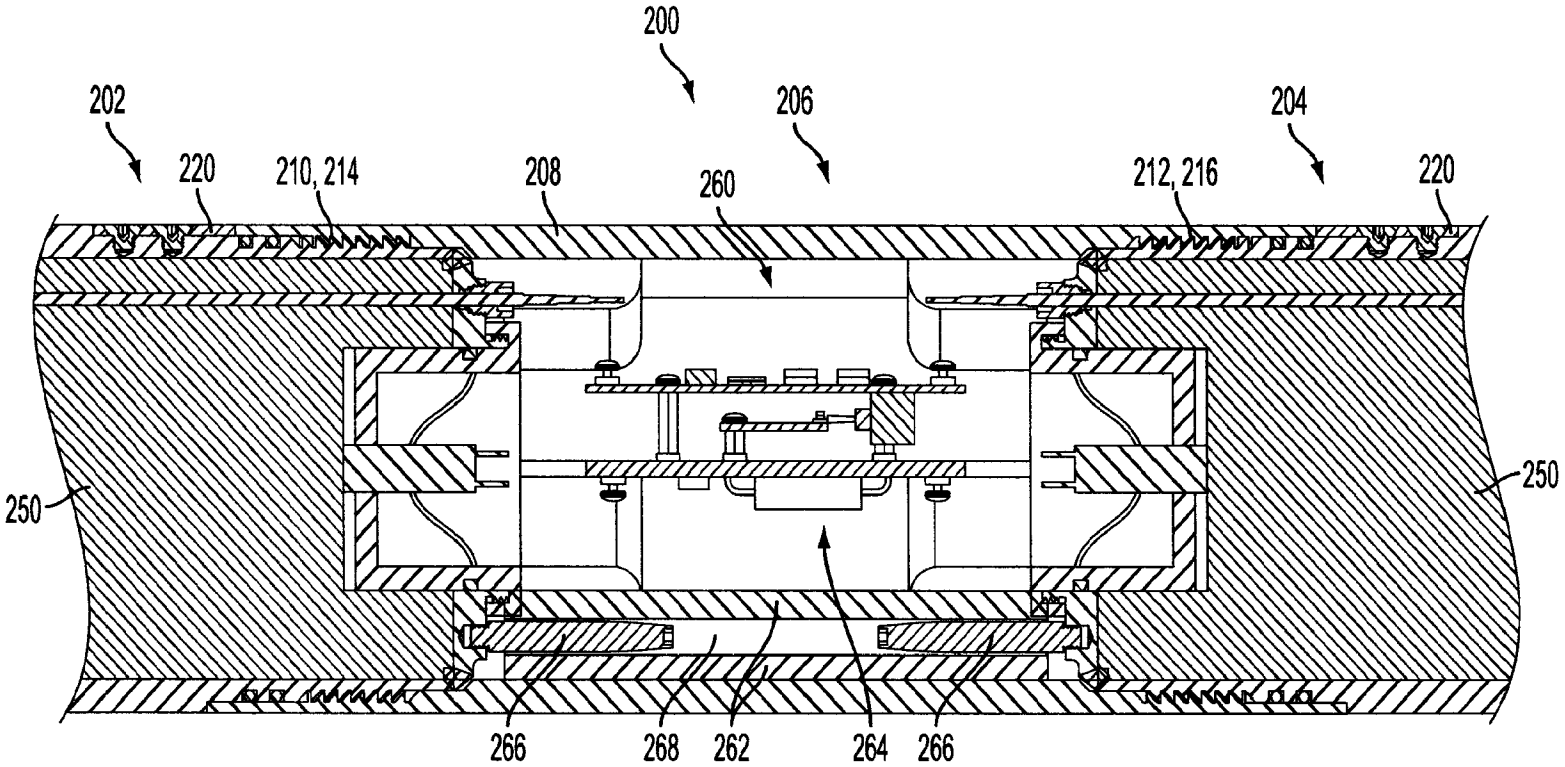
FIGS. 13 and 14A are cross-sectional views of the system of FIG. 12 taken along a longitudinal axis.
Figure 14A:
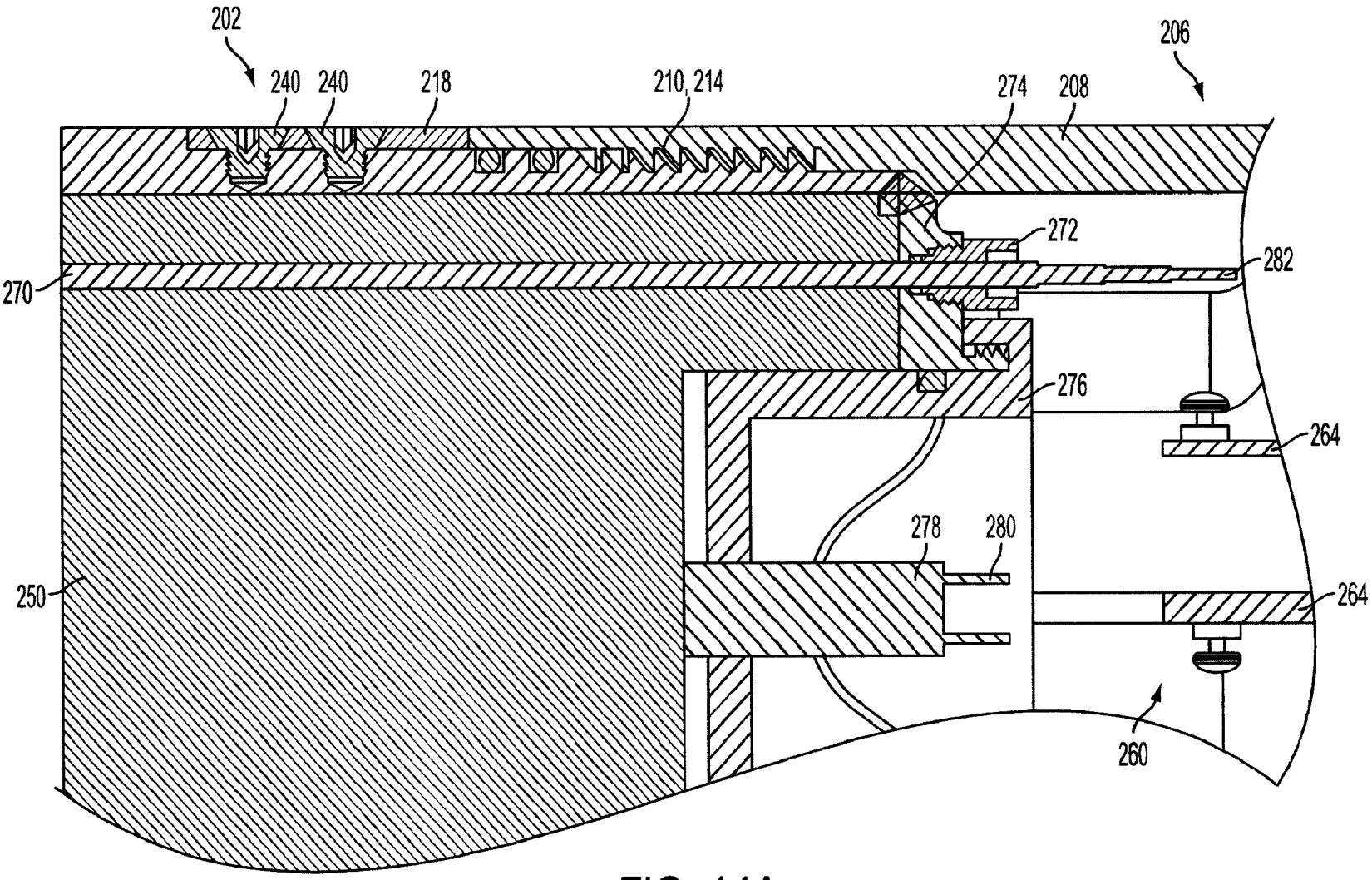

In some embodiments, a unit can comprise right-handed threads on one axial end portion of the casing and left-handed threads on the other axial end portion of the casing. As shown in FIG. 12, the oppositely threaded ends of each unit can facilitate coupling two units together with an intermediate connector. In the example shown in FIGS. 12-14A, a system 200 can be formed by coupling an exemplary first unit 202 and an exemplary second unit 204 together with an exemplary connector 206. FIGS. 13 and 14A show cross-sectional views taken along a longitudinal axis of the system 200 in an assembled state. The first and second units 202, 204 can be identical to or similar to the illustrated unit 100 shown in FIGS. 9-11, or can comprise alternative variations of units. For example, the units 202, 204 can comprise HE units that are similar or identical, but oriented in opposite axial directions such that their lone detonators are both facing the connector 206.

The connector 206 can comprise a tubular outer body 208 having first internal threads 210 at one end and second internal threads at the second opposite end, as shown in FIG. 12.

Mechanical coupling of the units 202, 204, and connector 206 can be accomplished by rotating connector 206 relative to the units 202, 204 (such as with the units 202, 204 stationary), such that internal threads 210, 212 thread onto external threads 214, 216 of the units 202, 204, respectively. The rotation of the connector 206 can act like a turnbuckle to draw the adjacent units 202, 204 together. The threads 210, 212, 214, 216 can comprise buttress threads for axial strength.

After the adjacent pair of units 202, 204 are drawn together, locking plates 218, 220 can be attached to each unit end portion and engage slots 222, 224, respectively in each end of the connector outer body 208 to prevent unintentional unscrewing of the joint. Lock plates 218, 220 are attached to each unit by fastening means (e.g., screws 240, 242 and screw holes 244, 246 in the unit case). The fastening means preferably do not pass through the case wall to avoid allowing the contained material 250 to escape and so that the system remains sealed. The lock plates 218, 220 prevent the connector 206 from unscrewing from the units 202, 204 to insure that the assembly stays intact.

The described threaded couplings between the units and the connectors can provide axial constraint of sections of a tool string to each other, and can also provide compliance in off-axis bending due to thread clearances. This can allow the tool string to bend slightly off-axis at each threaded joint such that it can be inserted into a bore which has a non-straight contour. One advantage of the described locking plate configuration is to eliminate the need for torquing the coupling threads to a specified tightness during assembly in the field. In practice, the connector shoulders (226, 228 in FIG. 12) need not be tightened to intimately abut the unit shoulders (230, 232 in FIG. 12) axially, but some amount of clearance can be left between the connector and unit shoulders to assure torque is not providing any, or only minimal, axial pre-stress on the system. This small clearance can also enhance the off-axis bending compliance of the tool string in conjunction with the thread clearances.

The connector 206 can further comprise a detonation control module 260 contained within the outer body 208. The detonation control module 260 can be configured to be freely rotatable relative to the outer body 208 about the central axis of the connector, such as via rotational bearings between the outer body and the detonation control module. The detonation control module 260 can comprise a structural portion 262 to which the electrical portions 264 are mounted. The electrical portions 264 of the detonation control module 260 are described in more detail below.

During assembly of the connector 260 to the units 202, 204, the detonation control module 206 can be held stationary relative to the units 202, 204 while the outer body 208 is rotated to perform mechanical coupling. To hold the detonation control module 260 stationary relative to the units 202, 204, one or both of the units can comprise one or more projections, such as pins 266 (see FIG. 13), that project axially away from the respective unit, such as from the end caps, and into a receiving aperture or apertures 268 in the structural portion 262 of the detonation control module 260. The pin(s) 266 can keep the detonation control module 260 stationary relative to the units 202, 204 such that electrical connections therebetween do not get twisted and/or damaged. In some embodiments, only one of the units 202, 204 comprises an axial projection coupled to the structural portion 262 of the detonation control module 260 to keep to stationary relative to the units as the outer casing is rotated.

The units 202, 204 can comprise similar structure to that described in relation to the exemplary unit 100 shown in FIGS. 9-11. As shown in FIGS. 13 and 14A, the unit 202 comprises electrical wires 270 extending through the material 250 in the unit and through glands 272 in an end cap 274. The unit 202 further comprises a detonator holder 276 extending through the end cap 272 and a detonator 278 extending through the holder 276. Unit 204 also comprises similar features. Electrical connections 280 of the detonator and 282 of the wires 270 can be electrically coupled to the detonation control module 260, as describe below, prior to threading the connector to the two units 202, 204.

Figure 14B:
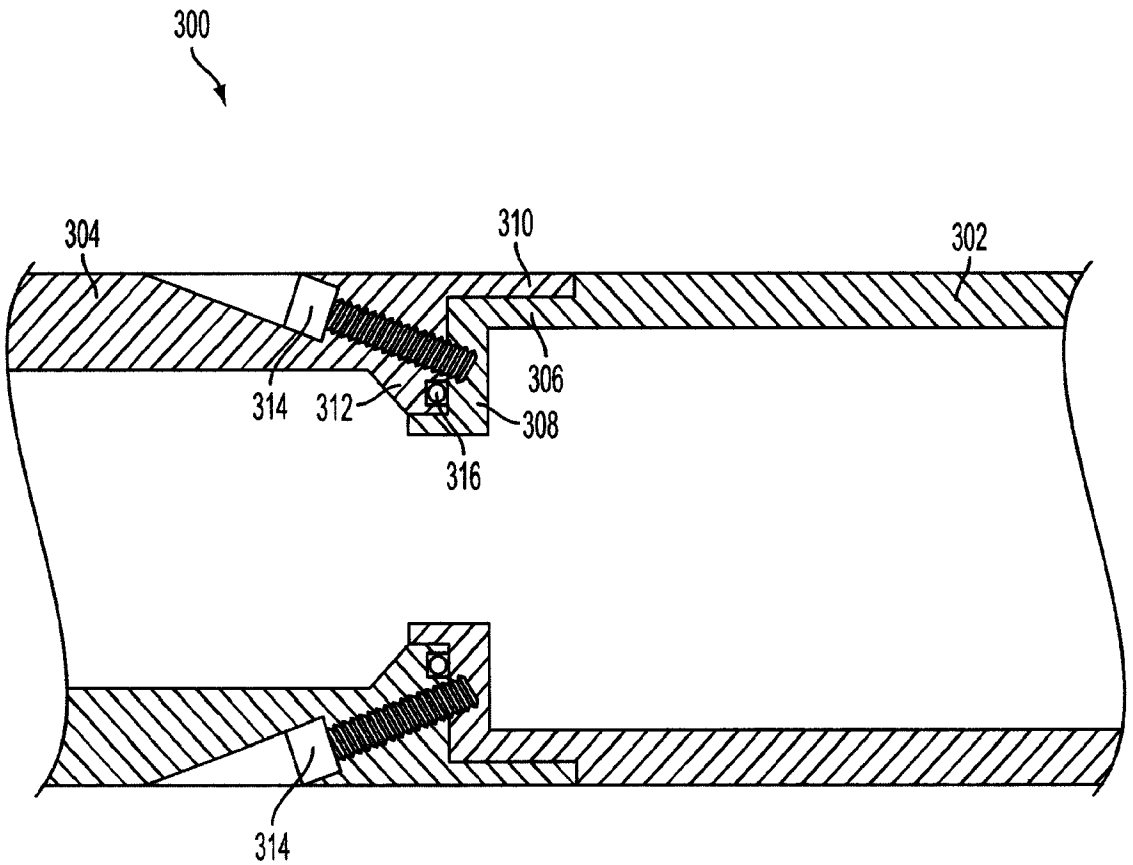
FIGS. 14B-14D are cross-sectional views showing alternative mechanical coupling systems.
Figure 14C:
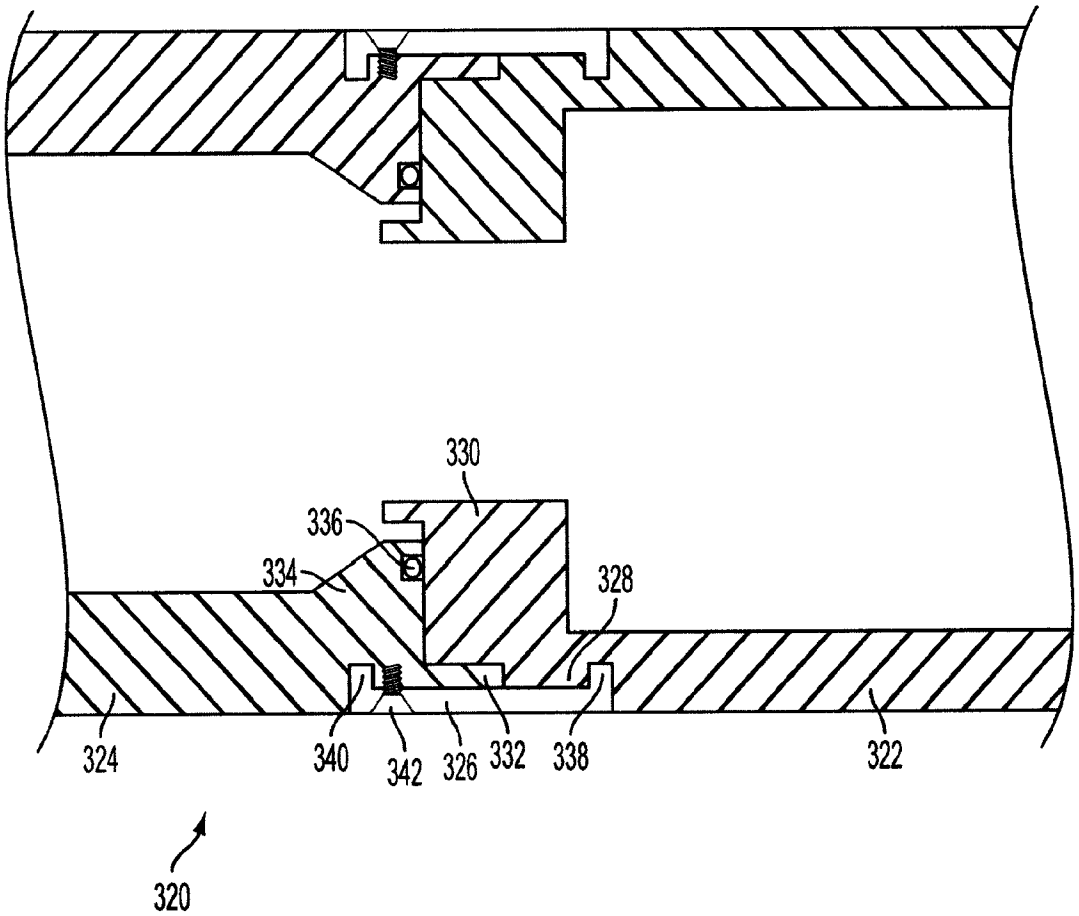
Figure 14D:
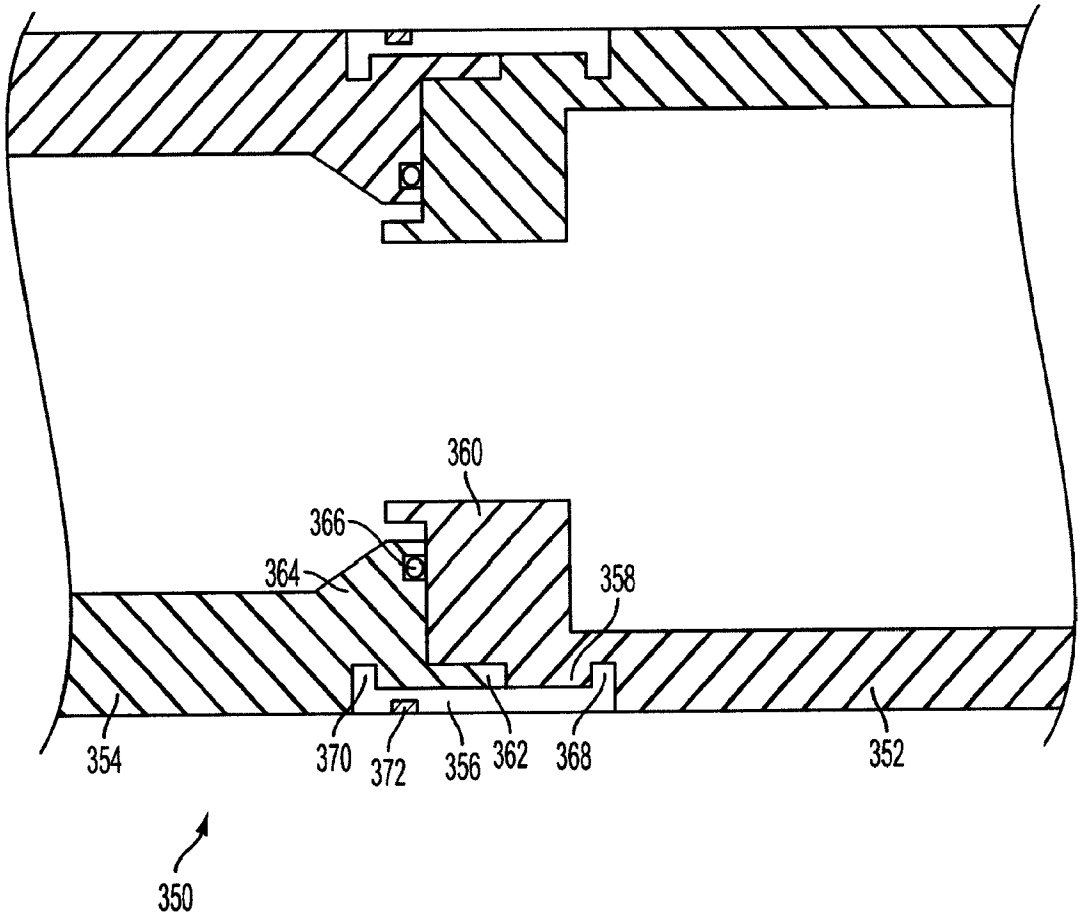

FIGS. 14B-14D shows cross-sectional views of alternative mechanical coupling mechanisms for attaching the units to the connectors. In each of FIGS. 14B-14D, some portions of the devices are omitted. For example, the detonation control module, detonator, wiring, and fill materials are not shown. The detonator holder and/or end caps of the units may also be omitted from these figures.

FIG. 14B shows an exemplary assembly 300 comprising a unit 302 (such as an HE or PP unit) and a connector 304. The unit 302 comprises a casing and/or end cap that includes a radially recessed portion 306 and an axial end portion 308. The connector 304 comprises an axial extension 310 positioned around the radially recessed portion 306 and an inner flange 312 positioned adjacent to the axial end portion 308. One or more fasteners 314 (e.g., screws) are inserted through the connector 304 at an angle between axial and radial. The fasteners 314 can be countersunk in the connector to preserve a smooth outer radial surface of the assembly. The fasteners 314 can extend through the inner flange 312 of the connector and through the axial end portion 308 of the unit, as shown, to mechanically secure the unit and the connector together. A sealing member 316, such as an O-ring, can be positioned between the inner flange 312 and the axial end portion 308, or elsewhere in the connector-unit joint, to seal the joint and prevent material contained within the assembly from escaping and prevent material from entering the assembly.

FIG. 14C shows another exemplary assembly 320 comprising a unit 322 (such as an HE or PP unit), a connector 324, and one or more locking plates 326. The unit 322 comprises a casing and/or end cap that includes a radially recessed portion 328 and an axial end portion 330. The connector 324 comprises an axial extension 332 positioned adjacent to the radially recessed portion 328 and an inner flange 334 positioned adjacent to the axial end portion 330. A sealing member 336, such as an O-ring, can be positioned between the inner flange 334 and the axial end portion 330, or elsewhere in the connector-unit joint, to seal the joint and prevent material contained within the assembly from escaping and prevent material from entering the assembly. The locking plate(s) 326 comprise a first ledge 338 that extends radially inwardly into a groove in unit 322, and a second ledge 340 that extends radially inwardly into a groove in the connector 324. The first and second ledges 338, 340 prevent the unit 322 and the connector 324 from separating axially apart from each other, locking them together. The plate(s) 326 can be secured radially to the assembly with one or more fasteners 342, such as screws, that extend radially through the plate 326 and into the connector 324 (as shown) or into the unit 322.

FIG. 14D shows yet another exemplary assembly 350 comprising a unit 352 (such as an HE or PP unit), a connector 354, and one or more locking plates 356. The unit 352 comprises a casing and/or end cap that includes a radially recessed portion 358 and an axial end portion 360. The connector 354 comprises an axial extension 362 positioned adjacent to the radially recessed portion 358 and an inner flange 364 positioned adjacent to the axial end portion 360. A sealing member 366, such as an O-ring, can be positioned between the inner flange 364 and the axial end portion 360, or elsewhere in the connector-unit joint, to seal the joint and prevent material contained within the assembly from escaping and prevent material from entering the assembly. The locking plate(s) 356 comprise a first ledge 368 that extends radially inwardly into a groove in unit 352, and a second ledge 370 that extends radially inwardly into a groove in the connector 354. The first and second ledges 368, 370 prevent the unit 352 and the connector 354 from separating axially apart from each other, locking them together. The plate(s) 376 can be secured radially to the assembly with one or more resilient bands or rings 372, such as an elastomeric band, that extends circumferentially around the assembly 350 to hold the plate(s) to the connector 354 and to the unit 352. The band(s) 372 can be positioned in an annular groove to maintain a flush outer surface of the assembly 350.

The assemblies shown in FIGS. 14A-14D are just examples of the many different possible mechanical couplings that can be used in the herein described systems and assemblies. It can be desirable that the mechanical couplings allow for some degree of off-axis pivoting between the unit and the connector to accommodate non-straight bore, and/or that the mechanical coupling imparts minimal or no axial pre-stress on the string, while providing sufficient axial strength to hold the string axially together under its own weight when in a bore and with additional axial forces imparted on the string due to friction, etc.

PP units and systems can be structurally similar to HE units and systems, and both can be described in some embodiments by exemplary structures shown in FIGS. 9-14. However, while HE units can comprise only a single detonator, in some PP units and PP systems, the PP unit can comprise two detonators/ignition systems, one positioned at each end of the unit. The PP ignition systems can be configured to simultaneously ignite the PP material from both ends of the unit. The two opposed PP ignition systems can comprise, for example, ceramic jet ignition systems. The PP ignitions systems can rapidly ignite the PP material along the axial length of the PP unit to help ignite the PP material in a more instantaneous matter, rather than having one end of the unit ignite first then wait for the reaction to travel down the length of the PP unit to the opposite end. Rapid ignition of the PP material can be desirable such that the PP ignition product material can quickly expand and fill the bore prior to the ignition of the HE material.

V. Exemplary Detonation Control Module and Electrical Systems

Figure 15:
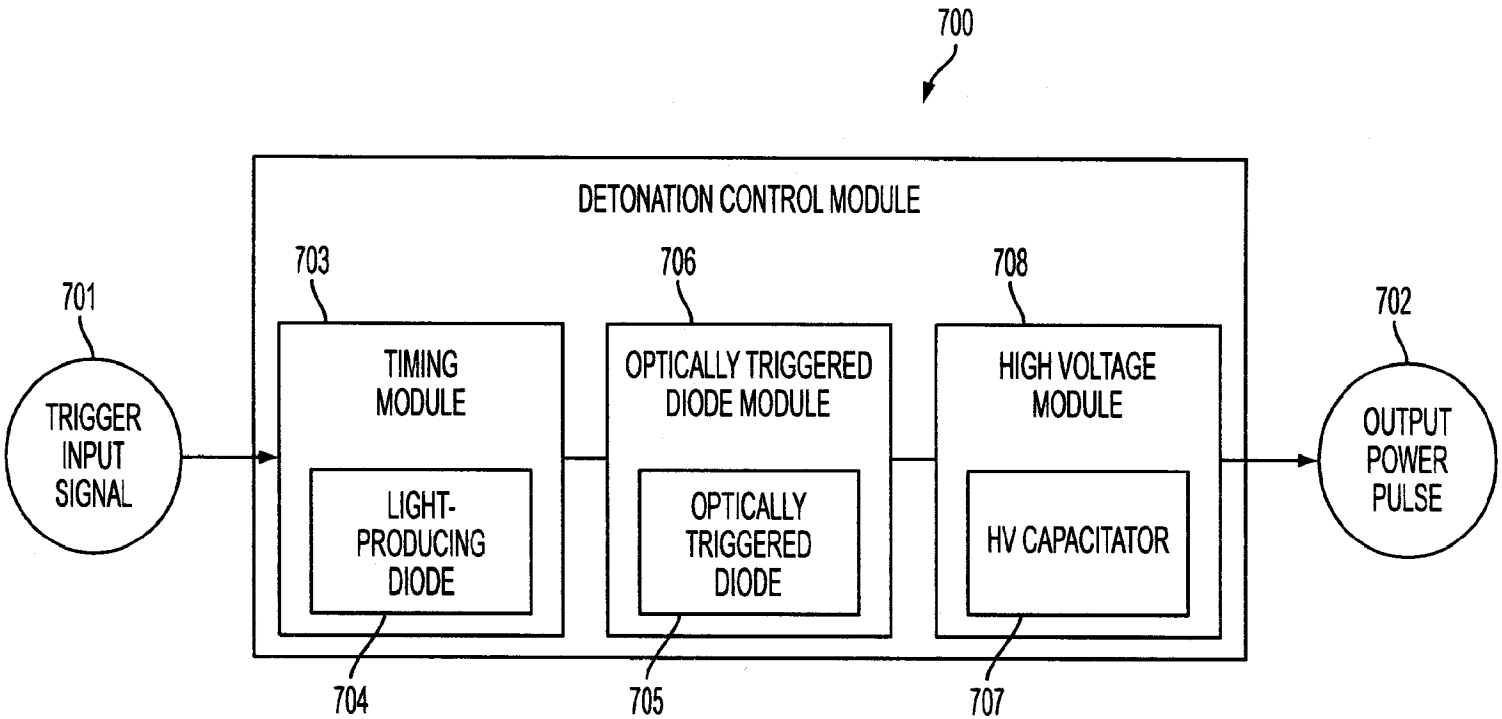
FIG. 15 is a diagram representing an exemplary detonation control module.

FIG. 15 is a block diagram illustrating an exemplary detonation control module 700. Detonation control module 700 is activated by trigger input signal 701 and outputs a power pulse 702 that triggers a detonator. In some embodiments, output power pulse 702 triggers a plurality of detonators. Trigger input signal 701 can be a common trigger signal that is provided to a plurality of detonation control modules to trigger a plurality of detonators substantially simultaneously. Detonators may detonate explosives, propellants, or other substances.

Detonation control module 700 includes timing module 703. Timing module 703 provides a signal at a controlled time that activates a light-producing diode 704. Light-producing diode 704, which in some embodiments is a laser diode, illuminates optically triggered diode 705 in optically triggered diode module 706, causing optically triggered diode 705 to conduct. In some embodiments, optically triggered diode 705 enters avalanche breakdown mode when activated, allowing large amounts of current flow. When optically triggered diode 705 conducts, high-voltage capacitor 707 in high-voltage module 708 releases stored energy in the form of output power pulse 702. In some embodiments, a plurality of high-voltage capacitors are used to store the energy needed for output power pulse 702.

Figure 16A:
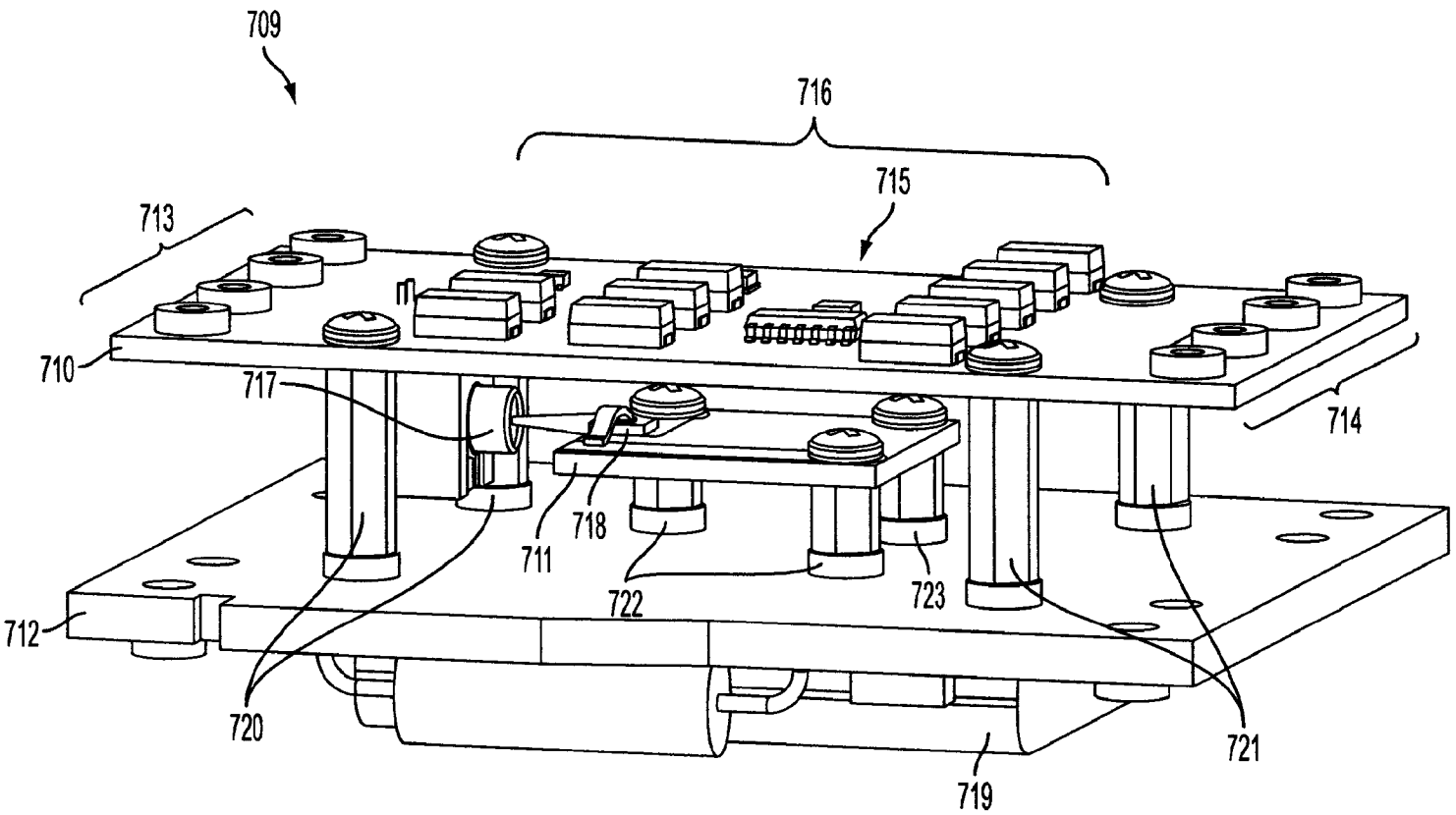
FIGS. 16A-16C are perspective views of one embodiment of a detonation control module.

FIG. 16A illustrates exemplary detonation control module 709. Detonation control module 709 includes timing module 710, optically triggered diode module 711, and high-voltage module 712. Connectors 713 and 714 connect timing module 710 with various input signals such as input voltages, ground, trigger input signal(s), and others. A timing circuit 715 includes a number of circuit components 716. Exemplary circuit components include resistors, capacitors, transistors, integrated circuits (such as a 555 or 556 timer), and diodes.

Timing module 710 also includes light-producing diode 717. Timing circuit 715 controls activation of light-producing diode 717. In some embodiments, light-producing diode 717 is a laser diode. Light-producing diode 717 is positioned to illuminate and activate optically triggered diode 718 on optically triggered diode module 711. Optically triggered diode 718 is coupled between a high-voltage capacitor 719 and a detonator (not shown).

As shown in FIG. 16A, timing module 710 is mechanically connected to high-voltage module 712 via connectors 720 and 721. Optical diode module 711 is both mechanically and electrically connected to high-voltage module 712 via connectors 722 and mechanically connected via connector 723.

Figure 16B:
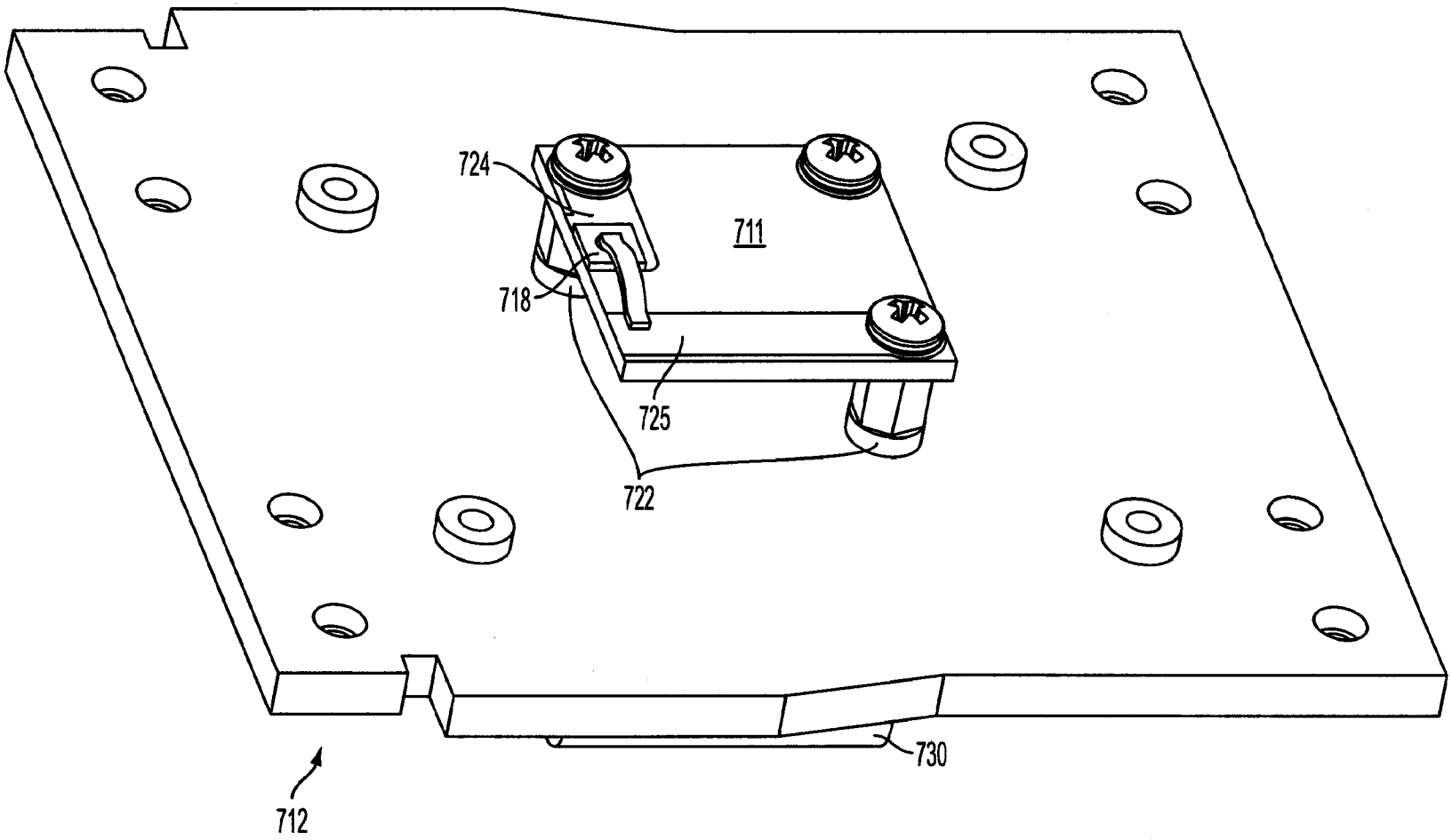

FIG. 16B illustrates optically triggered diode module 711. When optically triggered diode 718 is activated, a conductive path is formed between conducting element 724 and conducting element 725. The conductive path connects high-voltage capacitor 719 with a connector (shown in FIG. 17) to a detonator (not shown) via electrical connectors 722.

Figure 16C:
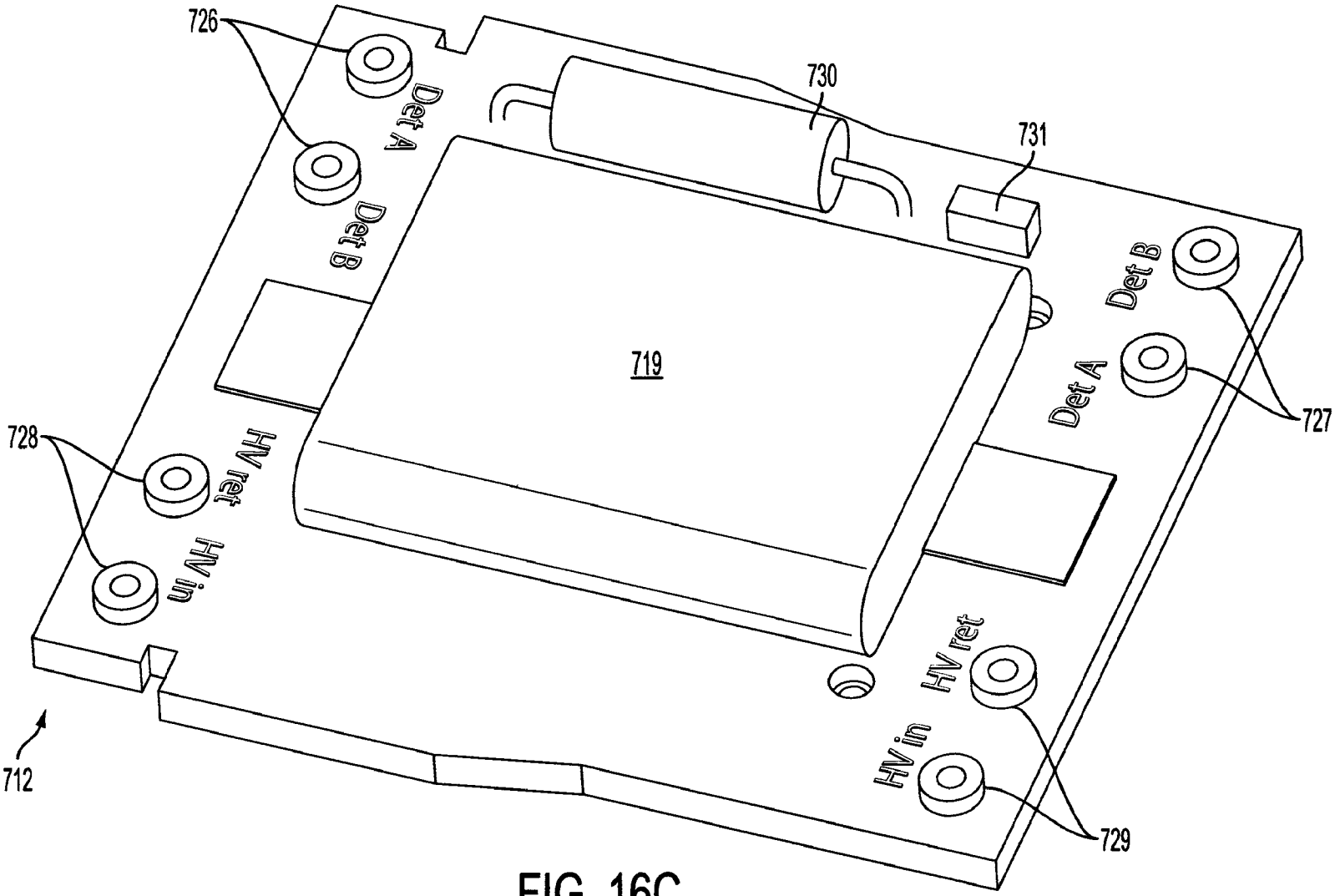

FIG. 16C illustrates high-voltage module 712. Connectors 726 and 727 connect high-voltage capacitor 719 to two detonators, "Det A" and "Det B." In some embodiments, each of connectors 726 and 727 connect high-voltage capacitor 719 to two detonators (a total of four). In other embodiments, detonation control module 709 controls a single detonator. In still other embodiments, detonation control module 709 controls three or more detonators. High-voltage capacitor 719 provides an output power pulse to at least one detonator (not shown) via connectors 726 and 727. Connectors 728 and 729 provide a high-voltage supply and high-voltage ground used to charge high-voltage capacitor 719. High-voltage module 712 also includes a bleed resistor 730 and passive diode 731 that together allow charge to safely drain from high-voltage capacitor 719 if the high-voltage supply and high-voltage ground are disconnected from connectors 728 and/or 729.

Figure 17:
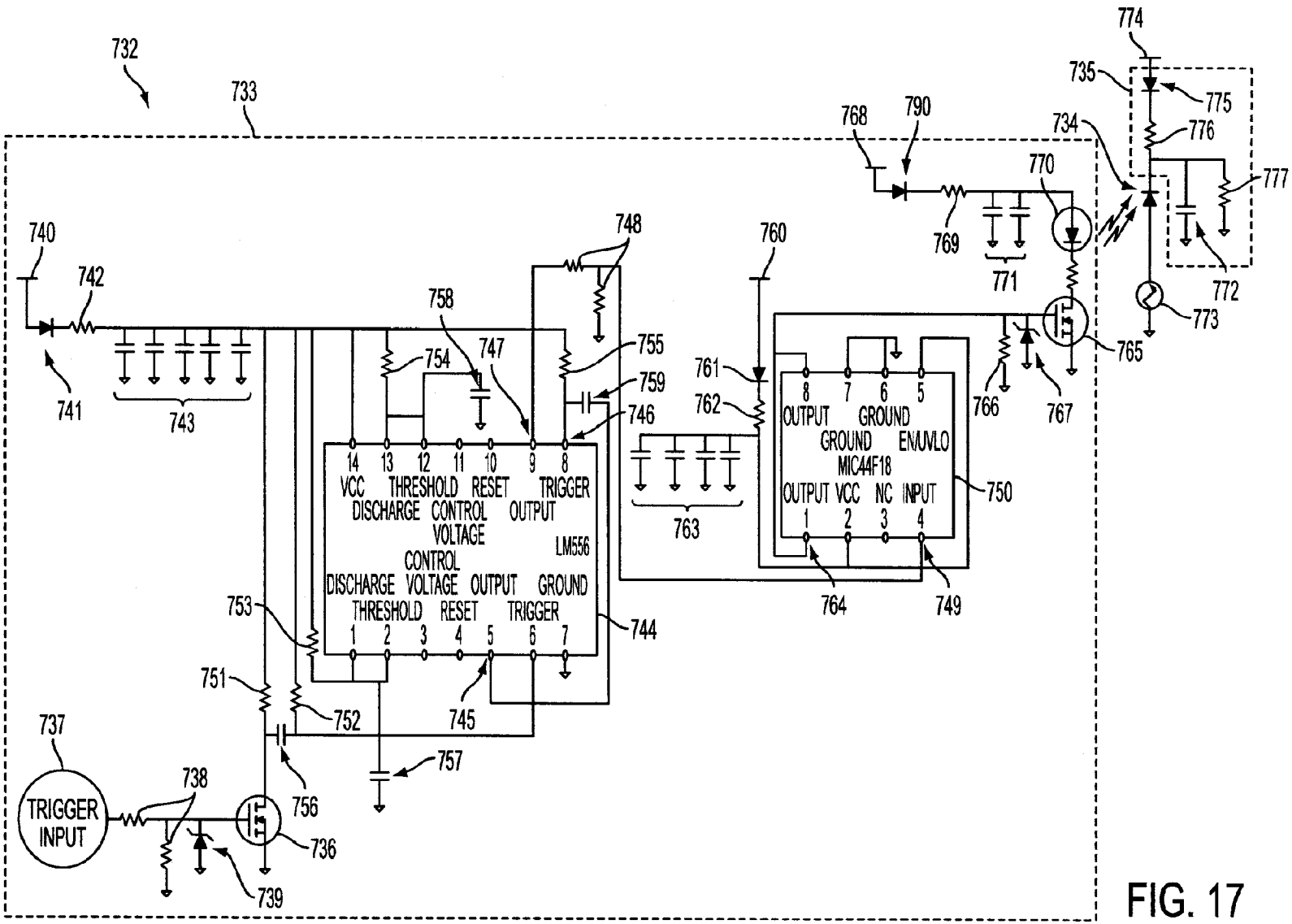
FIG. 17 is a circuit diagram representing an exemplary detonation control module.

FIG. 17 is a schematic detailing an exemplary detonation control module circuit 732 that implements a detonation control module such as detonation control module 709 shown in FIGS. 16A-16C. Detonation control module circuit 732 includes a timing circuit 733, an optically triggered diode 734, and high-voltage circuit 735. Timing circuit 733 includes a transistor 736. Trigger input signal 737 is coupled to the gate of transistor 736 through voltage divider 738. In FIG. 17, transistor 736 is a field-effect transistor (FET). Specifically, transistor 736 is a metal oxide semiconductor FET, although other types of FETs may also be used. FETs, including MOSFETs, have a parasitic capacitance that provides some immunity to noise and also require a higher gate voltage level to activate than other transistor types. For example, a bipolar junction transistor (BJT) typically activates with a base-emitter voltage of 0.7 V (analogous to transistor 736 having a gate voltage of 0.7 V). FETs, however, activate at a higher voltage level, for example with a gate voltage of approximately 4 V. A higher gate voltage (activation voltage) also provides some immunity to noise. For example, a 2V stray signal that might trigger a BJT would likely not trigger a FET. Other transistor types that reduce the likelihood of activation by stray signals may also be used. The use of the term "transistor" is meant to encompass all transistor types and does not refer to a specific type of transistor.

Zener diode 739 protects transistor 736 from high-voltage spikes. Many circuit components, including transistor 736, have maximum voltage levels that can be withstood before damaging the component. Zener diode 739 begins to conduct at a particular voltage level, depending upon the diode. Zener diode 739 is selected to conduct at a voltage level that transistor 736 can tolerate to prevent destructive voltage levels from reaching transistor 736. This can be referred to as "clamping." For example, if transistor 736 can withstand approximately 24 V, zener diode 739 can be selected to conduct at 12 V.

A "high" trigger input signal 737 turns on transistor 736, causing current to flow from supply voltage 740 through diode 741 and resistor 742. A group of capacitors 743 are charged by supply voltage 740. Diode 741 and capacitors 743 act as a temporary supply voltage if supply voltage 740 is removed. When supply voltage 740 is connected, capacitors 743 charge. When supply voltage 740 is disconnected, diode 741 prevents charge from flowing back toward resistor 742 and instead allows the charge stored in capacitors 743 to be provided to other components. Capacitors 743 can have a range of values. In one embodiment, capacitors 743 include three 25 μF capacitors, a 1 μF capacitor, and a 0.1 μF capacitor. Having capacitors with different values allows current to be drawn from capacitors 743 at different speeds to meet the requirements of other components.

There are a variety of circumstances in which supply voltage 740 can become disconnected but where retaining supply voltage is still desirable. For example, detonation control module 732 can be part of a system in which propellants are detonated prior to explosives being detonated. In such a situation, the timing circuitry that controls detonators connected to the explosives may need to continue to operate even if the power supply wires become either short circuited or open circuited as a result of a previous propellant explosion. The temporary supply voltage provided by diode 741 and capacitors 743 allows components that would normally have been powered by supply voltage 740 to continue to operate. The length of time the circuit can continue to operate depends upon the amount of charge stored in capacitors 743. In one embodiment, capacitors 743 are selected to provide at least 100 to 150 microseconds of temporary supply voltage. Another situation in which supply voltage 740 can become disconnected is if explosions are staggered by a time period. In some embodiments, supply voltage 740 is 6V DC and resistor 742 is 3.3 kΩ. The values and number of capacitors 743 can be adjusted dependent upon requirements.

Timing circuit 733 also includes a dual timer integrated circuit (IC) 744. Dual timer IC 744 is shown in FIG. 17 as a "556" dual timer IC (e.g., LM556). Other embodiments use single timer ICs (e.g. "555"), quad timer ICs (e.g. "558"), or other ICs or components arranged to perform timing functions. The first timer in dual timer IC 744 provides a firing delay. The firing delay is accomplished by providing a first timer output 745 (IC pin 5) to a second timer input 746 (IC pin 8). The second timer acts as a pulse-shaping timer that provides a waveform pulse as a second timer output 747 (IC pin 9). After voltage divider 748, the waveform pulse is provided to a MOSFET driver input 749 to drive a MOSFET driver IC 750. MOSFET driver IC 750 can be, for example, a MIC44F18 IC.

Timer ICs such as dual timer IC 744, as well as the selection of components such as resistors 751, 752, 753, 754, and 755 and capacitors 756, 757, 758, and 759 to operate dual timer IC 744, are known in the art and are not discussed in detail in this application. The component values selected depend at least in part upon the desired delays. In one embodiment, the following values are used: resistors 751, 752, and 755=100 kΩ and capacitors 756 and 759=0.01 μF. Other components and component values may also be used to implement dual timer IC 744.

MOSFET driver IC 750 is powered by supply voltage 760 through diode 761 and resistor 762. In some embodiments, supply voltage 760 is 6V DC and resistor 762 is 3.3 kΩ Supply voltage 760 can be the same supply voltage as supply voltage 740 that powers dual timer IC 744. A group of capacitors 763 are charged by supply voltage 760. Diode 761 and capacitors 763 act to provide a temporary supply voltage when supply voltage 760 is disconnected or shorted. As discussed above, diode 761 is forward biased between supply voltage 760 and the power input pin of MOSFET driver IC 750 (pin 2). Capacitors 763 are connected in parallel between the power input pin and ground. Capacitors 763 can have a range of values.

MOSFET driver output 764 activates a driver transistor 765. In some embodiments, driver transistor 765 is a FET. MOSFET driver IC 750 provides an output that is appropriate for driving transistor 765, whereas second timer output 747 is not designed to drive capacitive loads such as the parasitic capacitance of transistor 765 (when transistor 765 is a FET).

Resistor 766 and zener diode 767 clamp the input to driver transistor 765 to prevent voltage spikes from damaging transistor 765. When driver transistor 765 is activated, current flows from supply voltage 768, through diode 790 and resistor 769 and activates a light-producing diode 770. In some embodiments, driver transistor 765 is omitted and MOSFET driver output 764 activates light-producing diode 770 directly.

In some embodiments, light-producing diode 770 is a pulsed laser diode such as PLD 905D1S03S. In some embodiments, supply voltage 768 is 6V DC and resistor 769 is 1 kΩ Supply voltage 768 can be the same supply voltage as supply voltages 740 and 760 that power dual timer IC 744 and MOSFET driver IC 750, respectively. A group of capacitors 771 are charged by supply voltage 768. Diode 790 and capacitors 771 act to provide a temporary supply voltage when supply voltage 768 is removed (see discussion above regarding diode 741 and capacitors 743). Capacitors 771 can have a range of values.

When activated, light-producing diode 770 produces a beam of light. Light-producing diode 770 is positioned to illuminate and activate optically triggered diode 734. In some embodiments, optically triggered diode 734 is a PIN diode. Optically triggered diode 734 is reverse biased and enters avalanche breakdown mode when a sufficient flux of photons is received. In avalanche breakdown mode, a high-voltage, high-current pulse is conducted from high-voltage capacitor 772 to detonator 773, triggering detonator 773. In some embodiments, additional detonators are also triggered by the high-voltage, high-current pulse.

High-voltage capacitor 772 is charged by high-voltage supply 774 through diode 775 and resistor 776. In one embodiment, high-voltage supply 774 is about 2800 V DC. In other embodiments, high-voltage supply 774 ranges between about 1000 and 3500 V DC. In some embodiments, a plurality of high-voltage capacitors are used to store the energy stored in high-voltage capacitor 772. Diode 775 prevents reverse current flow and allows high-voltage capacitor to still provide a power pulse to detonator 773 even if high-voltage supply 774 is disconnected (for example, due to other detonations of propellant or explosive). Bleed resistor 777 allows high-voltage capacitor 772 to drain safely if high-voltage supply 774 is removed. In one embodiment, resistor 776 is 10 kΩ, bleed resistor 777 is 100 MΩ, and high-voltage capacitor 772 is 0.2 μF. High-voltage capacitor 772, bleed resistor 777, resistor 776, and diode 775 are part of high-voltage circuit 735.

Figure 18:
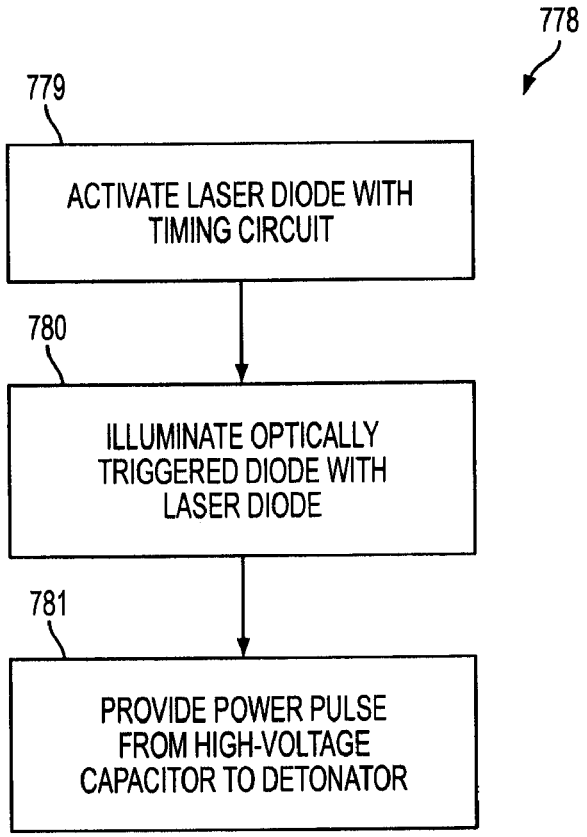
FIG. 18 is a flow chart illustrating an exemplary method disclosed herein.

FIG. 18 illustrates a method 778 of controlling detonation. In process block 779, a laser diode is activated using at least one timing circuit. In process block 780, an optically triggered diode is illuminated with a beam produced by the activated laser diode. In process block 781, a power pulse is provided from a high-voltage capacitor to a detonator, the high-voltage capacitor coupled between the optically triggered diode and the detonator.

FIGS. 15-18 illustrate a detonation control module in which a light-producing diode activates an optically triggered diode to release a high-voltage pulse to trigger a detonator. Other ways of triggering a detonator are also possible. For example, a transformer can be used to magnetically couple a trigger input signal to activate a diode and allow a high-voltage capacitor to provide a high-voltage pulse to activate a detonator. Optocouplers, for example MOC3021, can also be used as a coupling mechanism.

A detonation system can include a plurality of detonation control modules spaced throughout the system to detonate different portions of explosives.

VI. Exemplary Methods of Use

The herein described systems are particularly suitable for use in fracturing an underground geologic formation where such fracturing is desired. One specific application is in fracturing rock along one or more sections of an underground bore hole to open up cracks or fractures in the rock to facilitate the collection of oil and gas trapped in the formation.

Thus, desirably a plurality of spaced apart explosive charges are positioned along a section of a bore hole about which rock is to be fractured. The explosive charges can be placed in containers such as tubes and plural tubes can be assembled together in an explosive assembly. Intermediate propellant charges can be placed between the explosive charges and between one or more assemblies of plural explosive charges to assist in the fracturing. The propellant charges can be placed in containers, such as tubes, and one or more assemblies of plural propellant charges can be positioned between the explosive charges or explosive charge assemblies. In addition, containers such as tubes of an inert material with a working liquid being a desirable example, can be placed intermediate to explosive charges or intermediate to explosive charge assemblies. This inert material can also be positioned intermediate to propellant charges and to such assemblies of propellant charges. The "working fluid" refers to a substantially non-compressible fluid such as water or brine, with saltwater being a specific example. The working fluid or liquid assists in delivering shockwave energy from propellant charges and explosive charges into the rock formation along the bore hole following initiation of combustion of the propellant charges and the explosion of the explosives.

In one specific approach, a string of explosive charge assemblies and propellant charge assemblies are arranged in end to end relationship along the section of a bore hole to be fractured. The number and spacing of the explosive charges and propellant charges, as well as intermediate inert material or working fluid containing tubes or containers, can be selected to enhance fracturing.

For example, a numerical/computational analysis approach using constituent models of the material forming the underground geologic formation adjacent to the bore hole section and of the explosive containing string can be used. These analysis approaches can use finite element modeling, finite difference methods modeling, or discrete element method modeling. In general, data is obtained on the underground geologic formation along the section of the bore hole to be fractured or along the entire bore hole. This data can be obtained any number of ways such as by analyzing core material obtained from the bore hole. This core material will indicate the location of layering as well as material transitions, such as from sandstone to shale. The bore hole logging and material tests on core samples from the bore hole, in the event they are performed, provide data on stratrigraphy and material properties of the geologic formation. X-ray and other mapping techniques can also be used to gather information concerning the underground geologic formation. In addition, extrapolation approaches can be used such as extrapolating from underground geologic formation information from bore holes drilled in a geologically similar (e.g., a nearby) geologic area.

Thus, using the finite element analysis method as a specific example, finite element modeling provides a predictive mechanism for studying highly complex, non-linear problems that involve solving, for example, mathematical equations such as partial differential equations. Existing computer programs are known for performing an analysis of geologic formations. One specific simulation approach can use a software program that is commercially available under the brand name ABAQUS, and more specifically, an available version of this code that implements a fully coupled Euler-Lagrange methodology.

This geologic data can be used to provide variables for populating material constitutive models within the finite element modeling code. The constitutive models are numerical representations of cause-and-effect for that particular material. That is, given a forcing function, say, pressure due to an explosive load, the constitutive model estimates the response of the material. For example, these models estimate the shear strain or cracking damage to the geologic material in response to applied pressure. There are a number of known constitutive models for geologic materials that can be used in finite element analysis to estimate the development of explosive-induced shock in the ground. These models can incorporate estimations of material damage and failure related directly to cracking and permeability. Similar constitutive models also exist for other materials such as an aluminum tube (if an explosive is enclosed in an aluminum tube) and working fluid such as brine.

In addition, equations of state (EOS) exist for explosive materials including for non-ideal explosives and propellants. In general, explosive EOS equations relate cause-and-effect of energy released by the explosive (and propellant if any) and the resulting volume expansion. When coupled to a geologic formation or medium, the expansion volume creates pressure that pushes into the medium and causes fracturing.

Figure 21:
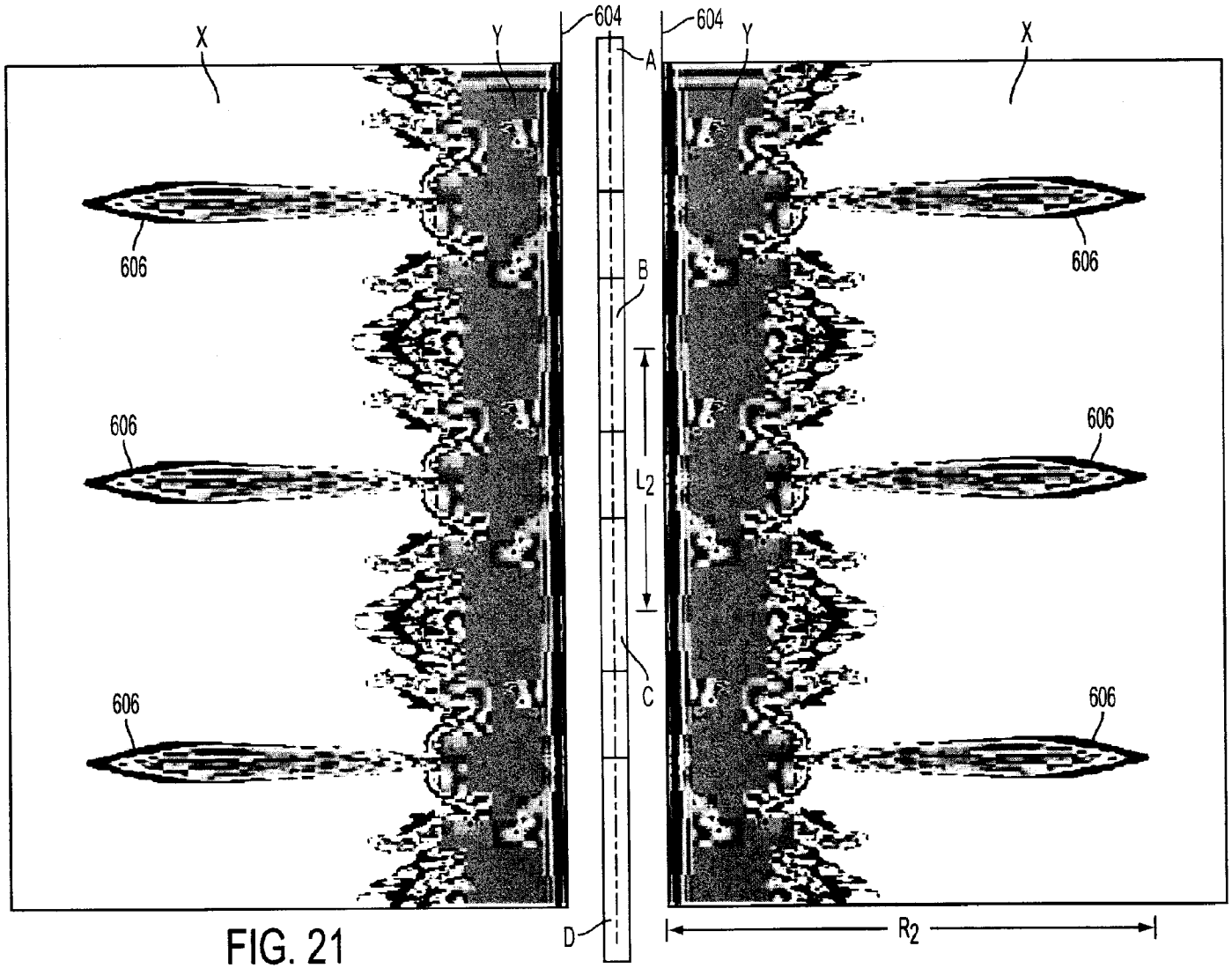

In view of the above, from the information obtained concerning the geologic material along the section of a bore hole to be fractured, a constitutive model of the material can be determined. One or more simulations of the response of this material model to an arrangement of explosive charges (and propellant charges if any, and working fluid containers, if any) can be determined. For example, a first of such simulations of the reaction of the material to explosive pressure from detonating explosive charges, pressure from one or more propellant charges, if any, and working fluids if any, can be performed. One or more additional simulations (for example plural additional simulations) with the explosive charges, propellant charges if any, and/or working fluids, if any, positioned at different locations or in different arrangements can then be performed. The simulations can also involve variations in propellants and explosives. The plural simulations of the reaction of the material to the various simulated explosive strings can then be evaluated. The simulation that results in desired fracturing, such as fracturing along a bore hole with spaced apart rubblization areas comprising radially extending discs, as shown in FIG. 21, can then be selected. The selected arrangement of explosive charges, propellant charges, if any, and working fluids, if any, can then be assembled and positioned along the section of the bore hole to be fractured. This assembly can then be detonated and the propellant charges, if any, initiated to produce the fractured geologic formation with desired rubblization zones. Thus, rubblization discs can be obtained at desired locations and extended radii beyond fracturing that occurs immediately near the bore hole.

The timing of detonation of explosives and initiation of combustion of various propellant charges can be independently controlled as described above in connection with an exemplary timing circuit. For example, the explosives and propellant initiation can occur simultaneously or the propellant charges being initiated prior to detonating the explosives. In addition, one or more explosive charges can be detonated prior to other explosive charges and one or more propellant charges can be initiated prior to other propellant charges or prior to the explosive charges, or at other desired time relationships. Thus, explosive charges can be independently timed for detonation or one or more groups of plural explosive charges can be detonated together. In addition, propellant charges can be independently timed for initiation or one or more groups of plural propellant charges can be initiated together. Desirably, initiation of the combustion propellant charges is designed to occur substantially along the entire length of, or along a majority of the length of, the propellant charge when elongated propellant charge, such as a tube, is used. With this approach, as the propellant charge burns, the resulting gases will extend radially outwardly from the propellant charges. For example, ceramic jet ejection initiators can be used for this purpose positioned at the respective ends of tubular propellant charges to eject hot ceramic material or other ignition material axially into the propellant charges. In one desirable approach, combustion of one or more propellant charges is initiated simultaneously at both ends of the charge or at a location adjacent to both ends of the charge. In addition, in one specific approach, assemblies comprising pairs of explosive charges are initiated from adjacent ends of explosive charges.

Desirably, the explosive charges are non-ideal explosive formulations such as previously described. In one specific desirable example, the charges release a total stored energy (e.g., chemically stored energy) equal to or greater than 12 kJ/cc and with greater than thirty percent of the energy released by the explosive being released in the following flow Taylor Wave of the detonated (chemically reacting) explosive charges.

In one approach, an assembly of alternating pairs of propellant containing tubes and explosive containing tubes, each tube being approximately three feet in length, was simulated. In the simulation, detonation of the explosives and simultaneous initiation of the propellant charges provided a simulated result of plural spaced apart rubblization discs extending radially outwardly beyond a fracture zone adjacent to and along the fractured section of the bore hole.

Desirably, the explosive charges are positioned in a spaced apart relationship to create a coalescing shock wave front extending radially outwardly from the bore hole at a location between the explosive charges to enhance to rock fracturing.

The system can be used without requiring the geologic modeling mentioned above. In addition, without modeling one can estimate the reaction of the material to an explosive assembly (which may or may not include propellant charges and working fluid containers) and adjust the explosive materials based on empirical observations although this would be less precise. Also, one can simply use strings of alternating paired explosive charge and paired propellant charge assemblies. In addition, the timing of detonation and propellant initiation can be empirically determined as well. For example, if the geologic material shows a transition between sandstone and shale, one can delay the sandstone formation detonation just slightly relative to the detonation of the explosive in the region of the shale to result in fracturing of the geologic formation along the interface between the sandstone and shale if desired.

Unique underground fractured geologic rock formations can be created using the methods disclosed herein. Thus, for example, the explosion and/or propellant gas created fracture structures (if propellants are used) can be created adjacent to a section of a previously drilled bore hole in the geologic rock formation or structure. The resulting fractured structure comprises a first zone of fractured material extending a first distance away from the location of the previously drilled bore hole. Typically this first zone extends a first distance from the bore hole and typically completely surrounds the previously existing bore hole (previously existing allows for the fact that the bore hole may collapse during the explosion). In addition, plural second zones of fractured material spaced apart from one another and extending radially outwardly from the previously existing bore hole are also created. The second fracture zones extend radially outwardly beyond the first fracture zone. Consequently, the radius from the bore hole to the outer periphery or boundary of the second fracture zones is much greater than the distance to the outer periphery or boundary of the first zone of fractured material from the bore hole. More specifically, the average furthest radially outward distance of the second fracture zones from the previously existing bore hole is much greater than the average radially outward distance of the fractured areas along the bore hole in the space between the spaced apart second zones.

More specifically, in one example the second fracture zones comprise a plurality of spaced apart rubblization discs of fractured geologic material. These discs extend outwardly to a greater radius than the radius of the first fracture zone. These discs can extend radially outwardly many times the distance of the first zones, such as six or more times as far.

By using non-ideal explosive formulations, less pulverization or powdering of rock adjacent to the previous existing bore hole results. Powdered pulverized rock can plug the desired fractures and interfere with the recovery of petroleum products (gas and oil) from such fracturing. The use of propellant charges and working fluid including working fluid in the bore hole outside of the explosive charges can assist in the reduction of this pulverization.

Specific exemplary approaches for implementing the methodology are described below. Any and all combinations and sub-combinations of these specific examples are within the scope of this disclosure.

Thus, in accordance with this disclosure, a plurality of spaced apart explosive charges can be positioned adjacent to one another along a section of the bore hole to be fractured. These adjacent explosive charges can be positioned in pairs of adjacent explosive charges with the explosive charges of each pair being arranged in an end to end relationship. The charges can be detonated together or at independent times. In one desirable approach, the charges are detonated such that detonation occurs at the end of the first of the pair of charges that is adjacent to the end of the second of the pair of charges that is also detonated. In yet another example, the detonation of the explosive charges only occurs at the respective adjacent ends of the pair of charges. Multiple pairs of these charges can be assembled in a string with or without propellant charges and working liquid containers positioned therebetween. Also, elongated propellant charges can be initiated from opposite ends of such propellant charges and can be assembled in plural propellant charge tubes. These propellant charge tube assemblies can be positioned intermediate to at least some of the explosive charges, or explosive charge assemblies. In accordance with another aspect of an example, pairs of explosive charges can be positioned as intercoupled charges in end to end relationships with a coupling therebetween. Pairs of propellant charges can be arranged in the same manner.

In an alternative embodiment, although expected to be less effective, a plurality of spaced apart propellant charges and assemblies of plural propellant charges can be initiated, with or without inert material containing tubes therebetween, with the explosive charges eliminated. In this case, the rubblization zones are expected to be less pronounced than rubblization zones produced with explosive charges, and with explosive charge and propellant charge combinations, with or without the inert material containers therebetween.

Other aspects of method acts and steps are found elsewhere in this disclosure. This disclosure encompasses all novel and non-obvious combinations and sub-combinations of method acts set forth herein.

VII. Exemplary Detonation Results

Figure 19:
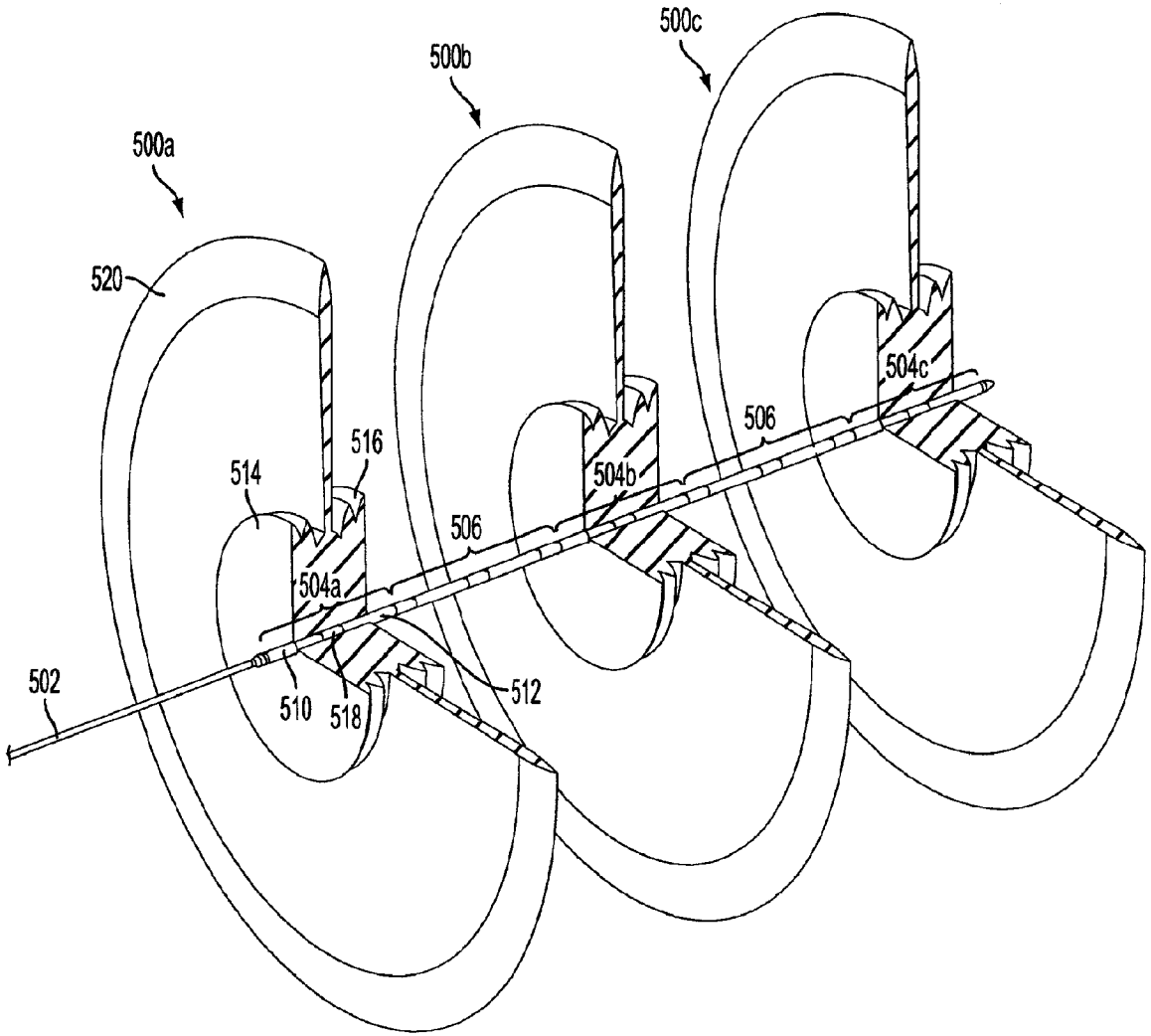
FIG. 19 is a partially cross-sectional perspective view of a theoretical shock pattern produced by a detonated tool string.

FIG. 19 shows exemplary shock patterns 500*a*, 500*b*, and 500*c* resulting from detonation of an exemplary string 502 within a bore (not shown) in a geologic formation. The string 502 comprises a first HE system 504*a*, a second HE system 504*b*, and a third HE system 504*c*, and two PP systems 506 positioned between the three HE systems. Each of the HE systems 504 is similar in construction and function to the exemplary HE system 200 shown in FIGS. 12-14, and comprises a pair of HE units and a connector. The PP systems 506 comprise a pair of PP units and three adjacent connectors. The HE system 504*a* is centered on a causes the shock pattern 500*a*, the HE system 504*b* is centered on a causes the shock pattern 500*b*, and the HE system 504*c* is centered on a causes the shock pattern 500*c*.

Taking the HE unit 504*a* and its resulting shock pattern 500*a* as an example, each of the individual HE units 510, 512 causes nearly identical shock patterns 514, 516, respectively, that are symmetrical about the connector 518 that joins the HE units. Note that the illustrated shock pattern in FIG. 19 only shows a central portion of the resulting shock pattern from each HE system, and excludes portions of the shock pattern not between the centers of the two HE units. The portion of the shock pattern shown is of interest because the shocks from each of the two HE units interact with each other at a plane centered on the connector 518 between the two HE units, causing a significant synergistic shock pattern 520 that extends much further radially away from the bore and string compared to the individual shock patterns 514, 516 of each HE unit.

By spacing the HE charges appropriately there results a zone of interaction between the charges which leads to a longer effective radius of shock and rubblization. Spaced and timed charges can increase the effected radius by a factor of 3 to 4 when compared to a single large explosive detonation. Instead of a dominate fracture being created that extends in a planar manner from the wellbore, the disclosed system can result in an entire volume rubblization that surrounds the wellbore in a full 360 degrees. In addition, possible radial fracturing that extends beyond the rubblized zone can result.

The HE charges can separated by a distance determined by the properties of the explosive material and the surrounding geologic formation properties that allows for the development and interaction of release waves (i.e., unloading waves which occur behind the "front") from the HE charges. A release wave has the effect of placing the volume of material into tension, and the coalescence of waves from adjacent charges enhances this tensile state. Consideration of the fact that rock fracture is favored in a state of tension, an exemplary multiple charge system can favors optimum rock fracture such that these fractures will remain open by self-propping due to asperities in the fracture surface.

Furthermore, the space between the HE charges includes PP systems. The PP systems cause additional stress state in the rock to enhance the effect of the main explosive charges.

Figure 20:
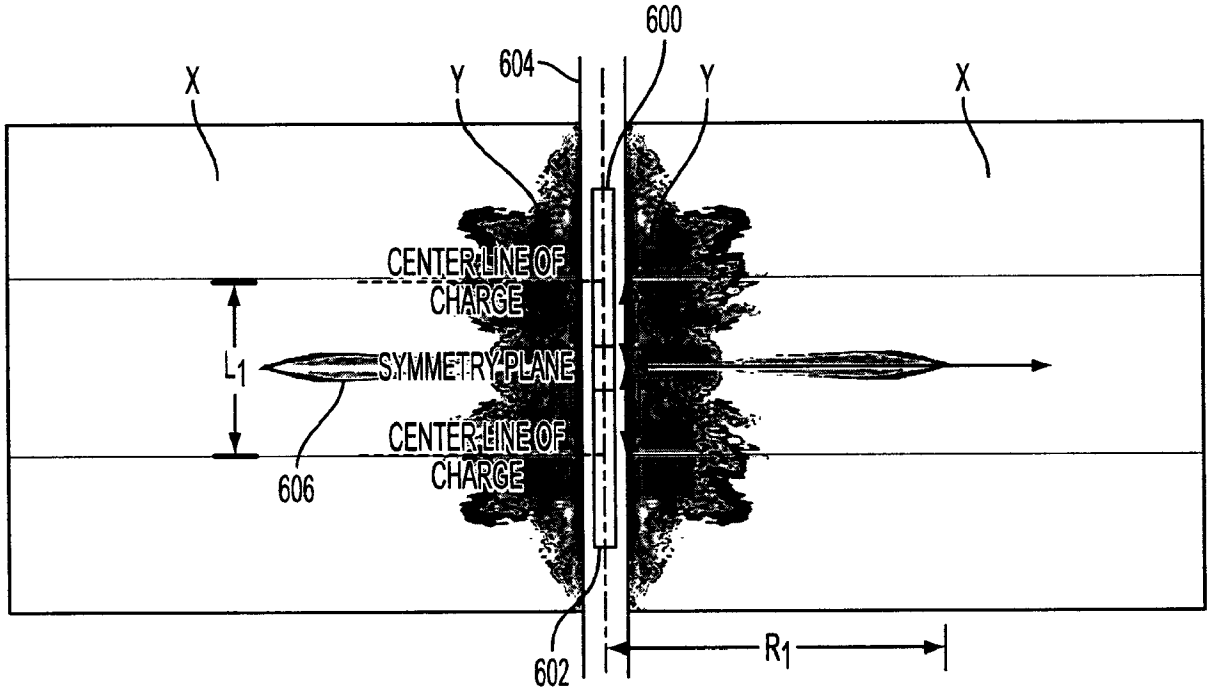
FIGS. 20 and 21 are vertical cross-sectional views through a geologic formation along a bore axis, showing rubbilization patterns resulting from a detonation.

FIG. 20 shows exemplary simulated results of a detonation as described herein. Two 2 meter long HE units, labeled 600 and 602, are connected in a HE system with an intermediate connector, and have a center-to-center separation $L_1$ of 3.5 m. The HE system is detonated in a bore 604 in a theoretically uniform rock formation. The contours are rock fracture level, with zone 20 representing substantially full rock fracture and zone X showing no fracture or partial fracture. Expected damage regions directly opposite each charge are apparent, and these extend to about 3 meters radially from the bore 604. However, the region of the symmetry between the two charges shows a "rubble disk" 606 that extends considerably further to a distance $R_1$, e.g., about 10 m, from the bore into the geologic formation. This simulation illustrates the extent of improved permeability through rock fracture that can be accomplished by taking advantage of shock wave propagation effects and charge-on-charge release wave interaction. Also, it is anticipated that late-time formation relaxation will induce additional fracturing between rubble disks. FIG. 20 is actually a slice through a 360° damage volume created about the axis of the charges.

In addition to the interaction between two adjacent charges, performance can be further improved by using an HE system with more than two HE units in series. For example, FIG. 21 shows three rubble disks created by four separated HE units, A, B, C, D. As in FIG. 20, FIG. 21 shows a slice through a 360° rubble zone.

Additional considerations in the design of explosive stimulation systems, such as described herein, can include the material and configuration of the HE unit container (e.g., aluminum tube), the inclusion of propellant units within the string in the axial volume between the individual charges, and the introduction of brine or other borehole fluid to fill the annulus separating the explosive system and the host rock formation. The propellant has been shown to be effective in boosting and extending the duration of the higher rock stress state, consequently extending fracture extent. The HE unit container can be designed not simply to facilitate placement of the system into a wellbore but, along with the wellbore fluid, it can provide a means for mechanically coupling the blast energy to the surrounding rock. Moreover, coupling of the shock through the aluminum or similar material case avoids short-duration shock which can result in near-wellbore crushing of the rock, with accompanying diminishment of available energy available for the desired long-range tensile fracturing process. This coupling phenomenon is complementary to the energy release characteristics of the explosive as discussed elsewhere herein.

Figure 22C:
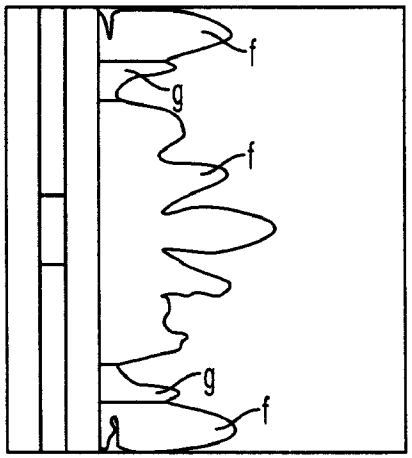
FIG. 22C is a schematic illustrating different geologic layers present in the rubbilization zone.
Figure 22B:
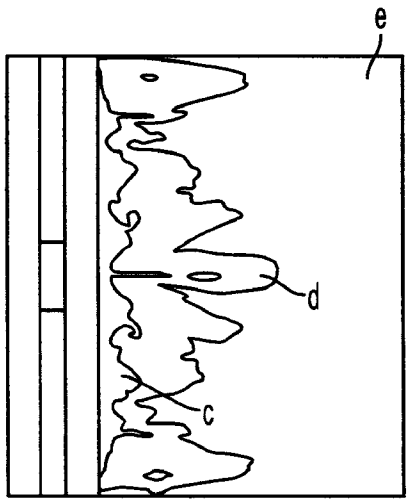
FIG. 22B is a schematic showing the degree of rubbilization in the geologic formation a short time after detonation.
Figure 22A:
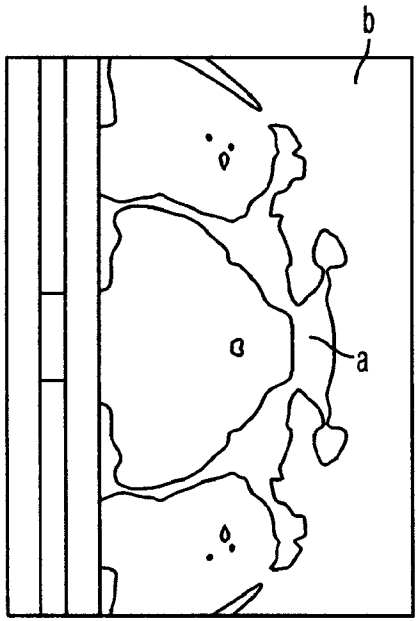
FIG. 22A is a schematic representing high and low stress regions in a geologic formation a short time after detonation.

The disclosed systems and numerical simulations can include consideration of site geologic layering and other properties. The seismic impedance contrast between two material types can create additional release waves in the shock environment. For example, an interlayered stiff sandstone/soft shale site can be modeled. The resulting environment predicted for a hypothetical layered site subjected to a two-explosive stimulation is shown in FIGS. 22A-22C. As in previous figures, these figures again show a slice through a 360° rubble zone.

FIGS. 22A-22C do not show a final predicted state (i.e., not full extent of fracturing), but show a point in time chosen to be illustrative of the phenomenology related to geologic layering. FIG. 22A is a contour of rock stress, with high stress regions "a" and low stress regions "b". FIG. 22B displays the volume of fractured material, with zone "c" referring to fully fractured rock and transitioning to zone "d" where the material is in incipient fracture state, and zone "e" where there is no fracture. FIG. 22C displays the same material volume as in FIG. 22B, but material changes between sandstone in zone "g" and shale in zone "h" are shown. FIGS. 22A-22C illustrate that rubblization disks that can be produced in specific geologic locations with reference to the corresponding geologic layers by properly designed charge length and spacing based on known geologic properties. For example, in FIG. 22C, a majority of the rubblization is confined to the shale regions "g" and away from the sandstone region "h".

VIII. Exemplary Chemical Compositions

Chemical compositions disclosed herein are developed to optimize for cylinder energy. Such compositions are developed to provide different chemical environments as well as variation in temperature and pressure according to the desired properties, such as according to the specific properties of the geologic formation in which energy resources are to be extracted.

Compositions disclosed herein can include explosive material, also called an explosive. An explosive material is a reactive substance that contains a large amount of potential energy that can produce an explosion if released suddenly, usually accompanied by the production of light, heat, sound, and pressure. An explosive charge is a measured quantity of explosive material. This potential energy stored in an explosive material may be chemical energy, such as nitroglycerin or grain dust, pressurized gas, such as a gas cylinder or aerosol can. In some examples, compositions include high performance explosive materials. A high performance explosive is one which generates an explosive shock front which propagates through a material at supersonic speed, i.e. causing a detonation, in contrast to a low performance explosive which instead causes deflagration. In some examples, compositions include one or more insensitive explosives. Compositions disclosed herein can also include one or more propellants. In some examples, a propellant includes inert materials, such as brine, water, and mud, and/or energetic materials, such as explosive, combustible, and/or chemically reactive materials, or combinations thereof.

It is contemplated that a disclosed unit can include any explosive capable of creating a desired rubblization zones. Compositions which may be used in a disclosed unit are provided, but are not limited to, U.S. Pat. Nos. 4,376,083, 5,316,600, 6,997,996, 8,168,016, and 6,875,294 and USH1459 (United States Statutory Invention Registration, Jul. 4, 1995—High energy explosives).

In some examples, a composition includes a high-energy density explosive, such as comprising at least 8 kJ/cc, at least 10 kJ/cc, or at least 12 kJ/cc. In some examples, the explosive is a cast-cured formulation. In some examples, the explosive is a pressed powder (plastic bonded or otherwise), melt-cast, water gels/slurries and/or liquid. In some cases thermally stable explosives are included due to high-temperatures in certain geological formations. In some examples, non-nitrate/nitrate ester explosives (such as, AN, NG, PETN, ETN, EGDN) are used for these formulations, such as HMX, RDX, TATB, NQ, FOX-7, and/or DAAF. In some examples, explosive compositions include binder systems, such as binder systems substantially free of nitrate ester plasticizers. For example, suitable binder systems can include fluoropolymers, GAP, polybutadiene based rubbers or mixtures thereof. In some examples, explosive compositions include one or more oxidizers, such as those having the anions perchlorate, chlorate, nitrate, dinitramide, or nitroformate and cations, such as ammonium, methylammonium, hydrazinium, guanidinium, aminoguanidinium, diaminoguanidinium, triaminoguanidinium, Li, Na, K, Rb, Cs, Mg, Ca, Sr, and Ba can be blended with the explosive to help oxidize detonation products. These can be of particular utility with fuel-rich binders are used such as polybutadiene based systems.

In some examples, the disclosed chemical compositions are designed to yield an energy density being greater than or equal to 8, 10, or 12 kJ/cc at theoretical maximum density, the time scale of the energy release being in two periods of the detonation phase with a large amount, greater than 25%, such as greater than 30% to 40%, being in the Taylor expansion wave and the produced explosive being a high density cast-cured formulation.

In some examples, the disclosed chemical compositions include one or more propellants. Propellant charges can be produced from various compositions used commonly in the field, being cast-cured, melt-cast, pressed or liquid, and of the general families of single, double or triple base or composite propellants. For example, a disclosed propellant unit comprises one or more oxidizers such as those having the anions perchlorate, chlorate, nitrate, dinitramide, or nitroformate and cations such as ammonium, methylammonium, hydrazinium, guanidinium, aminoguanidinium, diaminoguanidinium, triaminoguanidinium, Li, Na, K, Rb, Cs, Mg, Ca, Sr, and Ba. A propellant unit can also comprise one or more binders, such as one or more commonly used by one of ordinary skill in the art, such as polybutadiene, polyurethanes, perfluoropolyethers, fluorocarbons, polybutadiene acrylonitrile, asphalt, polyethylene glycol, GAP, PGN, AMMO/BAMO, based systems with various functionally for curing such as hydroxyl, carboxyl, 1,2,3-triazole cross-linkages or epoxies. Additives, such as transition metal salt, for burning rate modification can also be included within a propellant unit. In some examples, one or more high-energy explosive materials are included, such as those from the nitramine, nitrate ester, nitroaromatic, nitroalkane or furazan/furoxan families. In some examples, a propellant unit also includes metal/semimetal additives such as Al, Mg, Ti, Si, B, Ta, Zr, and/or Hf which can be present at various particle sizes and morphologies.

In some examples, chemical compositions include one or more high-performance explosives (for example, but not limited to HMX, TNAZ, RDX, or CL-20), one or more insensitive explosives (TATB, DAAF, NTO, LAX-112, or FOX-7), one or more metals/semimetals (including, but not limited to Mg, Ti, Si, B, Ta, Zr, Hf or Al) and one or more reactive cast-cured binders (such as glycidyl azide (GAP)/nitrate (PGN) polymers, polyethylene glycol, or perfluoropolyether derivatives with plasticizers, such as GAP plasticizer, nitrate esters or liquid fluorocarbons). While Al is the primary metal of the disclosed compositions it is contemplated that it can be substituted with other similar metals/semimetals such as Mg, Ti, Si, B, Ta, Zr, and/or Hf. In some examples, Al is substituted with Si and/or B. Si is known to reduce the sensitivity of compositions compared to Al with nearly the same heat of combustion. It is contemplated that alloys and/or intermetallic mixtures of above metals/semimetals can also be utilized. It is further contemplated that particle sizes of the metal/semimetal additives can range from 30 nm to 40 μm, such as from 34 nm to 40 μm, 100 nm to 30 μm, 1 μm to 40 μm, or 20 μm to 35 μm. In some examples, particle sizes of the metal/semimetal additives are at least 30 nm, at least 40 nm, at least 50 nm, at least 100 nm, at least 150 nm, at least 200 nm, at least 300 nm, at least 400 nm, at least 500 nm, at least 600 nm, at least 700 nm, at least 800 nm, at least 900 nm, at least 1 μm, at least 5 μm, at least 10 μm, at least 20 μm, at least 30 μm, including 30 nm, 40 nm, 50 nm, 100 nm, 150 nm, 200 nm, 300 nm, 400 nm, 500 nm, 600 nm, 700 nm, 800 nm, 900 nm, 1 μm, 2 μm, 3 μm, 4 μm, 5 μm, 6 μm, 7 μm, 8 μm, 9 μm, 10 μm, 20 μm, 30 μm, 31 μm, 32 μm, 33 μm, 34 μm, 35 μm, 36 μm, 37 μm, 38 μm, 39 μm, or 40 μm. It is contemplated that the shape of particles may vary, such as atomized spheres, flakes or sponge morphologies. It is contemplated that the percent or combination of high-performance explosives, insensitive explosives, metals/semimetals and/or reactive cast-cured binders may vary depending upon the properties desired.

In some examples, a disclosed formulation includes about 50% to about 90% high-performance explosives, such as about 60% to about 80%, including 50%, 51%, 52%, 53%, 54%, 55%, 56%, 57%, 58%, 59%, 60%, 61%, 62%, 63%, 64%, 65%, 66%, 67%, 68%, 69%, 70%, 71%, 72%, 73%, 74%, 75%, 76%, 77%, 78%, 79%, 80%, 81%, 82%, 83%, 84%, 85%, 86%, 87%, 88%, 89%, or 90% high-performance explosives; about 0% to about 30% insensitive explosives, such as about 10% to about 20%, including 0%, 1%, 2%, 3%, 4%, 5%, 6%, 7%, 8%, 9%, 10%, 11%, 12%, 13%, 14%, 15%, 16%, 17%, 18%, 19%, 20%, 21%, 22%, 23%, 24%, 25%, 26%, 27%, 28%, 29%, or 30% insensitive explosives; about 5% to about 30% metals or semimetals, such as about 10% to about 20%, including 5%, 6%, 7%, 8%, 9%, 10%, 11%, 12%, 13%, 14%, 15%, 16%, 17%, 18%, 19%, 20%, 21%, 22%, 23%, 24%, 25%, 26%, 27%, 28%, 29%, or 30% metals/semimetals; and about 5% to about 30% reactive cast-cured binders, such as about 10% to about 20%, including 5%, 6%, 7%, 8%, 9%, 10%, 11%, 12%, 13%, 14%, 15%, 16%, 17%, 18%, 19%, 20%, 21%, 22%, 23%, 24%, 25%, 26%, 27%, 28%, 29%, or 30% reactive cast-cured binders.

In some examples, a disclosed formulation includes about 50% to about 90% HMX, TNAZ, RDX and/or CL-20, such as about 60% to about 80%, including 50%, 51%, 52%, 53%, 54%, 55%, 56%, 57%, 58%, 59%, 60%, 61%, 62%, 63%, 64%, 65%, 66%, 67%, 68%, 69%, 70%, 71%, 72%, 73%, 74%, 75%, 76%, 77%, 78%, 79%, 80%, 81%, 82%, 83%, 84%, 85%, 86%, 87%, 88%, 89%, or 90% HMX, TNAZ, RDX and/or CL-20; about 0% to about 30% TATB, DAAF, NTO, LAX-112, and/or FOX-7, such as about 10% to about 20%, including 0%, 1%, 2%, 3%, 4%, 5%, 6%, 7%, 8%, 9%, 10%, 11%, 12%, 13%, 14%, 15%, 16%, 17%, 18%, 19%, 20%, 21%, 22%, 23%, 24%, 25%, 26%, 27%, 28%, 29%, or 30% TATB, DAAF, NTO, LAX-112, and/or FOX-7; about 5% to about 30% Mg, Ti, Si, B, Ta, Zr, Hf and/or Al, such as about 10% to about 20%, including 5%, 6%, 7%, 8%, 9%, 10%, 11%, 12%, 13%, 14%, 15%, 16%, 17%, 18%, 19%, 20%, 21%, 22%, 23%, 24%, 25%, 26%, 27%, 28%, 29%, or 30% Mg, Ti, Si, B, Ta, Zr, Hf and/or Al; and about 5% to about 30% glycidyl azide (GAP)/nitrate (PGN) polymers, polyethylene glycol, and perfluoropolyether derivatives with plasitisizers, such as GAP plastisizer, nitrate esters or liquid fluorocarbons, such as about 10% to about 20%, including 5%, 6%, 7%, 8%, 9%, 10%, 11%, 12%, 13%, 14%, 15%, 16%, 17%, 18%, 19%, 20%, 21%, 22%, 23%, 24%, 25%, 26%, 27%, 28%, 29%, or 30% glycidyl azide (GAP)/nitrate (PGN) polymers, polyethylene glycol, and perfluoropolyether derivatives with plasitisizers, such as GAP plastisizer, nitrate esters or liquid fluorocarbons.

In some examples, a disclosed formulation includes about 50% to about 90% HMX, such as about 60% to about 80%, including 50%, 51%, 52%, 53%, 54%, 55%, 56%, 57%, 58%, 59%, 60%, 61%, 62%, 63%, 64%, 65%, 66%, 67%, 68%, 69%, 70%, 71%, 72%, 73%, 74%, 75%, 76%, 77%, 78%, 79%, 80%, 81%, 82%, 83%, 84%, 85%, 86%, 87%, 88%, 89%, or 90% HMX; about 0% to about 30% Al, such as about 10% to about 20%, including 0%, 1%, 2%, 3%, 4%, 5%, 6%, 7%, 8%, 9%, 10%, 11%, 12%, 13%, 14%, 15%, 16%, 17%, 18%, 19%, 20%, 21%, 22%, 23%, 24%, 25%, 26%, 27%, 28%, 29%, or 30% Al (with a particle size ranging from 30 nm to 40 μm, such as from 34 nm to 40 μm, 100 nm to 30 μm, 1 μm to 40 μm, or 20 μm to 35 μm. In some examples, particle sizes of the metal/semi-metal additives are at least 30 nm, at least 40 nm, at least 50 nm, at least 100 nm, at least 150 nm, at least 200 nm, at least 300 nm, at least 400 nm, at least 500 nm, at least 600 nm, at least 700 nm, at least 800 nm, at least 900 nm, at least 1 μm, at least 5 μm, at least 10 μm, at least 20 μm, at least 30 μm, including 30 nm, 40 nm, 50 nm, 100 nm, 150 nm, 200 nm, 300 nm, 400 nm, 500 nm, 600 nm, 700 nm, 800 nm, 900 nm, 1 μm, 2 μm, 3 μm, 4 μm, 5 μm, 6 μm, 7 μm, 8 μm, 9 μm, 10 μm, 11 μm, 12 μm, 13 μm, 14 μm, 15 μm, 16 μm, 17 μm, 18 μm, 19 μm, 20 μm, 30 μm, 31 μm, 32 μm, 33 μm, 34 μm, 35 μm, 36 μm, 37 μm, 38 μm, 39 μm, or 40 μm); about 5% to about 15% glycidal azide polymer, such as about 7.5% to about 10%, including 5%, 6%, 7%, 8%, 9%, 10%, 11%, 12%, 13%, 14%, or 15% glycidal azide polymer; about 5% to about 15% Fomblin Fluorolink D, such as about 7.5% to about 10%, including 5%, 6%, 7%, 8%, 9%, 10%, 11%, 12%, 13%, 14%, or 15% Fomblin Fluorolink D; and about 0% to about 5% methylene diphenyl diisocyanate, such as about 2% to about 4%, including 1%, 2%, 3%, 4%, or 5% methylene diphenyl diisocyanate.

In some examples, a disclosed composition includes at least a highly non-ideal HE is defined as an HE in which 30% to 40% or more of the meta-stably stored chemical energy is converted to HE hot products gases after the detonation front (shock front) in a deflagrating Taylor wave. In some examples, a disclosed composition does not include an ideal HE.

In some examples, a disclosed composition, such as a composition optimized for performance and thermal stability includes HMX, fluoropolymer and/or an energetic polymer (e.g., GAP) and Al. In some examples, other optimized formulations for performance and thermal stability can replace HMX with RDX for reduced cost mixture that also contains a fluoropolymer and/or energetic polymer (e.g., GAP) and Al.

In some examples, a disclosed composition includes 69% HMX, 15% 3.5 μm atomized Al, 7.5% glycidal azide polymer, 7.5% Fomblin Fluorolink D and 1% methylene diphenyl diisocyanate (having an mechanical energy of 12.5 kJ/cc at TMD).

In some examples, an inert surrogate is substituted for Al. In some examples, lithium fluoride (LiF) is one such material that may be substituted in certain formulations as an inert surrogate for Al. Other compounds which have a similar density, molecular weight and very low heat of formation so that it can be considered inert even in extreme circumstances may be substituted for Al. It is contemplated that the percentage of Al to the inert surrogate may range from about 10% Al to about 90% inert surrogate to about 90% Al and 10% inert surrogate. Such compositions may be used to develop models for metal reactions that extend beyond the current temperature and pressures in existing models.

IX. Detonation Command and Control System

The detonation of the explosives, as previously described, can be accomplished using any suitable detonation system or control. As previously mentioned, detonation includes deflagration and also includes initiation of propellant charges if present. In the examples where a capacitor is charged and then discharged to set off a detonator or to initiate a propellant initiator, a high voltage source is typically used to provide this charge. In addition, a fire control signal can be provided to a switch operable to discharge the capacitor to a detonator or intiator to cause detonation of the explosive. Similarly, the fire control signal can control the initiation of combustion of propellant charges. Detonators and propellant combustion initiators, if propellant charges are being used, can be used to respectively detonate explosive charges and initiate propellant combustion. As explained above, the explosive charges and propellant combustion initiation of any one or more detonators and initiators (e.g., plural detonators and initiators) can be controlled to respond to the fire control signal at the same or different times. Although a wide variety of alternative detonation control systems can be used, an exemplary system is described below. In addition, the references to firing or detonating explosives in the discussion below applies equally to initiating the combustion of propellant charges if being used with the explosives. The exemplary system can be used both in the context of detonating explosives for experiments and field testing, such as to determine and evaluate the results of explosions from various explosive charge designs, as well as in commercial applications, such as detonating charges in an underground bore or otherwise positioned underground to fracture rock for petroleum recovery purposes. One such system can be denoted by the phrase "high fidelity mobile detonation physics laboratory" (or by the acronym HFMDPL). The term "laboratory" is used to indicate that the system can be used for detonation of explosives for experimental and evaluation purposes, but the system is not limited to laboratory or experimental use. Thus, the use of the acronym HFMDPL connotates a system that is not limited to experimental applications and any references in the discussion below to experimental applications is simply by way of example.

An exemplary HFMDPL is suitable for applications such as conducting heavily diagnosed high-fidelity detonation testing in remote areas in a highly controlled manner and operates to enhance safety, security and successful test execution. In some examples, this facility is mobile and can be utilized to execute small-scale and large-scale heavily diagnosed HE (high explosive) testing as dictated by project requirements. A desirable form of HFMDPL can be used to accomplish firing or detonation of complex studies (for example, multiple explosive charges) at multiple different remote locations. Safety and security controls can be integrated into the system along with high-fidelity diagnostic and data acquisition capabilities. The HFMDPL can be used to develop/optimize explosive compositions that enhance permeability systems (rock fracturing) that are specific for a particular geologic formation, thereby allowing energy resources (e.g., oil from fracking) to be more effectively obtained.

Many security requirements are set by existing governmental regulations applicable to detonation testing, for example, requirements for HE handling, safety, security and test execution. Several additional requirements can also apply that are specific to the nature of HE system characterization testing, mine-scale test, and the field-scale testing. The primary components of the HFMDPL comprise a command center and an instrument center that are separated by one another during use. Communication between the command center and instrumentation center is typically accomplished wirelessly, such as by a strongly encrypted high-speed wireless link. A quality assured integrated control system and multiple high-fidelity diagnostic systems can be integrated into the command and control system.

In one example, the HFMDPL comprises two mobile vehicles, such as two trailers, a command center trailer and an instrument center trailer, that are specifically designed and created as a portable facility structure for use in conducting heavily diagnosed high-fidelity detonation testing or commercial explosions, such as for rock fracturing, in remote areas in a highly controlled manner. These vehicle systems can be utilized for conducting firing site and field-scale HE testing.

The HFMDPL also desirably includes a fire set and control system (FSCS). The FSCS can include or be coupled to high voltage detonators, such as several separately timed high voltage detonator systems with a single or common timing firing circuit (which can allow for independent timing control of the detonation of explosive charges and the initiation of combustion of propellant charges) and verification feedback. The HFMDPL can also include personnel safety and security system features, such as one or more interlocks that preclude detonation if not in appropriate status. This system thus can have interlocked access control for HE handling, dry runs and test execution. The system also can include video surveillance of primary control points and test execution. A standardized diagnostics control can also be integrated into the FSCS. These diagnostic systems are conventional and can be utilized to measure physical behavior during detonation events. These data sets can be used for numerical simulation tools, and for verification of test results.

The command and control system can also receive inputs from a plurality of instruments, e.g., instruments 1 through N with N being an arbitrary number corresponding to the number of separate data producing instruments that are used. These instruments can be considered to be a part of the system or more typically separate therefrom even though coupled thereto. The instruments can, for example, include camera systems (such as a fast framing [(FF)] camera and Mega Sun Xenon Lighting System used in diagnostics); x-ray systems; a photon Doppler velocimetry (PDV) system; accelerometers; in situ acoustical instrument instruments such as can be used for measuring damage/rubblization, in situ stress measurement instruments, such as strain-gauges, various time-of-arrival (ToA) measurement systems; as well as other instruments. The camera and lighting systems can use visible wavelengths to produce high-fidelity snapshots in time of material positions (surfaces and fragments), which assists with the analysis of shock and rarefaction waves that have been produced due to an explosion. The PDV instrument system (such as a PDV system with 8 points as is commercially available from NSTech) can be used to produce high-fidelity point measurements of shock and particle motion at a surface, and assists with the analysis of shock and rarefaction waves at the surface under interrogation. An x-ray system (such as a dual head 450 keV x-ray system with controller, scanner and cables) can use x-ray wavelengths to, for example, produce high-fidelity snapshots in time of material positions (surfaces and fragments) through an array of materials (depending on attenuation). These data sets can be used for the analysis of shock and rarefaction waves that have been produced within a system in response to an explosion. Also, a diagnostics control can be integrated into the instrumentation center of the system to facilitate the integration of custom diagnostics into each test as dictated by project requirements. Also, data processing can be accomplished by this system, such as by a computer at the control center that can use commercially available analysis software to analyze the data captured by instruments at the instrumentation center in response to shock waves.

The command and control center can also send instrument control signals, for example from an instrumentation center of the system at instrumentation outputs thereof (which can be discrete or comprise input/outputs for sending and receiving data from instruments). Thus, a plurality of instrumentation outputs, can be provided with each, for example, being provided for coupling to a respective associated instrument for sending instrument control signals to control the associated instrument.

The HFMDPL also can comprise at least one computing hardware apparatus at the command center, such as explained below. Further, the instrumentation center of the HFMDPL can also include a processor, such as a National Instruments FPGA-based controller systems for controlling the data flow and detonation control signals. The command center can also include one or more oscilloscopes (such as commercially available from Textronix) for diagnostic measurements.

The exemplary HFMDPL described below, can be used to execute small-scale high explosives (HE) characterization testing, HE system testing, and the Mine- and Field-scale tests, as well as controlling commercial explosion detonations, such as in connection with explosive underground fracking.

Figure 26A:
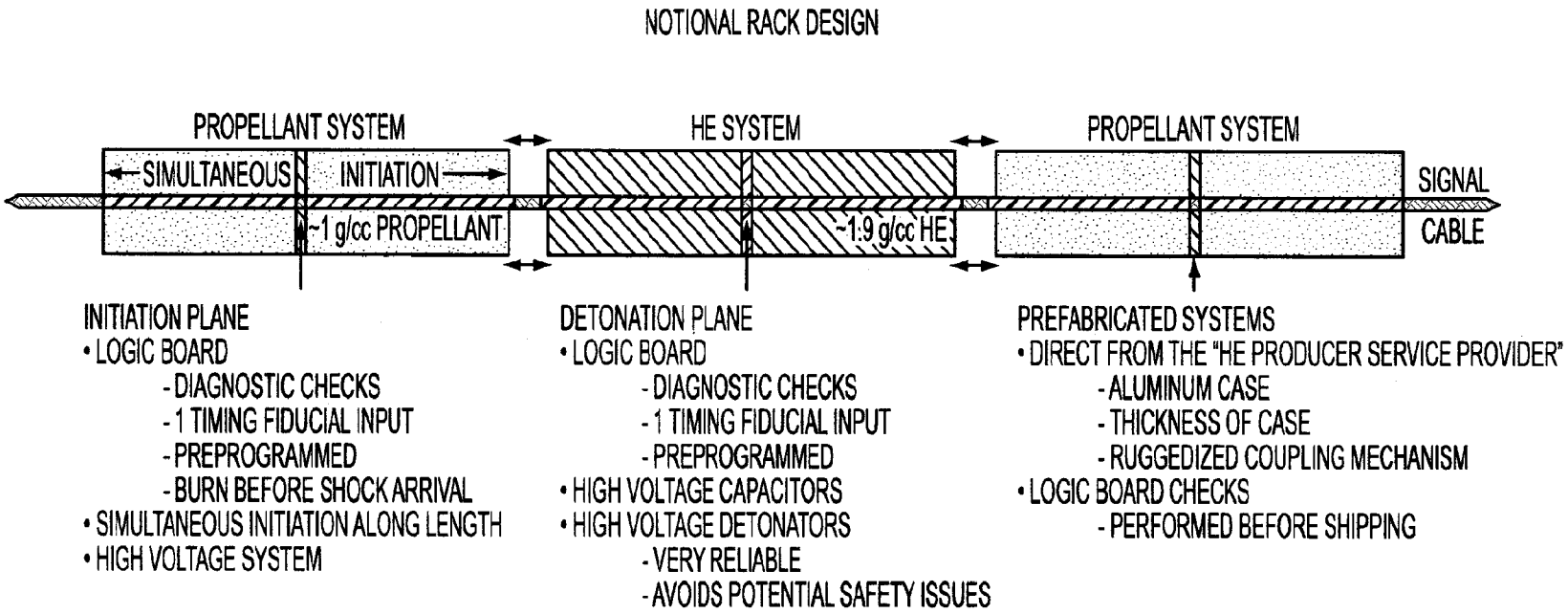
FIG. 26A illustrates detonation planes resulting from the ignition of pairs of propellant containing tubes substantially simultaneously along their entire length and an intermediate pair of high explosive containing tubes from their adjacent ends.
Figure 26B:
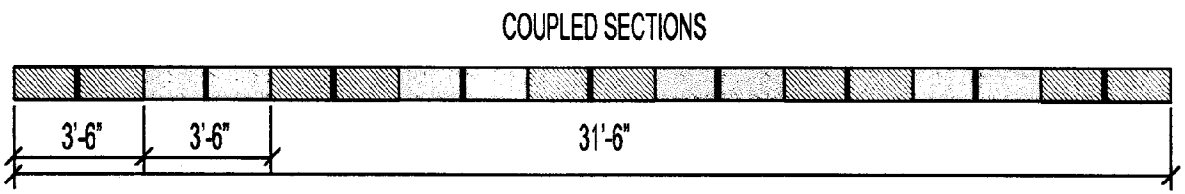
FIG. 26B illustrates an exemplary arrangement of interconnected alternating pairs of propellant and high explosive containing tubes.

In some examples, the HFMDPL is used to characterize specific high energy density non-ideal class 1.1 HE formulations. For example, the HFMDPL can be used for shock front characterization, characterization of the reacting plume of products gases behind the shock front, and the verification of HE manufacturer specifications. The HFMDPL can also be used for characterization of specific HE system configurations. For example, the HFMDPL can be used to characterize systems containing HE, Aluminum and brine (or liquid propellant); and the characterization and validation of self-contained high-voltage detonation systems (detonation planes) [see FIGS. 26A and 26B]; and/or characterization and validation of combined HE-propellant systems.

Mine-scale testing can use conventional diagnostics to analyze data generated from a test explosion to substantially characterize the effects of an HE system within a complex geologic formation without the effects of surface boundary conditions, and to validate/update the associated numerical simulation capabilities required to design such studies. The mine-scale can be used to effectively separate complex issues/developments associated with HE system design and performance from the complex wellbore engineering issues/developments which can utilize these HE system designs once perfected. In some examples, a mine-scale test can include the following: specific diagnostic sets for characterizing HE System functionality and wave interaction characterization within the formation; acoustic techniques for dynamically assessing damage in the formation; postmortem diagnostics for validating this in situ fracturing technique; and seismic and/or micro-seismic diagnostics. The mine-scale test can be designed and used to demonstrate/validate all functions required for executing field-scale HE testing and/or commercial scale fracking for the particular geologic formation. The knowledge gained from the mine-scale test can then be used to update/correct identified flaws in the integrated set of functions required for executing field-scale HE testing. The perfected/validated HE system can be transitioned to a field-scale (down-hole) study. The HFMDPL can then be used for integrating a HE system into an engineered wellbore environment thereby allowing in situ fracturing in a wellbore(s).

The HFMDPL in a desirable form can utilize an HE system to liberate energy resources locked in low permeability geological formations to be released by creating new fracture networks and remobilizing existing fractures while not requiring the underground injection of millions of gallons of water or other chemical additives or proppants associated with the conventional hydraulic fracturing. Further, the disclosed HFMDPL can be used to design systems with charges tailored to specific soil profiles thereby directing the force of the explosion outward, away from the wellbore itself and thereby liberating the desired energy resource.

Figure 27:
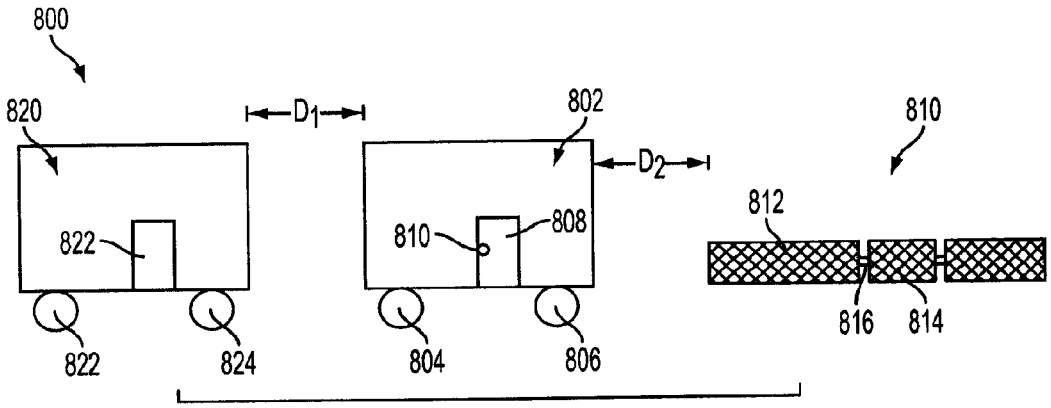
FIG. 27 is a schematic illustration of a command and control system comprising a movable instrumentation vehicle and a movable command center vehicle.

With reference to FIG. 27, an exemplary command and control system 800 is illustrated. The command and control system comprises an instrumentation center 802 which desirably is mobile and comprises a vehicle such as a trailer having sets of wheels 804, 806. The trailer desirably houses various instrumentation control and monitoring apparatus as well as other components, such as described below. The illustrated trailer 802 has a door 808 with a latch 810 that can comprise an interlock operable to send a signal to computing hardware within the trailer to indicate whether the door 808 is latched. The trailer 802 is shown spaced by a distance D2 from an area 810 where an explosive is to be detonated. The illustrated blast area 810 is shown surrounded by a fence 812 with an access point, such as a gate 814 in one section of the fence. Other access points can be provided as well. The gate 814 comprises a latch 816 and an interlock such as at the latch on the gate provides a signal from the gate to the instrumentation trailer, such as via wireless communication or hardwire connections, to indicate whether the gate is closed. Various instruments can be positioned in the blast area for use in evaluating the blast or explosion. Depending upon the instrument, they can be coupled to computing hardware in the trailer 802, such as by hardwire connections or wireless communications, to provide information to the instrumentation center, such as status signals in some cases (e.g., that the instrument has been set with appropriate settings and is operational) and data signals corresponding to data collected by the instruments, such as data resulting from a blast or explosion.

The command and control system 800 also comprises a command center 820 which is desirably mobile and can comprise a vehicle. In FIG. 27, the command vehicle is shown as a trailer with wheels 822, 824 for use in moving the trailer from one location to another. The wheels 804, 806, 822, and 824 can be permanently affixed (via respective axles) to their respective trailers or detachable and used only during movement of the trailers from one blast location to another. The mobility of the command center 820 and instrumentation center 802 allows the command and control system to be readily transported from one blast site to another. In FIG. 27, the command center 820 is shown spaced a distance D1 from the instrumentation center 802. The instrumentation center 802 can be placed relatively close to the blast site 810 whereas the command center is typically placed much further away from the blast center, such as miles away from the blast center. Thus, the distance of the command center 820 to the blast area is desirably greater than the distance from the instrumentation center 802 to the blast area. The command center is shown with a door 822 that can also be provided with an interlock, if desired. However, this is less important since the command center is typically positioned very far away from the blast site.

Figure 28:
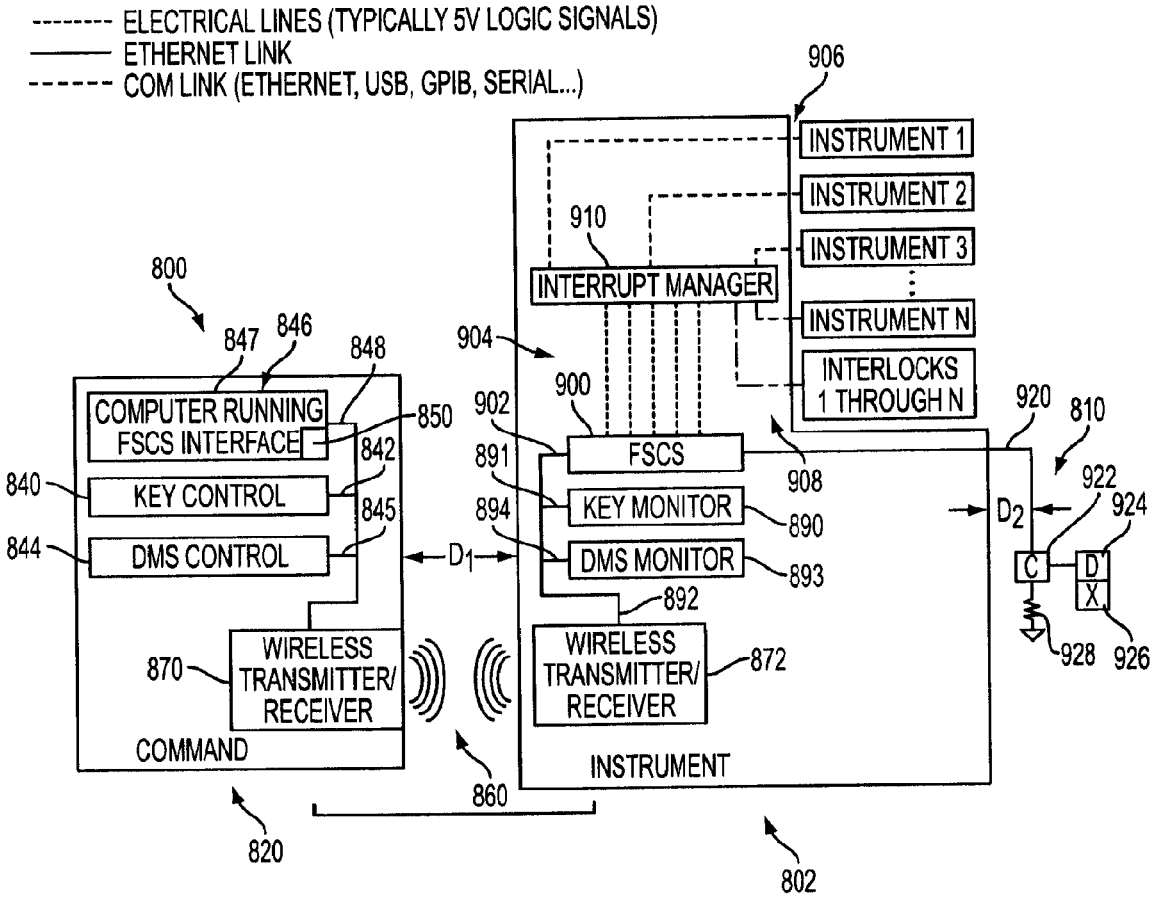
FIG. 28 is a schematic illustration of an exemplary embodiment of a command and control system comprising an instrumentation center and a command center.

FIG. 28 is a schematic illustration of an exemplary instrumentation vehicle or instrumentation center 802 and an exemplary command vehicle or command center 820. In general, in one embodiment, the command vehicle comprises a plurality of detonation control devices that must each produce a detonation authorization signal before the instrumentation trailer can command the occurrence of a detonation. In FIG. 28, one such control device can comprise a key control 840. The key control 840 is actuated by manually turning a key to shift a switch from an off or no fire position to a firing authorized position resulting in the generation of a first fire authorization signal at an output 842 of the key control. In addition, a second switch, such as a dead man switch indicated by DMS control 844 in FIG. 28, can also be provided. The dead man switch can be a manually actuated switch, such as a pedal controlled switch that, when shifted and held in a firing authorization position, causes another (e.g., a second) fire authorization signal to be provided at an output 845 of the DMS control. The command center 820 can also comprise command computing hardware 846, such as a programmed computer 847, configured by programming instructions, an example of which is set forth below, for controlling the operation of the command center to send signals to the instrumentation center resulting in the firing of one or more explosive charges and/or initiation of one or more propellant charges in response to a fire control signal from the instrumentation center as described below. The command center computing hardware, such as the illustrated computer 847, can run an interface program to interface with the instrumentation center and more specifically with fire set and control system computing hardware (FSCS computing hardware) 900 of the instrumentation center. The command center computing hardware can comprise at least one input/output 848 from which signals can be sent and received. The input/output can comprise one or more discrete inputs and plural outputs.

As explained below, the computing hardware 846 can comprise a display 850. The display can display a representation, for example a visual representation in iconic form, of various instruments and interlocks coupled to the instrument center, as well as any instruments and interlocked devices connected or coupled directly to the command center. In addition, a textual description of the instrument can also be displayed along with the icon, if any. Also, the status of the instruments and interlocks (e.g., whether the instruments are operational, whether a door or gate is open or closed, etc.) can be displayed on display 850. In addition, the command center computing hardware can be configured to display a computer implemented switch on display 850 together with the status of the key control and DMS control. These displays can be on a single common screen so that an operator in the command center can readily determine if the command and control system is in a position to cause detonation of the explosives.

A communications network, which can be a wired network, but in one form is desirably a wireless communications network, is shown at 860. Communications network 860 can comprise a transmitter/receiver (transceiver) 870 at the command center and a complimentary transmitter/receiver (transceiver) 872 at the instrumentation center. The communications network facilitates the transmission of data and other signals between the command and instrument centers. The communications network can be an extremely secure network, for example a highly encrypted network, to provide enhanced security over the detonation of explosives. Thus, signals corresponding to the first, second and third detonation authorization signals (corresponding to the key control 840 being placed in its fire authorization position, the DMS control 844 being placed and held in its fire authorization position, and the switch of computer 846 being placed in its fire authorization signal) can be communicated from the wireless transmitter receiver 870 to the transmitter receiver 872 of the instrumentation unit. In this disclosure, the term "corresponding" with reference to signals means that one signal is the same as or derived from or a modification of another signal, such as by signal shaping, filtering and/or other processing. In addition, signals sent or transmitted in response to another signal also can constitute a corresponding signal. A corresponding signal in general conveys or represents information content from the signal to which it corresponds.

The instrumentation center 802 in the illustrated FIG. 28 embodiment comprises a key monitor 890. The monitor can be software implemented and part of the computing hardware at the instrumentation center. The key monitor can operate to monitor input signals on a line 892 from transceiver 872 to determine whether the status of the key control 840 at the command center has been shifted to a position at which the first fire authorization signal has been generated. Thus, the key monitor is looking for a status update corresponding to the positioning of the key control. In addition, a DMS monitor 893, which also can be software implemented or comprise a portion of the computing hardware at the instrumentation center, is provided and can operate to monitor signals on line 892 indicating the status of the DMS control 844 output. The DMS monitor 893 determines whether the DMS control has been shifted to provide a second fire authorization signal corresponding to the second switch being in the fire authorized position. The illustrated DMS monitor 893 can comprise an input 894 for receiving signals from line 892 corresponding to the status of the DMS control 844. The key monitor also can comprise an input 891 for receiving signals corresponding to the status of the key control 840.

Fire set and control system (FSCS) computing hardware 900 is also included in the illustrated instrumentation center 802. The FSCS computing hardware 900 can be a computer like computer 847 as well as other forms of computing hardware, such as an FPGA circuit configured to carry out the functions described below. The FSCS computing hardware comprises an input/output 902 coupled to the line 892 to send signals to and receive signals from the transceiver 872. The input/output 902 can comprise one or more discrete inputs and outputs. The FSCS computing hardware receives the fire authorization signals corresponding to the position of a software implemented switch, if used, at the command center, and signals indicating the key control and DMS control are in their fire authorization positions as determined by the key monitor 890 and DMS monitor 893 and thus can determine whether all three switches are in their fire authorized firing positions.

In addition, the FSCS computing hardware 900 can comprise a plurality of inputs collectively indicated at 904 for receiving signals corresponding to data collected by instruments, interlock related signals and instrument status signals. These inputs can comprise input/outputs and/or discrete outputs at which instrument control signals (e.g., to set operational conditions for the instruments) can be sent from the instrumentation center to respective associated instruments associated with the respective outputs.

The FSCS computing hardware is not limited to only processing these signals.

In the illustrated embodiment, a plurality of instruments for monitoring explosions in a blast zone 810 are provided. In FIG. 28, instruments 1-N are respectively each indicated by an associated block outside of the instrumentation center. It should be understood that, depending upon the instrument, it can be located within or on the instrumentation center structure. In addition, a block is shown in FIG. 28 labeled interlocks I-N. Typically at least one such interlock is included, and more typically a plurality of discrete interlocks. Hence the figure shows 1-N interlocks. The letter N refers to an arbitrary number as any number of instruments and interlocks can be used. Although more than one instrument can be connected to an instrumentation input at the instrumentation center, in the illustrated embodiment, each instrument is shown with an associated input with all of these inputs indicated collectively by the number 906 in FIG. 28. For convenience, the interlocks are shown connected by a common input 908 to the instrumentation center, it being understood that a plurality of interlock inputs would more typically be used with one such input being coupled to each interlock. The inputs 906 and 908 are coupled to the FSCS computing hardware. In this example, these inputs are coupled to respective inputs of an interrupt manager 910 that can comprise a portion of the FSCS computing hardware. The interrupt manager, if used, can for example comprise a field programmable gate array (FPGA) circuit, programmed or configured to carry out the functions described below.

In general, the interrupt manager polls the instruments and interlocks to confirm whether the instruments are in their desired operational status (e.g., settings initialized, instruments adequately powered, set up to respond, responds to test signals) and whether the interlocks are in their desired condition or state for firing of an explosive in the blast zone 810. The interrupt manager can also send programming signals, in the case of programmable instruments, to for example, set parameters for the instruments that place them in their desired operational state. In addition, in the case of remotely controllable interlocks, the interrupt manager can send interlock control signals via input/output 908 to the associated one or more interlocks to, for example, position the interlocks in the desired state (e.g., remotely close a gate and lock it). In addition, upon the occurrence of an explosion in the blast zone, or at other times that data is desired to be collected (e.g., temperature data in a wellbore), instrument data signals corresponding to data such as data gathered as a result of the blasts can be communicated from the respective instruments via inputs 906 to the interrupt manager with signals corresponding to these data signals passed via inputs 904 to, for example, a computer of the FSCS computing hardware. The data can be processed at the FSCS computing hardware or transmitted elsewhere, such as to the command center or to another location for analysis and processing.

Assuming the conditions are right for firing (e.g., all of the fire authorization signals are received from the fire authorization switches at the command center, all of the desired instruments are in an acceptable status to collect data upon firing and the interlocks are in their desired state for firing), a fire control signal output from the FSCS computing hardware is delivered via a line 920 (for example along an electrical conductor or wire) to a charge controller 922. In response, the charge controller causes the detonation of a detonator 924 and/or the initiation of an initiator for a propellant charge in response to the fire control signal and causes the explosive 926 to detonate (or propellant charge to initiate if 926 is a propellant charge). In examples wherein a capacitive discharge system is utilized for detonating the detonator 924, the FSCS computing hardware can also provide a charging control signal along line 920 to cause a high voltage source coupled to charging circuit 922 to charge a capacitor in the circuit 922 to a level such that, when firing is authorized, the capacitor discharges into the detonator 924 (or initiator if this component is an initiator) causing the detonation/initiation. Also, in this specific example, a drain capacitor 928 is shown for selective coupling to the capacitor of circuit 922 to drain the charge from the capacitor if firing does not occur within a predetermined time after the fire control signal, or if a system is to be placed in a safe mode. The fire set and control system computing hardware can generate an appropriate signal along line 920 to cause the discharge of the capacitor to place the system in a safe mode. Thus, if the detonator/initiator is of a type that is detonated/initiated in response to the discharge of a capacitive discharge unit (CDU), the instrumentation unit can provide a CDU discharge control signal to cause the discharge of the CDU to ground potential in the event any one or more of the plural instruments and at least one interlock are not in their authorized to fire status. The discharge control signal can also be sent if the fire authorization signals are absent, or change from a fire authorized to a non-fire authorized status.

It should be understood that various approaches for configuring the computing hardware of the command center and instrumentation center can be used to implement the command and control system. Specific examples of configuration logic, which can be implemented as programming instructions for a computer, are described below. It is to be understood that the disclosure is not limited to these examples.

Figure 29:
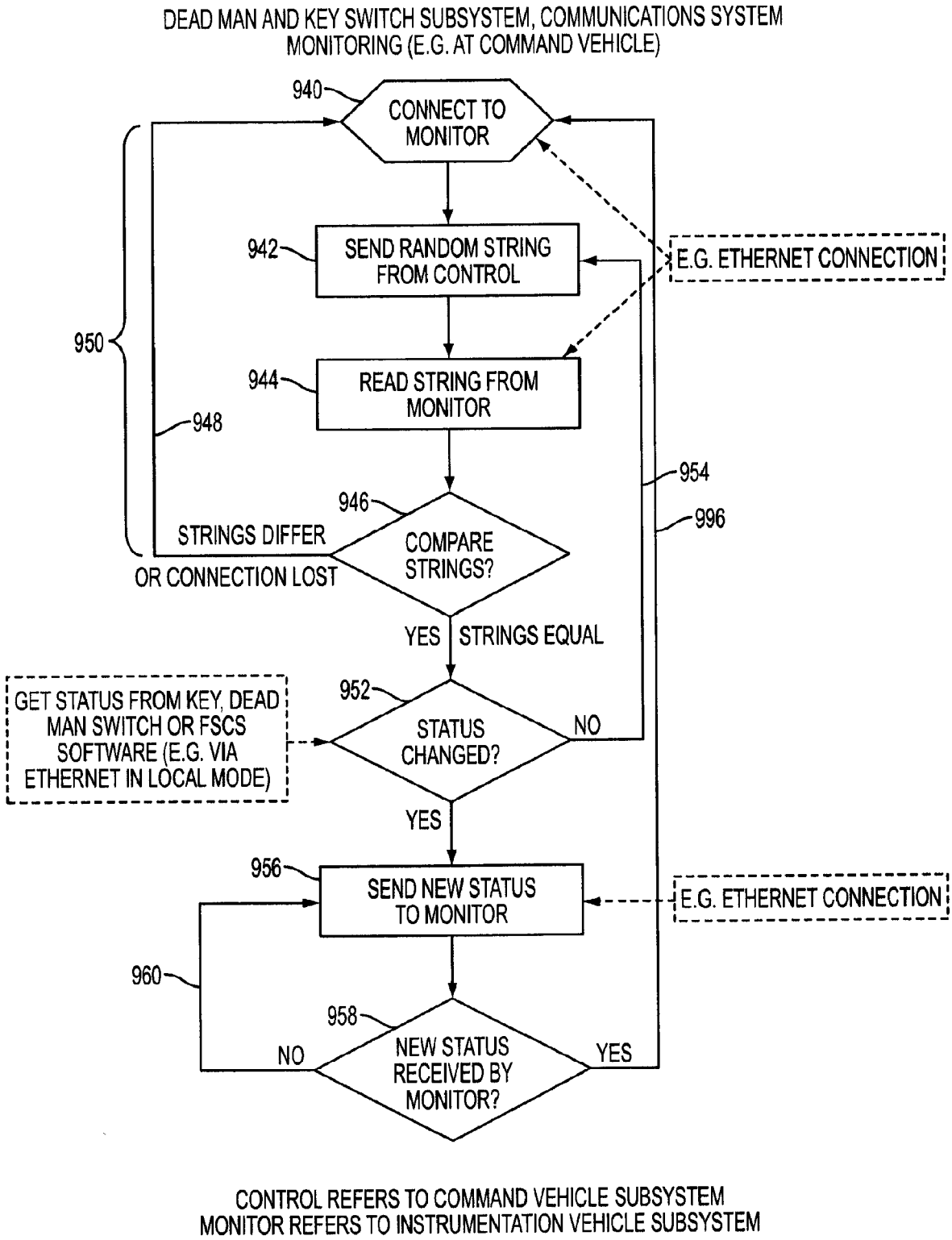
FIG. 29 is a flowchart of exemplary logic for switch and communication system monitoring at the command center.

With reference to FIG. 29, a flow chart for one exemplary approach for communicating the status of the DMS control (or dead man switch) 844 and key control (or key control switch) 840 from the command center to the instrumentation center is described. Alternatively, other switches can be monitored. In addition, this flow chart also illustrates an approach for monitoring the functioning of the communications link at the command vehicle side of the command and control system.

In the examples that follow, dashed lines indicate a communication link, for example an Ethernet connection, established via the communications network 860. In the illustrations, the reference to "Monitor" refers to the instrumentation center side of the command and control system, in addition, the word "Control" refers to the command center side of the command and control system.

The process of FIG. 29 starts at a block 940 referencing establishing a connection between the command center and instrumentation center via the communications network 860. From block 940, a block 942 is reached at which a randomly generated string of data (e.g., a test data packet) is sent from the control center 820 to the instrumentation center 820. At block 944 the control center reads a responsive string of data (e.g., a responsive test data packet) from the instrumentation center with these test strings being compared at block 946. If the test strings differ, for example, the responsive test packet is not what was expected, an error in the functioning of the communications link 860 is indicated (the link can be deemed inoperative while such error exists). In the case of a difference, a branch 948 is followed back to block 940 and testing of the communication link continues. Also, if the return string of data is not received from the instrumentation center by the command center within a desired time, which can be predetermined, and can be a range of times, a determination is made at block 946 that the connection has been lost (the link can be deemed inoperative while the connection is lost). In this case line 948 is also followed back to block 940. Thus, the portion of the flowchart just described, indicated generally at 950, evaluates the functioning of the communication network from the command center side of the system. If the communication network is not functioning, (deemed inoperative), in this exemplary embodiment the explosives will not be detonated.

If at block 946 the test data packet and responsive test data packet match as expected and a responsive test data packet was returned before a time out, then a block 952 is reached. At block 952 a determination is made as to whether the status is changed. More specifically, this block can alternatively comprise separate blocks, at which a check is made for any changes in the status of the key control 840, the DMS control 844 or the computer implemented switch, if any, implemented by the command computing hardware 846. In addition, in one embodiment the command computing system software can be placed in a test mode during which an explosion is blocked. The change in this status to the test mode can be checked at block 952. If the status hasn't changed at block 952, a line 954 is followed back to block 942 and the process of monitoring the communications link and looking for status changes continues. If a status change has been determined at block 952, a block 956 is reached and the new status of the component having a changed status is transmitted to the instrumentation side 802 of the command and control system. At block 958 a check is made as to whether the new status has been received by the instrumentation control side of the system. For example, the instrumentation side 802 can send a signal back to the command side 820 confirming the receipt of the status change. If at block 958 the answer is no, a line 960 is followed back to block 956. On the other hand, if the answer at block 958 is yes, a status change has been updated and a line 996 is followed back to block 940 with the process continuing.

In one embodiment, the command and control system requires each of the detonation authorization signals to be in a detonation authorized state (the status of all such items to be in the authorized firing state) as a precondition to the provision of a fire control signal to an explosive detonator. Also, the system desirably continuously or periodically looks for these status changes.

Figure 30:
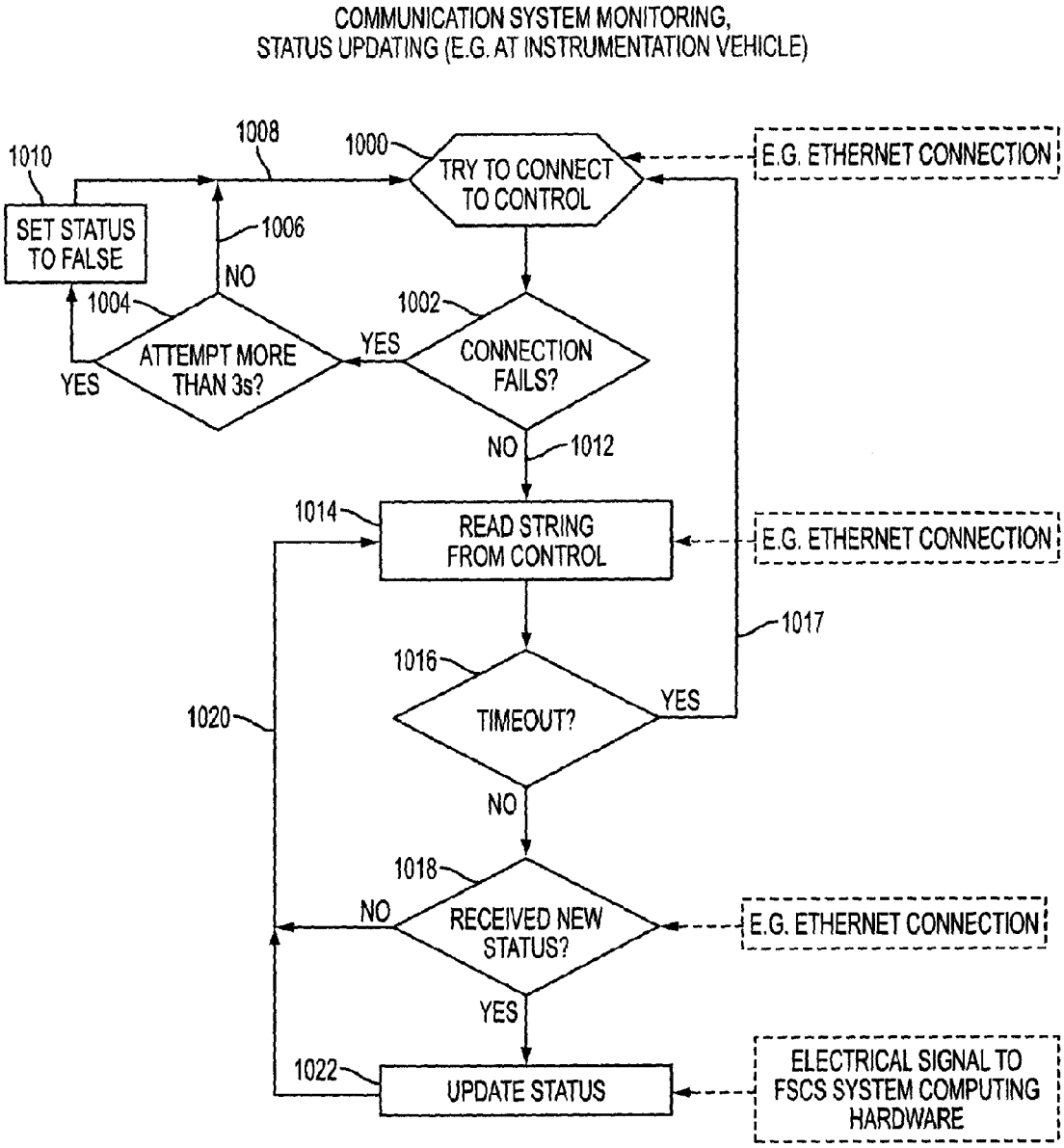
FIG. 30 is a flowchart of exemplary logic for communication system monitoring and status updating at the instrumentation center.

FIG. 30 illustrates an exemplary configuration software or flowchart for the instrumentation center side 802 of the command and control center relating to monitoring the functioning of the communication system from the instrumentation side and also relating to status updating. This sub-process starts at a block 1000, at which the instrumentation center attempts to connect to the command center of the system via the communications network 860. At block 1002 reached from block 1000, a determination is made as to whether the connection has failed. If the answer is yes, a block 1004 is reached at which a determination is made whether attempts have been made for longer than a timeout period, such as three seconds. If the answer is no at block 1004, a line 1006 is followed to a line 1008 and back to block 1000 with attempted connection continuing. If attempts have been made for more than the timeout period, a set status to false block 1010 is reached. At this block one or both of the dead man switch or key control switch outputs are deemed to be in the not authorized to fire state. As a result, no fire control signal will be delivered to the detonator(s) of the explosives under these conditions where communication from the instrumentation side to the command side of the system is determined by the instrumentation center to be lost (the communication link can be deemed inoperative in such a case).

If at block 1002 the connection has succeeded (not failed), a line 1012 is followed to a block 1014 and a data string (e.g., a test data packet) is read from the control side of the system. At block 1016, reached from block 1014, a determination is made as to whether a timeout has been reached. If the timeout is reached, then the data string (e.g., a test data packet) has not been received within a desired time. In this case, a yes branch 1017 is followed from block 1016 back to block 1000 and the process continues. If the data string is received before the timeout time is reached, a block 1018 is reached. Another block, not shown, can be placed between blocks 1016 and 1018 as an option to determine whether a data string match has been achieved, and, if not, the line 1018 can be followed back to block 1000. At block 1018 a determination is made as to whether a new status has been received. Block 1018 can be a plurality of blocks, for example, one being associated with or monitoring the status of each of the switches at the command center side of the system. If the answer is no at block 1018, a line 1020 returns the process back to block 1014. If the answer at block 1018 is yes, at least one of the switches has received a new status (e.g., shifted from a no fire status to a fire authorized status). In this case, the status is updated at block 1022. The process then continues via line 1020 to the block 1014. Thus, the flowchart of FIG. 30 illustrates a method of both verifying the communication system is functioning from the instrumentation side of the command and control system. This flowchart also illustrates a method of updating the status of the plurality of fire authorization switches at the command center that in a desirable embodiment must be actuated to a fire authorized state, before the instrumentation center will send a fire control signal to cause detonation of explosive charges.

The configuration of exemplary FSCS computing hardware can also comprise plural processes which can run in parallel. One such process can address communication within the logic, such as software logic operated at an FSCS computer. Another such process can deal with communication with physical (e.g., electrical) signals, such as from interlocks and instruments.

Figure 31:
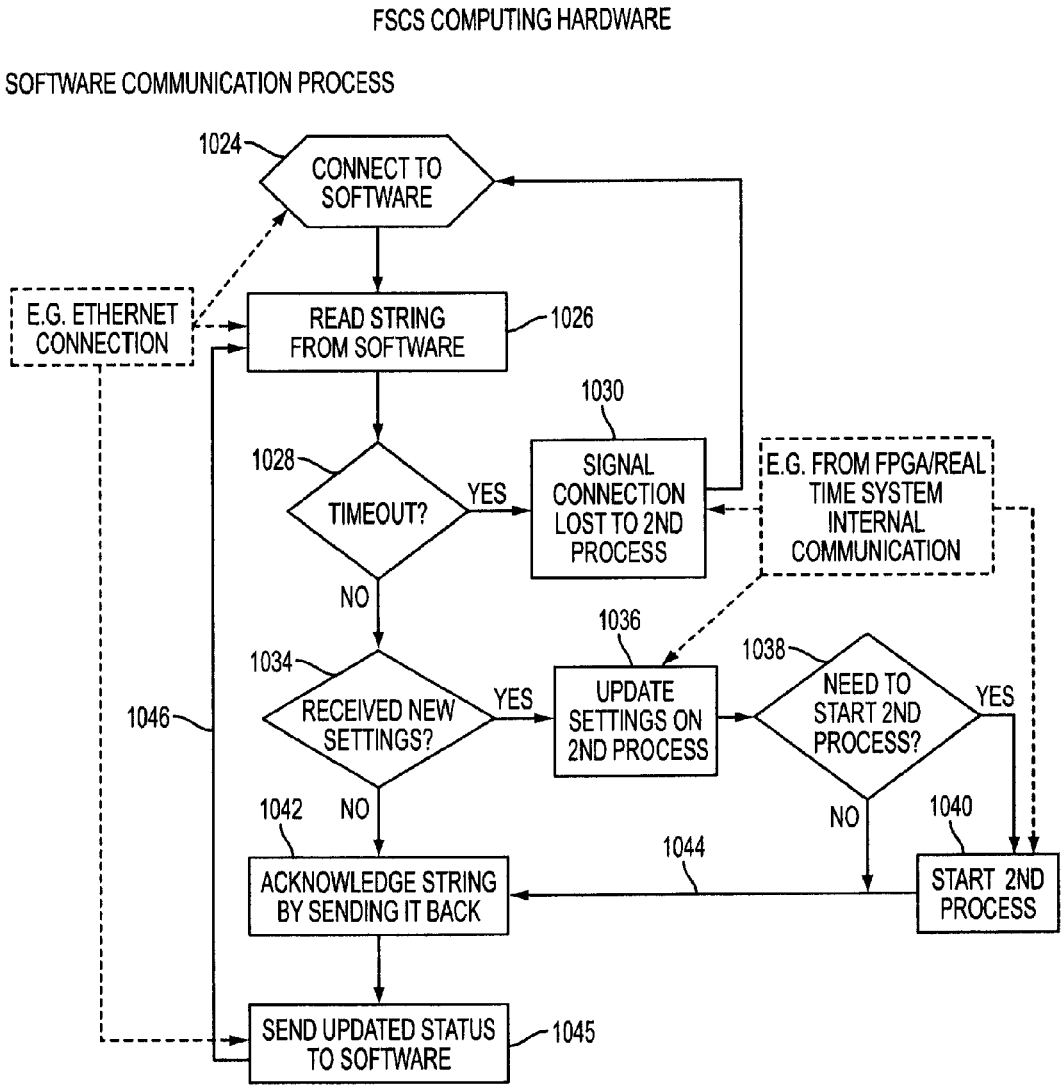
FIG. 31 is a flowchart of exemplary logic for communication processes carried out by computing hardware at the instrumentation center.

An exemplary software communication process for the FSCS computing hardware (which again can be implemented in hardware other than a programmed general purpose computer, such as in a programmable chip) is shown in FIG. 31. The process of FIG. 31 begins at a block 1024 at which a connection is made between the FSCS computing hardware 900 and the FSCS interface software running on computer 847 of the command center. At a block 1026, reached from block 1024, a data string (e.g., a test data packet) is read from the command center. At block 1028 a determination is made as to whether a timeout has been reached before the test data string has been received. If the answer is yes, at a block 1030 the signal connection via the communications network 860 is deemed lost (the communication link can be deemed to be inoperative upon determining that communication is lost) and used by the logic flowchart of FIG. 32 as explained below. In block 1030, the "2nd process" refers to the process dealing with processing electrical or physical signals from external sources, an example of which is explained below in connection with FIG. 32. From block 1030, the process returns to block 1024 and continues. If the timeout is not reached at block 1028, a block 1034 is reached at which a determination is made as to whether any required settings have been received from the command center. Such settings can be entered by a data entry device into the FSCS interface software of the computer 847 at the illustrated command center.

These settings can include attributes such as the timing of any countdown to firing, the identification of interlocks and instruments, as well as their settings and required status to be met before an explosive is detonated. If any new settings are received, a block 1036 is reached and the settings in the 2nd process (FIG. 32) are updated. At a block 1038 reached from block 1036, a determination is made as to whether the 2nd process of FIG. 32 should be started. If the answer is yes, the 2nd process is started as indicated by a block 1040. If the answer at block 1038 is no (the $2^{nd}$ process does not need to be started), a block 1042 is reached via a line 1044. Line 1044 also connects block 1040 to block 1042. At block 1042, the software at the instrumentation center side 802 acknowledges the receipt of the data string (data packet) from the command center side 802 and returns the data string (test data packet) to the command center where it can be checked at the command center for correspondence. From block 1042, a block 1045 is reached at which updated status information is sent from the instrumentation side to the FSCS interface software of the computer 847. This status information can comprise the state of interlocks (e.g., doors and gates are closed) and the status of instruments (e.g., they are operational and set with the appropriate settings to collect data upon the occurrence of an explosion). From block 1045, a line 1046 is followed back to block 1026 and the process continues.

Figure 32:
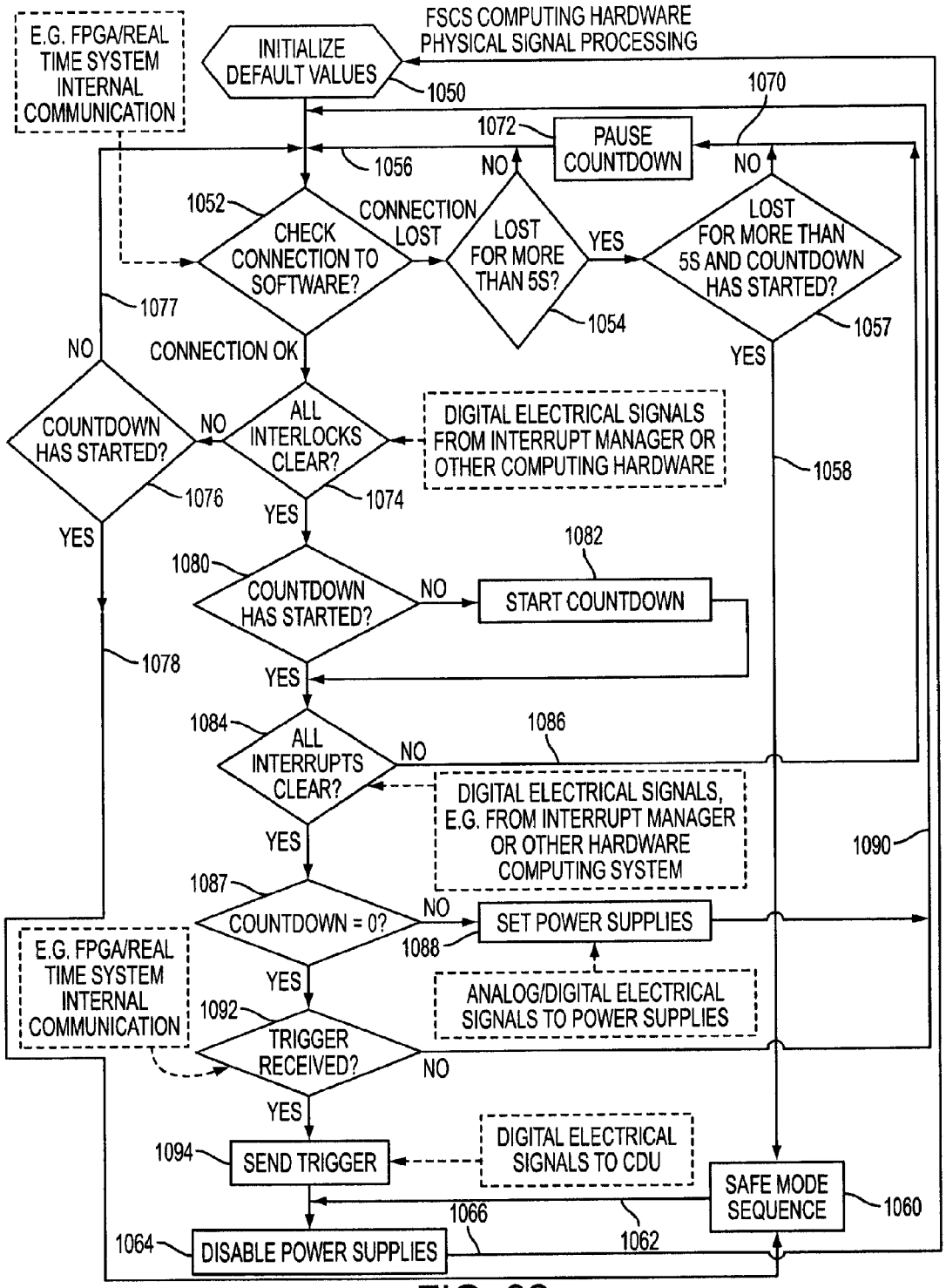
FIG. 32 is a flowchart of exemplary logic for carrying out physical signal processing by computing hardware at the instrumentation center.

With reference to FIG. 32, an exemplary logic, which can be computer implemented program steps or instructions, for the FSCS computing hardware 900 is disclosed for physical signal processing.

The illustrated exemplary process of FIG. 32 starts at a block 1050 at which the FSCS computing hardware causes the components of the system to be initialized to initial default values. For example, the output voltage of the fire control signal line is set to zero if zero volts corresponds to a no fire condition. In addition, if capacitors are used to detonate various detonators to thereby detonate their associated respective explosives, control signals, if needed, can be sent to discharge the capacitors. From block 1050, a block 1052 is reached and a check is made as to whether the instrumentation center of the command and control system is coupled to the FSCS interface software at the command center. This refers back to the process associated with block 1024 in FIG. 31. If the connection has been lost, a determination at a block 1054 is made as to whether the connection has been lost for more than a predetermined time. For example, this time can be established at five seconds. If the answer at block 1054 is no, a line 1056 is followed back to block 1052 and the process continues.

If the connection has been lost for more than the predetermined time as established at block 1054, a block 1057 is reached at which a determination is made as to whether both the firing countdown has started and communication has been lost for more than a predetermined time, such as five seconds. If the answer at block 1057 is yes, the system interrupts the countdown to block firing as the connection between the instrumentation center and command center has been lost (e.g., the communication link is deemed inoperative when the connection is found to be lost) and the countdown has begun. That is, in this case a line 1058 is followed from block 1057 to a block 1060 and a safe mode sequence is started. For example, in a safe mode detonation capacitors can be caused to discharge to ground potential (not to detonators) assuming the capacitors are not automatically discharged in the absence of a firing signal and the fire control signal is blocked. From block 1060, via a line 1062, a block 1064 is reached and the power supplies of the system are disabled so that firing capacitors cannot be charged when in the safe mode in this example. From block 1064, via a line 1066, the process returns to block 1050 and continues as described herein.

On the other hand, if the answer at block 1057 is no, then: (i) communication between the software of the command center and instrumentation center has not been lost for too long and the countdown has not started; (ii) communication has not been lost for too long but the countdown has not started; or (iii) communication has not been lost for too long and the countdown has started. In any of these cases, from block 1057 a line 1070 is reached and followed to a block 1072 and the countdown to firing is paused if it has been started. At block 1072, the process continues via a line 1056 and back to block 1052. At block 1072 if the countdown had not started (e.g., communication was lost for too long prior to beginning the countdown), the countdown is not paused at block 1072 as it had yet to start.

Returning to block 1052 of FIG. 32, if at this block the connection between the FSCS computing hardware of the instrumentation center and the FSCS interface software of the command center is not lost, a block 1074 is reached at which a determination is made as to whether all of the interlocks are clear (in an appropriate status for firing). For example, are all doors and gates that need to be shut in a closed state, and are the DMS, key and software switches at the command center in the authorized firing mode. If the answer at block 1074 is no, a block 1076 is reached and a determination is made as to whether countdown has started. If the answer is no, a line 1077 is followed back to block 1052 and the process continues. If the countdown has started when block 1076 is reached and the interlocks are not clear (for example, the dead man switch has opened), detonation is blocked as a yes branch 1078 is followed from block 1076 to the block 1060 with the safe mode sequence beginning at block 1060 as previously described. The process continues from block 1060 as described above.

Returning to block 1074, assume that all of the interlocks are clear. In this case, from block 1074 a block 1080 is reached at which a determination is made as to whether the countdown to firing (to sending the fire control signal) has started. If the countdown has not started, a block 1082 is reached and the countdown starts. If the countdown was paused at 1072 but the connection at block 1052 has not been lost for too long, when block 1082 is reached the countdown can, for example, be restarted at zero or be started where it left off at the time it was paused. From block 1082 the process continues to a block 1084 at which a determination is made as to whether all of the interrupts are clear. Block 1084 is also reached from block 1080 if the countdown was determined to have started when the query was made at block 1080. At block 1084 a determination is made as to whether the interrupts are in their desired status. Thus, at block 1084 confirmation is made, for example, of whether the instruments needed for the detonation are operational and within their proper settings and proper states to obtain data when an explosion occurs. If the answer at block 1084 is no, a branch 1086 is followed back to block 1072 with the countdown being paused and the process continuing from block 1072 as previously described. The status of the interrupts can be determined from signals, typically digital electrical signals, such as from the interrupt manager computing hardware 910 of FIG. 28.

If at block 1084 a determination is made that all of the interrupts are clear, the countdown check at block 1087 is reached. If the countdown has not reached zero, a block 1088 is reached and power supplies are set (e.g., to charge detonation capacitors if not charged). The process continues from block 1088 via a line 1090 to the block 1052. This again results in the checking of the interlocks and interrupts as the process continues through blocks 1074 and 1084 back to block 1087. If everything remains a go, eventually at block 1087 the countdown will have reached zero. From block 1087, a block 1092 is reached and a determination is made as to whether a trigger signal has been received. The trigger signal in this example can correspond to activation of the third detonation switch at the command center, such as a software implemented switch actuated by touching a display button enabled by the FSCS interface software at the command trailer. This button may have been shifted to a firing state at an earlier stage in the process. If the trigger signal has not been received at block 1092, the line 1090 is reached and the process continues back to block 1052 as previously described. If the trigger signal is determined to have been received at block 1092, from block 1092 a block 1094 is reached and a trigger signal (fire control signal) is sent to cause the detonation of the one or more explosives being controlled and the initiation of combustion of one or more propellant charges. Thus, for example, a fire control signal can be sent to capacitive discharge control units causing the discharge of capacitors to one or more detonators to explode explosive charges associated with the detonators and initiate combustion of propellant charges, if any. Following the sending of the trigger signal, the power supplies are disabled at block 1064 (cutting off power to the detonation circuits to isolate them in this example) and the process continues back to block 1050.

Figure 33:
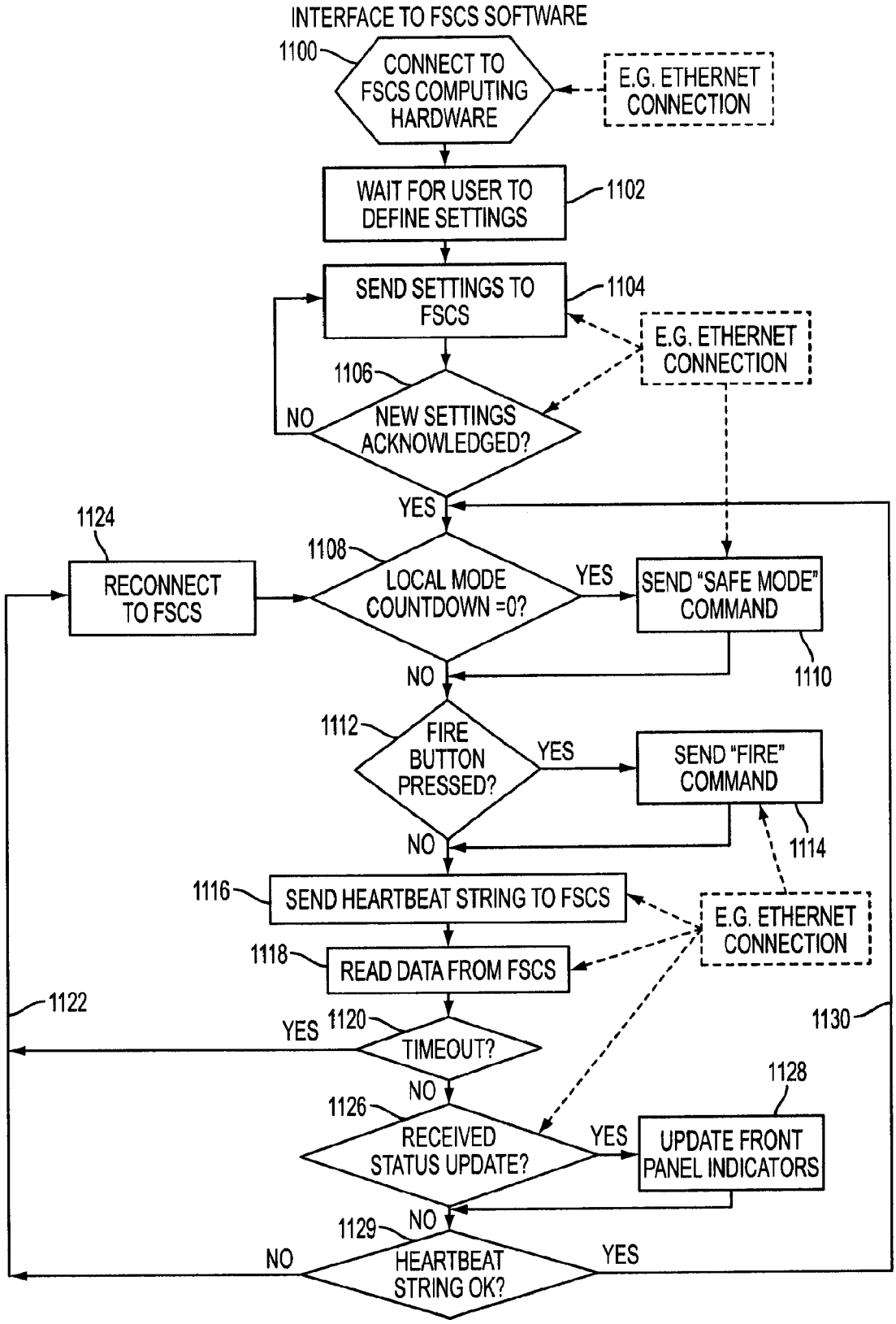
FIG. 33 is a flowchart of exemplary logic for a software interface at the command center.

FIG. 33 illustrates an exemplary FSCS interface software program (or logic flow chart) suitable for running on a computer 847 of the command center for interfacing with the FSCS computing hardware 900 of the instrumentation center. With reference to FIG. 33, this process starts at a block 1100 at which a connection is established between the FSCS interface software of the command center and the FSCS computing hardware 900 of the instrumentation center. At a block 1102, the process pauses to allow a user of the system to define the interlocks, the interrupts, the countdown time and any other settings desired for the system. For example, the user can identify interlocks associated with a specific blast zone, such as different gates controlling access to the zone, doors for various components of the system, and any other interlocks being used in the system. In connection with interrupts, the user can define which instruments are being used in the system and their required status and settings for operation that need to be met before an explosion is allowed to occur.

At block 1104, the settings established at block 1102 are transmitted from the command center to the instrumentation center, such as more specifically to the FSCS computing hardware 900 of the instrumentation center in this example. At block 1106, the interface software is waiting for an acknowledgement from the FSCS computing hardware that the settings have been received. If the answer is no, the process loops back to block 1104 (and the settings are resent) with the process continuing until the settings have been acknowledged. An escape loop can be followed after a time out elapses. From block 1106, a block 1108 is reached corresponding to an optional test mode operation. In this local test mode operation, testing is accomplished without allowing the firing of the explosives. In the test mode, from the time a software enabled switch is actuated to a fire authorized state, the countdown starts. If the countdown is reached (e.g., five minutes), a block 1110 is reached from block 1108 and a signal is sent to the FSCS computing hardware to start the safe mode sequence of block 1060 of FIG. 32. This local countdown can be restarted, for example, by actuating the software enabled switch before the local countdown is reached. The test mode can block firing by overriding the key control and DMS control settings. The test mode does allow testing of the various instrument settings as well as other testing functions. If in the test mode the local countdown has not been reached, the process can continue to test the system with explosive firing being blocked.

If the system is not in the test mode, from block 1106, the block 1112 is reached. At block 1112 a determination is made as to whether the fire button (e.g., the software implemented switch) has been shifted to a fire authorization signal position. If the answer is yes, an authorized fire signal corresponding to the position of the switch is sent from the command center to the instrumentation center as indicated by block 1114. If the answer at block 1112 is no, checking of the communication network continues by sending a heartbeat string of data (test packet) as indicated by block 1116 from the command center to the instrumentation center. At block 1118 data is obtained by the command center from the FSCS computing hardware, such as the instrument status data. If no data is received within a predetermined time, from a block 1120 a branch 1122 is followed to a block 1124 and another attempt is made to reconnect the interface FSCS software to the FSCS computing hardware of the instrumentation center. If data is received before the time out elapses at block 1120, a block 1126 is reached from block 1120. At block 1126 a determination is made as to whether the data updated the status of any of the instruments or interlocks. If so, a block 1128 is reached and a display or other indicators, desirably visual indicators, of the status of the displayed components is updated for easy viewing by an individual at the command center. From block 1128, following display updating, or from block 1126 in the event no status changes have occurred, a block 1129 is reached at which a determination is made as to whether the heartbeat string (e.g., a test packet returned to the FSCS interface software from the FSCS computing hardware of the instrumentation center) is equal to or otherwise matches or corresponds with the heartbeat string (test packet) sent at block 1116. If the answer is no, the assumption is made that the communication link has failed and the process continues via line 1122 to the block 1124. If the answer at block 1128 is yes, the process follows a line 1130 back to block 1108 and continues from there.

Figure 34:
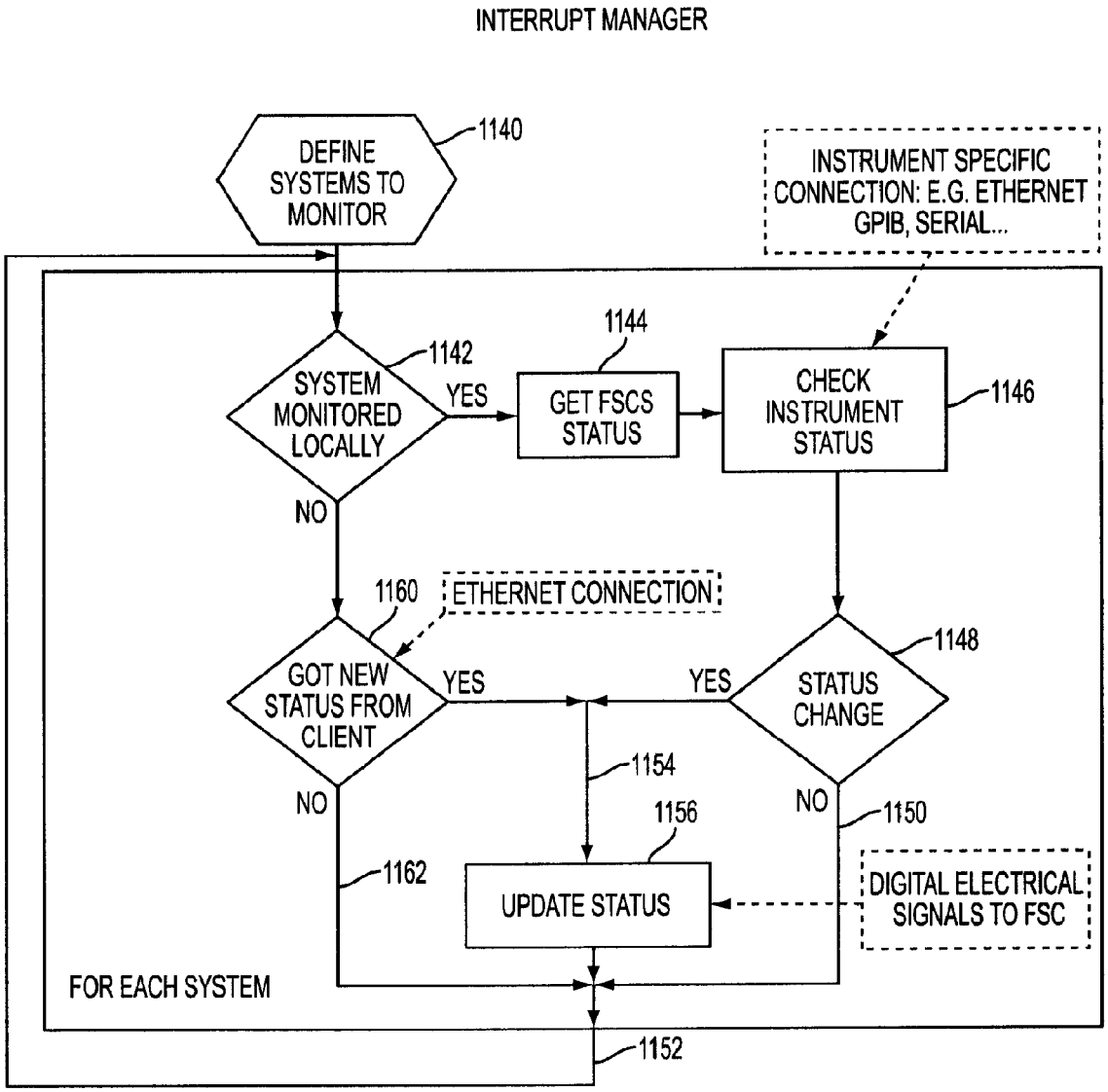
FIG. 34 is a flowchart of exemplary logic for an interrupt manager operable to monitor the status of elements such as instruments coupled to the instrumentation center of the system.

FIG. 34 illustrates an exemplary approach for monitoring interlocks and instruments coupled to the computing hardware at the instrumentation center of the command and control system. In this case, an interrupt manager portion of the computing hardware at the instrumentation trailer can be used for this purpose. The interrupt manager, if used, can be a separate module or an integral portion of the FSCS computing hardware and can be implemented in software programming, if desired.

In FIG. 34, the process commences at a block 1140 at which the systems (e.g., the instruments) and interlocks that are to be monitored at the instrumentation center are defined. Thus, the instruments are identified and set to their desired states. In addition, the interlocks to be monitored are defined with their desired states established. From block 1140, a block 1142 is reached. At block 1142 for all systems (e.g., instruments and interlocks) to be monitored at the instrumentation center, a signal corresponding to their current status is obtained from the FSCS computing hardware, such as from storage in memory of such hardware, as is indicated at block 1144. The instrument status (as well as interlock status) of each actual instrument and interlock is then checked at block 1146 with the checked or determined status resulting in stored status information. At the check instrument status block, new instrument settings can be applied to the instruments. Also, the status check can involve retrieving data from the instruments, such as collected during an explosion, if data has been stored therein. The activities performed during the check instrument status block can depend on the status of the FSCS computing hardware, such as if it is paused, counting, triggered, or in a safe mode. At block 1148, a comparison is made to see if a change in status or data has occurred. If no, a branch 1150 is followed to a line 1152 and the process continues to block 1142. If the answer at block 1148 is yes, a status change is indicated and a branch 1154 is followed to a block 1156 with the status being updated at block 1156.

If a particular instrument or interlock is not being monitored by the instrumentation side of the command and control system, but instead is being monitored at the command center side, from block 1142 a block 1160 is reached with status data being obtained from another source, such as from the FSCS interface of the command center. If the data has not changed (and a comparison can be made in block 1160 to determine if a change has occurred), a no branch 1162 is followed from block 1160 to the block 1152 and the process continues. If the data has changed, the branch 1154 is followed to the block 1156 with the process continuing as previously described.

Again, the process for configuring software and or hardware implementations of the command and control system described above are provided by way of example as other configurations can be used in the command and control system. It should also be noted that the ordering of the steps described in the above examples can be altered if desired.

Figure 35A:
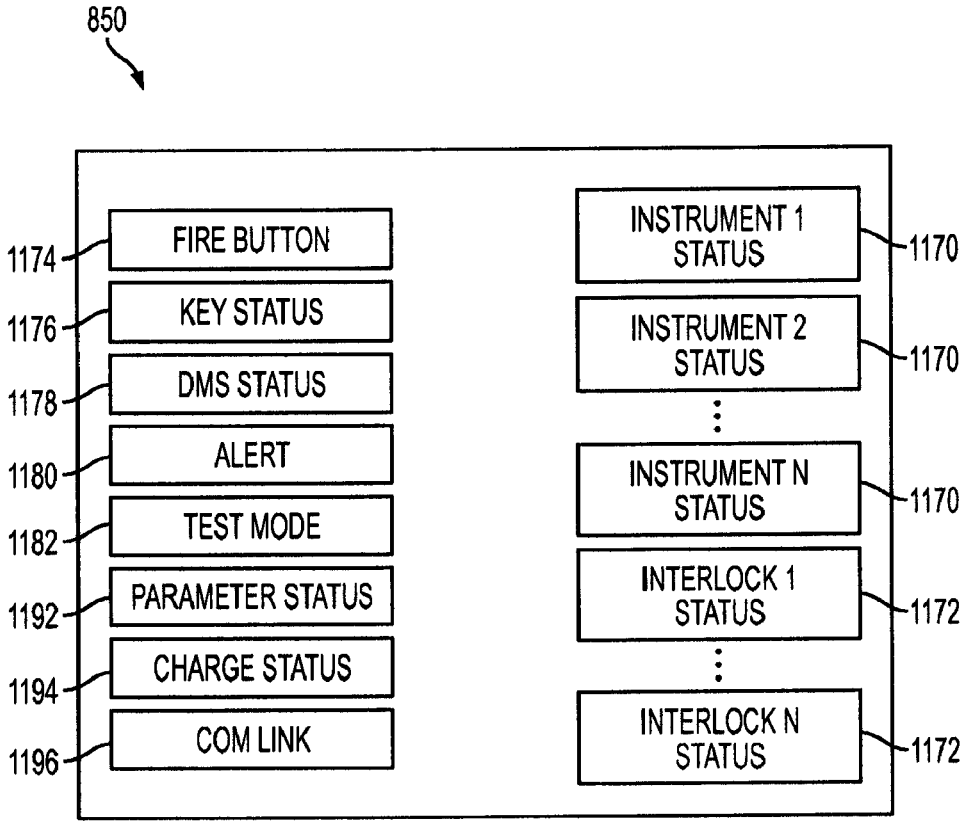
FIG. 35A is a schematic illustration of an exemplary display at the command center.

An exemplary display 850 is shown if FIG. 35A. In this display, a single or common screen can be used to simultaneously display the status of a number of instruments, indicated by blocks 1170, and the status of one or more interlocks, as indicated by the blocks 172. The displays can be textual, iconic or combinations thereof and may include coding (such as red and green dots with red indicating the status is not okay for explosive firing and green indicating an okay status) to indicate quickly to an individual viewing the screen what needs to happen before an explosive is detonated. Besides color, other visual differentiators or indicators can be utilized, such as differing geometric shapes, to indicate the appropriate status. The illustrated display also can include a display of a software implemented switch, labeled "fire button" in FIG. 35A and designated as 1174. The fire button can be actuated to a fire indicating position, such as by positioning a cursor over the button and clicking, touching the button or sliding the button from one position to another in a touchscreen application, or otherwise be actuatable to shift the displayed switch to a fire authorize signal producing state. Indicators such as described above in connection with the instrument status displays can be used to indicate the status of the fire button as well as the status of key and DMS displayed blocks as discussed below.

The illustrated display also in this example can include a block 1176 displaying the status of the key control 840 (FIG. 28) and a block 1178 indicating the status of a dead man switch control 844 (FIG. 28). These displays are desirable, but optional as the operator can readily see the key and DMS positions without looking at the display since the key and DMS switches are desirably included at the command center where the display is also located.

An alert 1180 can also be displayed. The alert can provide a visual, auditory or both visual and auditory alarm signal or alert in the event that unanticipated conditions occur. For example, one of the instruments can be a motion sensor for sensing motion in the blast zone and/or a camera for monitoring the blast zone with an alert being provided if motion is detected. The alert status can be associated with a respective fire authorization signal, such as previously described in connection with the key and DMS status signals. The fire authorization signal associated with the alert can be generated if an alert condition does not exist.

A display block 1182 can be provided and displayed to indicate that the system is in the test mode. The status of various parameters can also be indicated, such as at block 1192. These parameters can be environmental parameters (e.g., wind conditions, temperature conditions, other weather conditions), as well as other conditions desired to be monitored. A display block 1194 can be included to display the charging status and/or status of charging sources used to charge a detonation system. In addition, a display block 1196 can be displayed to indicate the status of the communication link, such as whether it is operational or not. Combinations and sub-combinations of these displayed items can be used. Desirably the fire button, key status, DMS status, interlock, and instrument status are displayed on one screen, with or without the com link status. An authorize to fire status of these components in one embodiment can be required before a trigger or fire control signal is sent from the instrumentation center to detonate the explosive.

Figure 35B:
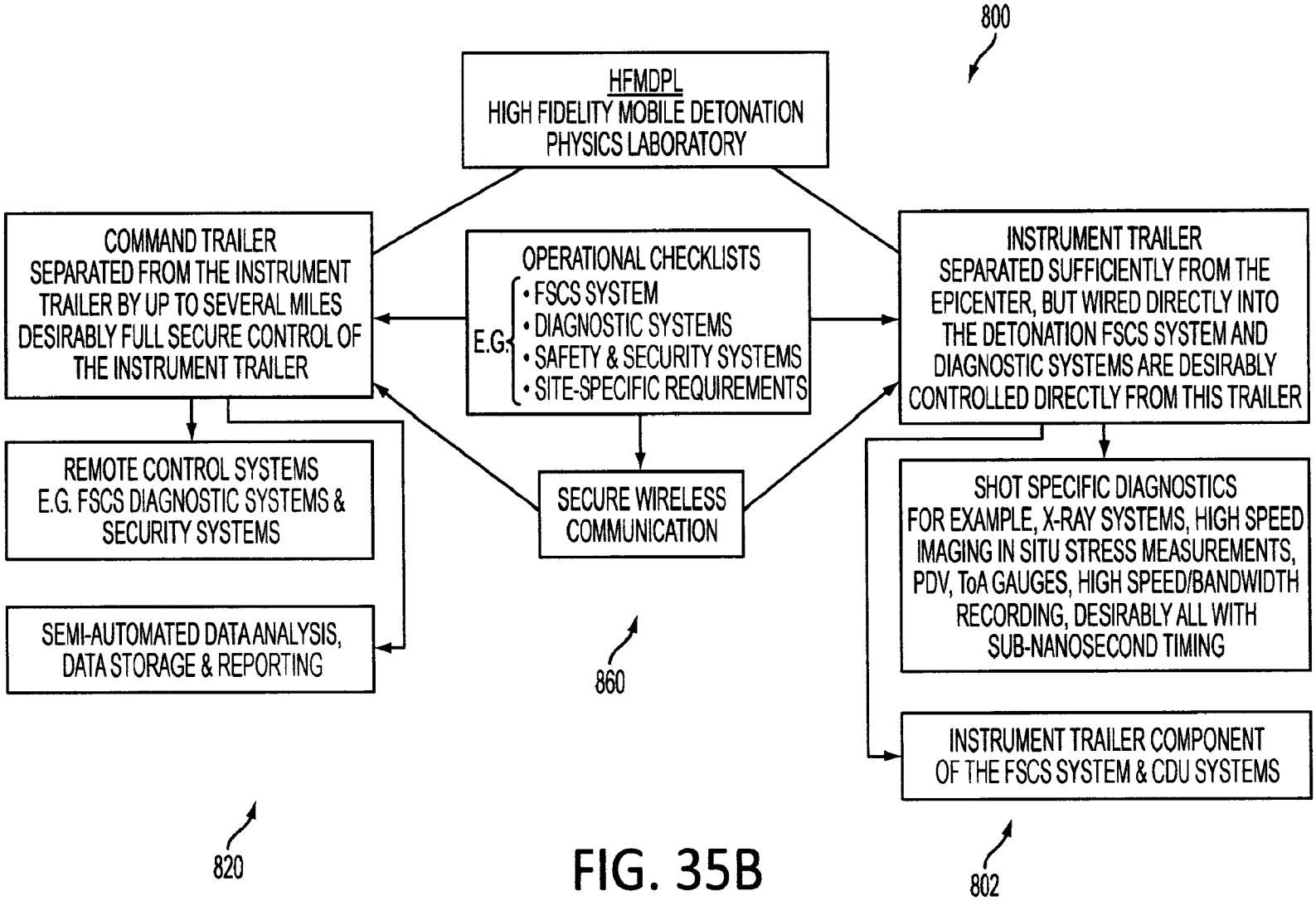
FIG. 35B is a schematic illustration of one example of a functional organization of the various tasks between the command center and instrument center.

FIG. 35B is a high level diagram indicating one suitable division of functions between the command center 820 and instrumentation center 802 of the command and control system. As part of the safety and security systems, requirements established by governmental entities can be built in to the checks that must occur prior to detonating an explosion. To the extent these requirements involve monitoring of instruments, they can be accomplished as previously described. To the extent they are outside the operation of the command and control center, such as requirements for explosive storage, they can be implemented separately from the command and control system.

Figure 35C:
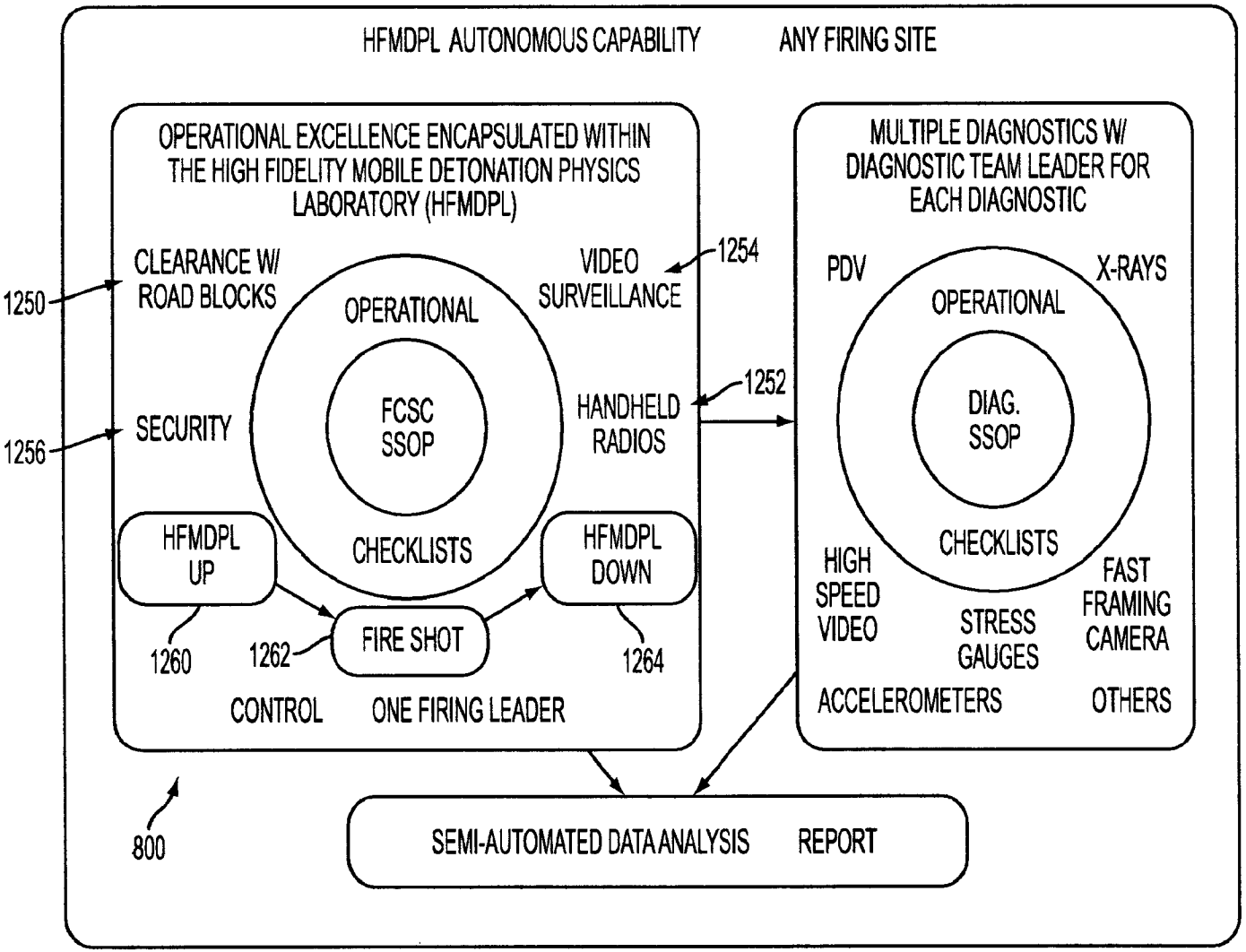
FIG. 35C is a schematic illustration of functions that can be carried out by the command and control center.

FIG. 35C illustrates in a functional manner yet another example of the operation of an exemplary command and control system. The reference to "autonomous capability" and "any firing site" in FIG. 35C simply refers to the fact that a desirable form of the command and control system is mobile and can be moved between different firing sites for use. With reference to FIG. 35C, interlocks in the form of road blocks 1250 are indicated. These interlocks can be manually actuated, such as by an individual at a road block sending a signal to the instrumentation center indicating that the road block is clear. In addition to the communications network, handheld radios can be used or other communications devices for communicating with the instrumentation center (if manned) and command center portions of the command and control system, such as indicated at 1252. Video surveillance, such as accomplished by cameras or otherwise (e.g., satellite surveillance) is indicated at 1254 and can be used to monitor the blast site. Security can refer to the secure aspects of the above-described system, as well as to security personnel. The operational checklist can be implemented as previously described for the FSCS computing hardware and FSCS interface software. The phrase "SSOP" refers to standard safety operations procedures, which can be governmentally prescribed. In connection with handling explosives, various checklists are followed in addition to the control provided by the command and control system.

With the illustrated command and control system, a single team leader (individual) can be in control of whether to trigger an explosion with the leader being positioned at the command center. This approach avoids the need to rely on multiple dispersed individuals to communicate that conditions are right for detonating an explosive.

The HFMDPL up-block 1260 in FIG. 35C refers to setting up the command and control system at the desired location for carrying out the detonation at a blast site. The fire shot block 1262 refers to accomplishing the desired explosion. The HFMDPL down-block 1264 refers to transporting the command and control system to another location. The various diagnostics of an explosion can be accomplished by a respective diagnostic team leader for each respective diagnostic. For example, an individual can be in charge of photon Doppler velocimetry diagnostics, another individual can be in charge of X-ray diagnostics, another individual can be in charge of stress and accelerometer diagnostics, and yet another individual can be in charge of video related diagnostics, and so forth. The computer at the command center can have the capability of analyzing and providing reports concerning the collected data. Alternatively, the data may simply be collected and stored, with the stored data then being transferred via storage media or electronically to another computer at another location for analysis.

Exemplary Computing Environments for Implementing Embodiments of the Disclosed Technology Any of the disclosed methods can be implemented as computer-executable instructions stored on one or more computer-readable media (e.g., one or more optical media discs, volatile memory components (such as DRAM or SRAM), or nonvolatile memory components (such as hard drives)) and executed on a computer (e.g., any suitable computer, including desktop computers, servers, tablet computers, netbooks, or other devices that include computing hardware). In this case, the computer can comprise one form of computing hardware that is configured by programming instructions to carry out the described activities. Any of the computer-executable instructions for implementing the disclosed techniques as well as any data created and used during implementation of the disclosed embodiments can be stored on one or more computer-readable media (e.g., non-transitory computer-readable media). The computer-executable instructions can be part of, for example, a dedicated software program or a software program that is accessed or downloaded via a web browser or other software application (such as a remote computing application). Such software can be executed, for example, on a single local computer or in a network environment (e.g., via the Internet, a wide-area network, a local-area network, a client-server network (such as a cloud computing network), a distributed computing network, or other such network) using one or more network computers.

For clarity, only certain selected aspects of the software-based implementations have been described. Other details that are well known in the art are omitted. For example, it should be understood that the disclosed technology is not limited to any specific computer language or program. For instance, the disclosed technology can be implemented by software written in C++, Java, Perl, JavaScript, Python, or any other suitable programming language. Likewise, the disclosed technology is not limited to any particular computer or type of hardware. Certain details of suitable computers and hardware are well known and need not be set forth in detail in this disclosure.

Furthermore, any of the software-based embodiments (comprising, for example, computer-executable instructions for causing a computer or computing hardware to perform any of the disclosed methods) can be uploaded, downloaded, or remotely accessed through a suitable communication means. Such suitable communication means include, for example, the Internet, the World Wide Web, an intranet, software applications, cable (including fiber optic cable), magnetic communications, electromagnetic communications (including RF, microwave, and infrared communications), electronic communications, or other such communication means.

The disclosed methods can alternatively be implemented by specialized computing hardware that is configured to perform any of the disclosed methods. For example, the disclosed methods can be implemented (entirely or at least in part) by an integrated circuit (e.g., an application specific integrated circuit ("ASIC") or programmable logic device ("PLD"), such as a field programmable gate array ("FPGA")).

Figure 36A:
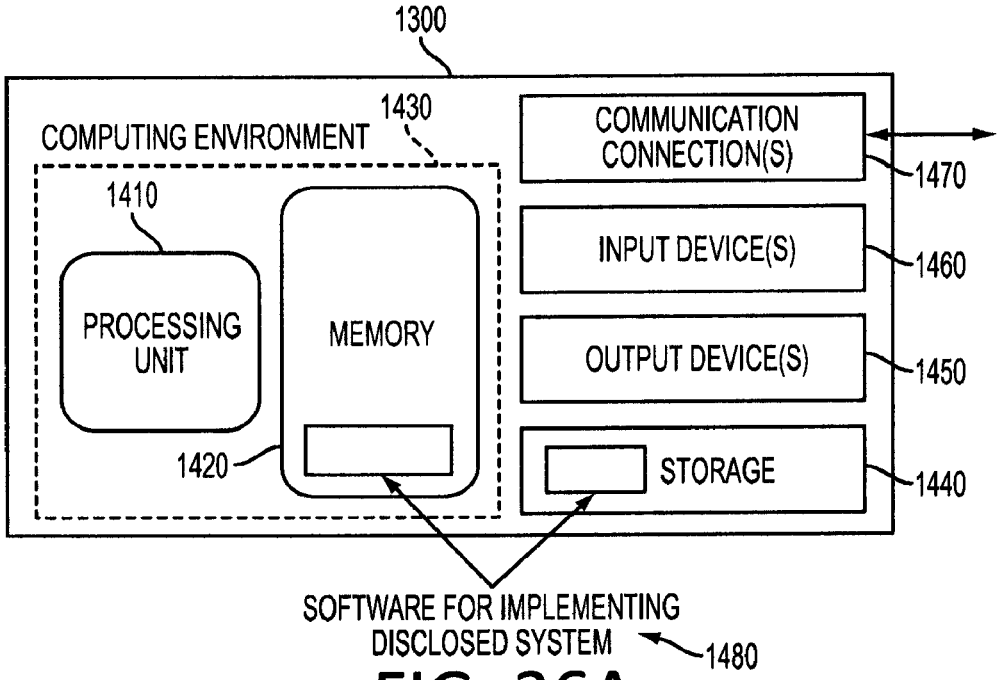
FIG. 36A is a schematic illustration of exemplary computing hardware that can be used both at the command center and instrumentation center for implementing the command and control system functions.

FIG. 36A illustrates a generalized example of a suitable computing environment 1300 in which several of the described embodiments can be implemented. The computing environment 1300 is not intended to suggest any limitation as to the scope of use or functionality of the disclosed technology, as the techniques and tools described herein can be implemented in diverse general-purpose or special-purpose environments that have computing hardware.

Figure 36B:
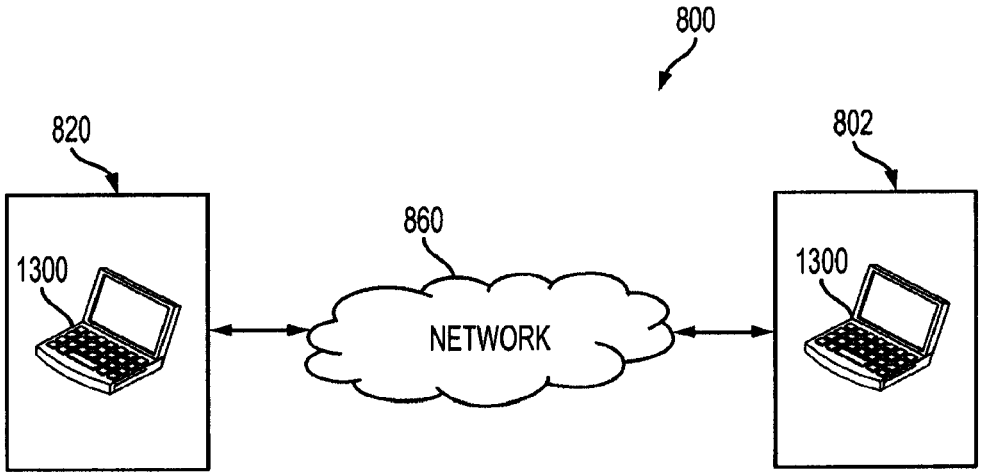
FIG. 36B is a schematic illustration of a communications network providing communications between computing hardware at the command center and computing hardware at the instrumentation center.

With reference to FIG. 36A, the computing environment 1300 can include at least one processing unit 1410 and memory 1420. In FIG. 36B, this most basic configuration 1300 is included within a dashed line. The processing unit 1410 executes computer-executable instructions. In a multiprocessing system, multiple processing units execute computer-executable instructions to increase processing power. The memory 1420 can be volatile memory (e.g., registers, cache, RAM), non-volatile memory (e.g., ROM, EEPROM, flash memory), or some combination of the two. The memory 1420 can store software 1480 implementing one or more of the described logic flowcharts for accomplishing the detonation of explosives and the control techniques described herein. For example, the memory 1420 can store software 1480 for implementing any of the disclosed techniques described herein and user interfaces.

The computing environment can have additional features. For example, the computing environment 1300 desirably includes storage 1440, one or more input devices 1460, one or more output devices 1450, and one or more communication connections 1470. An interconnection mechanism (not shown), such as a bus, controller, or network, interconnects the components of the computing environment 1300. Typically, operating system software (not shown) provides an operating environment for other software executing in the computing environment 1300, and coordinates activities of the components of the computing environment 1300.

The storage 1440 can be removable or non-removable, and can include one or more of magnetic disks, magnetic tapes or cassettes, CD-ROMs, DVDs, or any other tangible non-transitory non-volatile storage medium which can be used to store information and which can be accessed within the computing environment 1300. The storage 1440 can also store instructions for the software 1480 implementing any of the described techniques, systems, or environments.

The input device(s) 1460 can be a touch input device such as a keyboard, touchscreen, mouse, pen, trackball, a voice input device, a scanning device, or another device that provides input to the computing environment 1300. For example, the third detonation switch can be a software implemented and displayed push button or slide switch that is moved to a fire authorize position to cause the provision of a detonation authorization signal. The output device(s) 1450 can be a display device (e.g., a computer monitor, tablet display, netbook display, or touchscreen), printer, speaker, or another device that provides output from the computing environment 1300.

The communication connection(s) 1470 enable communication over a communication medium to another computing entity. The communication medium conveys information such as computer-executable instructions or other data and can be a modulated data or information signal. A modulated data signal is a signal that has one or more of its characteristics set or changed in such a manner as to encode information in the signal. By way of example, and not limitation, communication media include wired or wireless techniques implemented with an electrical, optical, RF, infrared, acoustic, or other carrier. One specific example of a suitable communications network 860 (FIG. 28) for communicating between command and instrumentation centers is a secure two way wireless communication (>802.11n) with a signature heartbeat.

As noted, the various methods can be described in the general context of computer-readable instructions stored on one or more computer-readable media. Computer-readable media are any available media that can be accessed within or by a computing environment. By way of example, and not limitation, within the computing environment 1300, the computer-readable media can include tangible non-transitory computer-readable media, such as memory 1420 and/or storage 1440.

The various methods disclosed herein can also be described in the general context of computer-executable instructions (such as those included in program modules) being executed in a computing environment by a processor. Generally, program modules include routines, programs, libraries, objects, classes, components, data structures, and so on that perform particular tasks or implement particular abstract data types. The functionality of the program modules can be combined or split between program modules as desired in various embodiments. Computer-executable instructions for program modules can be executed within a local or distributed computing environment.

An example of a possible network topology for implementing the command and control system using the disclosed technology is depicted in FIG. 36B. Networked computing device 1300 can be, for example, a computer 847 (FIG. 28) at the command center or vehicle that is running software connected to a network 860. The computing hardware device 1300 can have a computer architecture such as shown in FIG. 36A as discussed above. The computing device 1300 is not limited to a traditional personal computer but can comprise other computing hardware configured to connect to and communicate with a communications network 860 (e.g., tablet computers, mobile computing devices, servers, network devices, dedicated devices, and the like). In the illustrated embodiment, the computing hardware device 1300 is shown at the command vehicle or center 820 and is configured by software to communicate with a computing hardware device 1300 (that also can be a computer having the architecture of FIG. 36A above) at the instrumentation vehicle or center 802 via the network 860. In the illustrated embodiment, the computing devices are configured to transmit input data to one another and are configured to implement any of the disclosed methods and provide results as described above. Any of the received data can be stored or displayed at the receiving computing device (e.g., displayed as data on a graphical user interface or web page at the computing device). The illustrated network 860 can be implemented as a Local Area Network ("LAN") using wired networking (e.g., the Ethernet IEEE standard 802.3 or other appropriate standard) or more desirably by wireless networking (e.g. one of the IEEE standards 802.11a, 802.11b, 802.11g, or 802.11n, with the 802.11n standard being particularly desirable). Alternatively, and less desirably, for security reasons, at least part of the network 860 can be the Internet or a similar public network and operate using an appropriate protocol (e.g., the HTTP protocol).

The following examples are provided to illustrate certain particular features and/or embodiments. These examples should not be construed to limit the disclosure to the particular features or embodiments described.

EXAMPLES

Example 1

Explosive Compositions

This example discloses explosive compositions which can be used for multiple purposes, including environmentally-friendly fracturing.

Background:

Explosive regimes can be divided into three basic temporal stages: reaction in the CJ plane (very prompt reaction in the detonation, ns-μs), reaction in the post-detonation early expansion phase (4-10 μs) and late reaction to contribute to blast effects (1-100's of ms). Work on mixtures of TNT and Al (tritonals) began as early as 1914 and by WWII, where U.S. and British researchers discovered great effects in the third temporal regime of blast and no effects or detrimental effect to the prompt detonation regime. Because of a lack of acceleration in detonation wave speed, it is a commonly held belief in the energetics community that there is no Al participation at the C-J plane. However, some work has demonstrated that replacement of Al with an inert surrogate (NaCl) actually increased detonation velocity as compared to active Al, much more even than endothermic phase change could account for, therefore he postulated that the Al does react in the C-J plane, however it is kinetically limited to endothermic reactions. In contrast, later work did not see as significant a difference in detonation velocity when Al was substituted for an inert surrogate (LiF) in TNT/RDX admixtures. However, this work showed a 55% increase in cylinder wall velocity for late-time expansion for the active Al versus surrogate, with Al contribution roughly 4 μs after the passage of the C-J plane.

Modern high performance munitions applications typically contain explosives designed to provide short-lived high-pressure pulses for prompt structural damage or metal pushing, such as PBXN-14 or PBX9501. Another class of explosives, however, includes those that are designed for longer-lived blast output (enhanced blast) via late-time metal-air or metal detonation-product reactions. An example of an enhanced blast explosive, PBXN-109, contains only 64% RDX (cyclotrimethylenetrinitramine), and includes Al particles as a fuel, bound by 16% rubbery polymeric binder. The low % RDX results in diminished detonation performance, but later time Al/binder burning produces increased air blast. Almost in a separate class, are "thermobaric" type explosives, in which the metal loading can range from 30% to even as high as 90%. These explosives are different from the materials required for the present disclosure, as with such high metal loading, they are far from stoichiometric in terms of metal oxidation with detonation products, and additionally detonation temperature and pressure are considerably lower, which also effect metal oxidation rates. Therefore, such materials are well suited for late-time blast and thermal effects, but not for energy release in the Taylor expansion wave. Formulations combining the favorable initial work output from the early pressure profile of a detonation wave with late-time burning or blast are exceedingly rare and rely on specific ratios of metal to explosive as well as metal type/morphology and binder type. It has been demonstrated that both high metal pushing capability and high blast ability are achieved in pressed formulations by combining small size Al particles, conventional high explosive crystals, and reactive polymer binders. This combination is believed to be effective because the small particles of Al enhance the kinetic rates associated with diffusion-controlled chemistry, but furthermore, the ratio of Al to explosive was found to be of the utmost importance. It was empirically discovered that at levels of 20 wt % Al, the metal reactions did not contribute to cylinder wall velocity. This result is not only counterintuitive, but also is an indication that for metal acceleration applications, the bulk of current explosives containing Al are far from optimal. To fully optimize this type of combined effects explosive, a system in which the binder is all energetic/reactive, or completely replaced with a high performance explosive is needed. Furthermore, very little is understood about the reaction of Si and B in post-detonation environments.

Measurements:

In order to interrogate the interplay between prompt chemical reactions and Al combustion in the temporal reactive structure, as depicted in FIG. R, various measurement techniques are applied. Quantitative measurements in the microsecond time regime at high temperatures and pressures to determine the extent of metal reactions are challenging, and have been mostly unexplored to date. Techniques such as emission spectroscopy have been applied with success for observation of late-time metal oxidation, but the physiochemical environment and sub-microsecond time regime of interest in this study renders these techniques impractical. However, using a number of advanced techniques in Weapons Experiment Division, such as photon doppler velocimetry (PDV) and novel blast measurements, the initiation and detonation/burning responses of these new materials are probed. Predictions of the heats of reaction and detonation characteristics using modern thermochemical codes are used to guide the formulations and comparisons of theoretical values versus measured can give accurate estimations of the kinetics of the metal reactions. From measurement of the acceleration profile of metals with the explosives product gases, the pressure-volume relationship on an isentrope can be fit and is represented in the general form in equation 1, represented as a sum of functions over a range of pressures, one form being the JWL, equation 2.

$$P_s=\Sigma\phi(v) \quad \text{(eq 1)}$$

$$P_s=Ae^{-R_1V}+Be^{-R_2V}+CV^{-(\omega+1)} \quad \text{(eq 2)}$$

In the JWL EOS, the terms A, B, C, $R_1$, $R_2$ and ω are all constants that are calibrated, and $V=v/v_o$ (which is modeled using hydrocodes). With thermochemically predicted EOS parameters, and the calibrated EOS from tested measurements, both the extent and the timing of metal reactions is accurately be accessed, and utilized for both optimization of formulations as well as in munitions design. The time-scale of this indirect observation of metal reactions dramatically exceeds what is possible from that of direct measurements, such as spectroscopic techniques. The formulations are then optimized by varying the amount, type and particle sizes of metals to both enhance the reaction kinetics, as well as tailor the time regime of energy output. Traditional or miniature versions of cylinder expansion tests are applied to test down selected formulations. Coupled with novel blast measurement techniques, the proposed testing will provide a quantitative, thorough understanding of metal reactions in PAX and cast-cured explosives to provide combined effects with a number of potential applications.

Formulation:

Chemical formulations are developed to optimize for cylinder energy. Such formulations are developed to provide different chemical environments as well as variation in temperature and pressure. Chemical formulations may include high-performance explosives (for example but not limited to HMX, TNAZ, RDX CL-20), insensitive explosives (TATB, DAAF, NTO, LAX-112, FOX-7), metals/semimetals (Al, Si or B) and reactive cast-cured binders (such as glycidyl azide (GAP)/nitrate (PGN) polymers, polyethylene glycol, and perfluoropolyether derivatives with plasticizers such as GAP plasticizer, nitrate esters or liquid fluorocarbons). While Al is the primary metal of the disclosed compositions it is contemplated that it can be substituted with Si and/or B. Si is known to reduce the sensitivity of formulations compared to Al with nearly the same heat of combustion.

In order to verify thermoequlibrium calculations at a theoretical state or zero Al reaction, an inert surrogate for Al is identified. Lithium fluoride (LiF) is one such material that may be substituted in certain formulations as an inert surrogate for Al. The density of LiF is a very close density match for Al (2.64 $gcm^{-3}$ for LiF vs 2.70 $gcm^{-3}$ for Al), the molecular weight, 25.94 $gmol^{-1}$, is very close to that of Al, 26.98 $gmol^{-1}$, and it has a very low heat of formation so that it can be considered inert even in extreme circumstances. Because of these properties, LiF is believed to give formulations with near identical densities, particle size distributions, product gas molecular weights and yet give inert character in the EOS measurements. Initial formulations are produced with 50% and 100% LiF replacing Al. An understanding of reaction rates in these environments are used to develop models for metal reactions that extend beyond the current temperature and pressures in existing models.

Resulting material may be cast-cured, reducing cost and eliminating the infrastructure required for either pressing or melt-casting.

Particular Explosive Formulation

In one particular example, an explosive formulation was generated with an energy density being greater than or equal to 12 kJ/cc at theoretical maximum density, the time scale of the energy release being in two periods of the detonation phase with a large amount, greater than 30%, being in the Taylor expansion wave and the produced explosive being a high density cast-cured formulation. A formulation was developed and tested, which contained 69% HMX, 15% 3.5 μm atomized Al, 7.5% glycidal azide polymer, 7.5% Fomblin Fluorolink D and 1% methylene diphenyl diisocyanate (having an mechanical energy of 12.5 kJ/cc at TMD).

Figure 23:
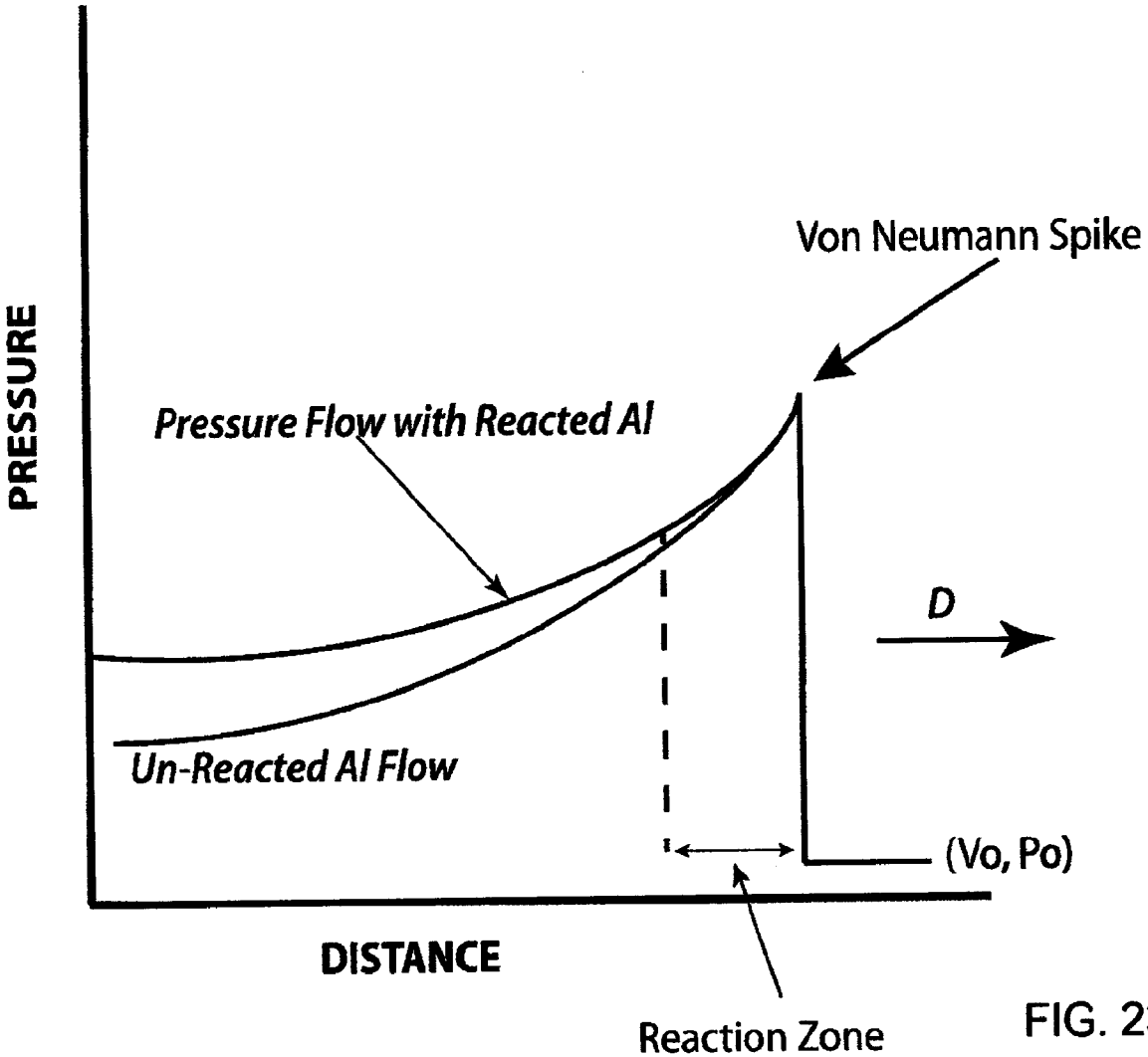
FIG. 23 is a graph of pressure as a function of distance from a bore for an exemplary detonation.

FIG. 23 provides a graphic depiction of a detonation structure of an explosive containing Al reacted or unreacted following flow-Taylor wave. Total mechanical energy in the formulation was equal to or greater than 12 kJ/cc. Greater than 30% of the energy was released in the following flow Taylor Wave of the explosive reaction due to reaction of Al (or other metals or semi-metals such as but not limited to Mg, Ti, Si, B, Ta, Zr, Hf). In the demonstrated explosive, 30-40% of energy was released in the Taylor Wave portion of the reaction. Other similar formulations similar to the above, but with a HTBP based non-reactive binder, failed to show early Al reaction in expansion. Further, formulations with nitrate ester plastisizers and added oxidizer failed to pass required sensitivity tests for safe handling.

Example 2

Use of Environmentally Friendly and Safe Non-Ideal High Explosive (HE) System to Create Fracturing In-Situ within Geologic Formations This example demonstrates the capability of the disclosed non-ideal HE system to be used to create fracturing in-situ within geologic formations.

Experimental/theoretical characterization of the non-ideal HE system was accomplished. The conceptual approach developed to the explosive stimulation of a nominal reservoir began with a pair of explosive charges in the wellbore separated by a distance determined by the properties of the explosive and the surrounding reservoir rock. The separation was the least required to assure that the initial outward going pressure pulse has developed a release wave (decaying pressure) behind was prior to the intersection of the two waves. The volume of material immediately behind the (nominally) circular locus of point where the intersecting waves just passed are loading in tension, favoring the fracture of the rock. The predicted result was a disc of fracture rock being generated out from the wellbore about midway between the charges. Numerical simulation supported this concept. FIG. 20 represents this result, as discussed above. In the center, along the plane of symmetry, the predicted effect of the two wave interaction was seen, projecting damage significantly further radially. The dimensions on this figure are for a particular computational trial, modeling a typical tight gas reservoir rock and are not to be inferred as more than illustrative.

Numeric models to represent the non-ideal HE system were built. Potential target reservoirs were identified, together with existing geophysical characterization of the representative formations. Numerical models to represent these formations were implemented. Numerical simulations indicating potential rubblized regions produced by multiple precision detonation events were calculated. Initial production modeling was conducted. Initial simulations indicated a rubblized region extending 20-30 feet in radius from the borehole.

Figure 24:
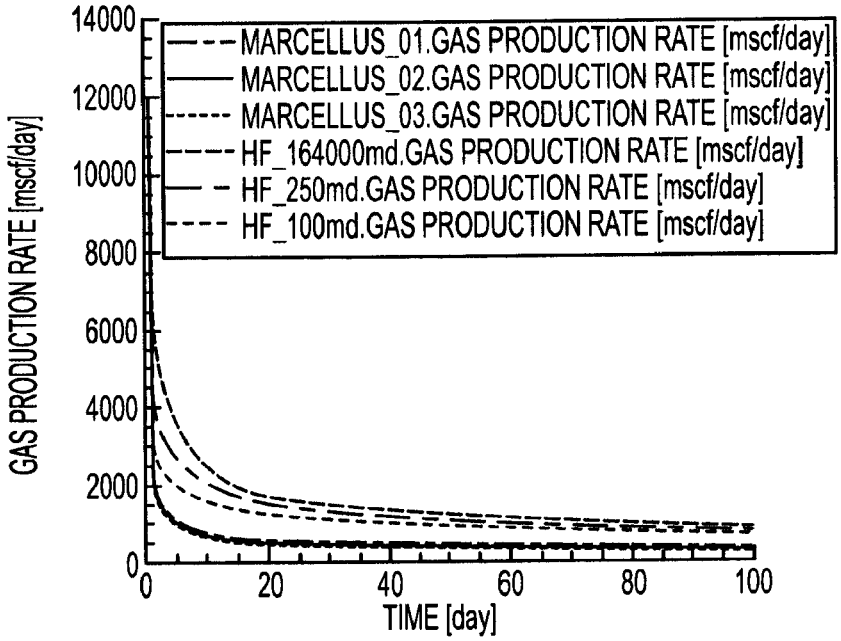
FIG. 24 is a graph of gas production rates as a function of time for different bore sites using different methods for fracturing.
Figure 25:
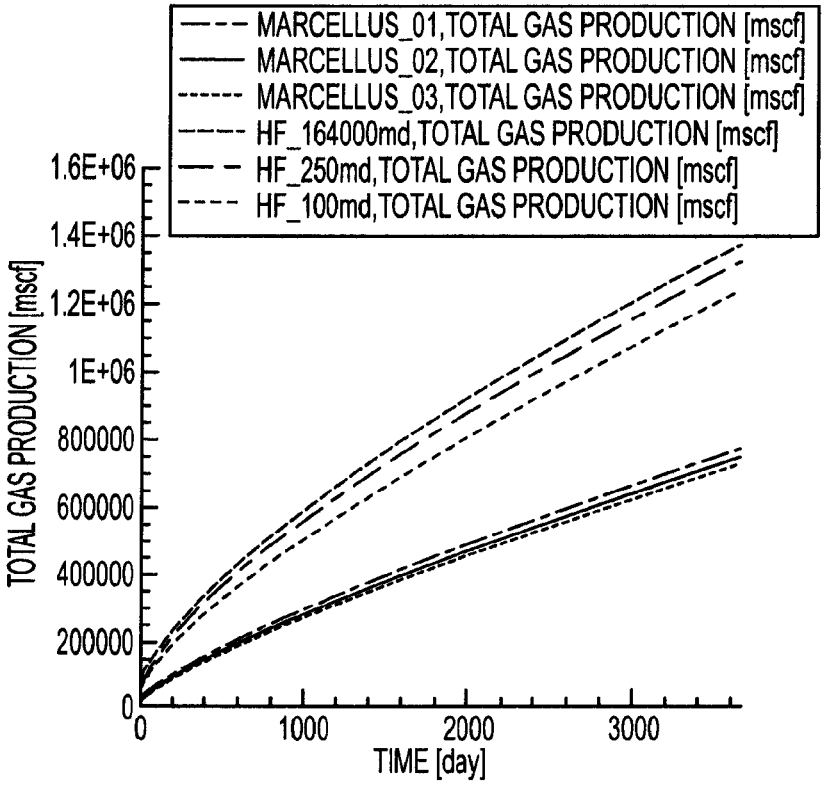
FIG. 25 is a graph of total gas production as a function of time for different bore sites using different methods for fracturing.

FIGS. 24 and 25 illustrate gas production by conventional fracture (solid lines) and rubblized zone (dashed lines) from 250' fractures with varying fracture conductivity or 3 cases of rubblized zones with radius of 20', 24' and 30'.

These studies demonstrate that the disclosed non-ideal HE system is a high energy density system which allows the zone affected by multiple timed detonation events to be extended by utilizing a "delayed" push in the energy in an environment of interacting shock/rarefaction waves. Moreover, the disclosed system allowed fracturing tight formations without hydraulically fracturing the formation and without generating harmful byproducts.

In view of the many possible embodiments to which the principles disclosed herein may be applied, it should be recognized that illustrated embodiments are only examples and should not be considered a limitation on the scope of the disclosure. Rather, the scope of the disclosure is at least as broad as the scope of the following claims. We therefore claim all that comes within the scope of these claims.

We claim:

1. An apparatus for controlling the detonation of an explosive by a detonator comprising:

a movable command center;

the command center comprising at least one manually controlled switch operable to produce a first fire authorization signal when said at least one switch is in a detonate explosive position;

the command center comprising command center computing hardware configured to cause the generation of a second fire authorization signal in response to actuation of displayed fire command switch to a detonate explosive position;

a movable instrumentation center physically spaced from and movable relative to the movable command center;

the instrumentation center comprising fire setting and control system (FSCS) computing hardware having an output for coupling to the detonator and configured to selectively provide a fire control signal to cause detonation of the detonator and explosion of the explosive; the FSCS computing hardware also comprising plural inputs coupled to a plurality of instruments for receiving instrument status signals corresponding to the operational status of such instruments and instrument data signals corresponding to data signals from such instruments; wherein the FSCS computing hardware is configured to selectively provide a fire control signal to cause the detonation of the detonator to detonate the explosive in response to the first and second fire authorization signals providing that the status of the instruments determined based on the instrument status signals is acceptable for detonating the explosive;

a communication network operable to communicate signals from the command center to the instrumentation center and from the instrumentation center to the command center, such communicated signals corresponding to the first and second fire authorization signals, corresponding to the instrument status signals and corresponding to the instrument data signals; and the FSCS computing hardware and command computing hardware being configured to test the operability of the communication network and to prevent the detonation of the detonator and explosion of the explosive in the event the communication network is determined to be inoperative.

2. The apparatus of claim 1 wherein the command center comprises at least a second manually controlled switch operable to produce a third fire authorization signal when said second manually controlled switch is in a detonate explosive position; wherein the FSCS computing hardware is configured to selectively provide the fire control signal in response to the first, second and third fire authorization signals providing that the status of the instruments determined based on the instrument status signals is acceptable.

3. The apparatus of claim 1 wherein the first fire authorization signal is dependent upon the position of a key and the third fire authorization signal is dependent upon the position of a dead man switch.

4. The apparatus of claim 1 wherein the command center is at a first location spaced a first distance from the explosive to be detonated and the instrumentation center is at a second location spaced a second distance from the explosive to be detonated, and wherein the first distance is greater than the second distance.

5. The apparatus of claim 1 wherein both the command center and the instrumentation center comprise mobile vehicles.

6. The apparatus of claim 5 wherein the mobile vehicles each comprise a trailer.

7. The apparatus of claim 1 wherein the command computer hardware and the FSCS computer hardware are each configured to monitor the communications network by causing the sending of test signals and responsive test signals back and forth between the command center and instrumentation center to verify the operation of the communications network, the FSCS computer hardware being configured to prevent the delivery of the fire control signal in the event transmission of signals over the communications network is interrupted or the test signals and responsive test signals transmitted over the communications network between the command center and instrumentation center do not correspond.

8. The apparatus of claim 1 wherein the fire control signal is also provided to control the initiation of a propellant by an initiator.

9. A method of controlling the firing of an explosive comprising:

(a) placing a command center a first distance away from the site at which the explosive is to be detonated;

(b) placing an instrumentation center a second distance away from the site at which the explosive is to be detonated, the second distance being less than the first distance;

(c) establishing a communication link between the command center and instrumentation center and verifying the operation of the communications link at least during times that the explosive may be detonated;

(d) receiving instrument status signals at the instrumentation center indicating the operational status of plural instruments and transmitting signals corresponding to such instrument status signals to the command center;

(e) receiving at least one interlock status signal at the instrumentation center indicating the status of the at least one interlock and transmitting signals corresponding to such interlock status signal to the command center;

(f) providing plural fire authorization signals from the command center to the instrumentation center;

(g) selectively delivering a fire control signal from the instrumentation center to an explosive detonator in response to the plural detonation control signals and providing that the instrument status signals and interlock status signals indicate that the instruments and at least one interlock are in an acceptable status for the explosive to be detonated;

(h) detonating the explosive in response to the fire control signal; and (i) receiving explosion responsive instrument data signals at the instrument center collected by instruments in response to the explosion and transmitting signals corresponding to the instrument data signals to the command center.

10. A method according to claim 9 comprising initiating at least one propellant charge in response to the fire control signal.

11. A method according to claim 9 wherein the act of providing plural fire authorization signals comprises providing first and second and third fire authorization signals in response to the movement of switches to fire authorization positions, first and second of said fire authorization signals being dependent on the position of respective manually actuated first and second switches, the third of said fire authorization signals being dependent upon the actuation of a computing hardware implemented third switch to a fire authorization position, the act of selectively delivering the fire control signal comprises delivering the fire control signal only if all of the first, second and third switches are in a position indicating that the explosive is to be detonated.

12. A method according to claim 9 comprising testing the operation of the communication link and wherein the act of selectively delivering the fire control signal comprises delivering the fire control signal only if testing confirms that the communication link is operational.

13. A method according to claim 9 comprising the act of displaying the status of plural instruments, the status of the computing hardware implemented third switch and the status of the first and second switches on a common display.

14. A method according to claim 13 comprising displaying the status of the at least one interlock on the common display.

* * * * *